US007661986B2

(12) United States Patent
Maesoba et al.

(10) Patent No.: US 7,661,986 B2
(45) **Date of Patent: *Feb. 16, 2010**

(54) CONNECTOR

(75) Inventors: Hiroyoshi Maesoba, Yokkaichi (JP); Hideo Adachi, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/353,289

(22) Filed: Jan. 14, 2009

(65) Prior Publication Data

US 2009/0186524 A1 Jul. 23, 2009

(30) Foreign Application Priority Data

Jan. 17, 2008 (JP) ..... 2008-008091

(51) Int. Cl.
*H01R 13/40* (2006.01)

(52) U.S. Cl. ..... 439/595

(58) Field of Classification Search ..... 439/595, 439/752, 744

See application file for complete search history.

(56) References Cited

U.S. PATENT DOCUMENTS 5,100,346 A 3/1992 McCardell
5,181,862 A * 1/1993 Hawk et al. ..... 439/595
6,077,117 A 6/2000 Iwahori
6,123,574 A 9/2000 Matsuda et al.
6,149,462 A * 11/2000 Sugie ..... 439/595
7,347,745 B1 3/2008 Raudenbush et al.
2009/0011661 A1 1/2009 Imai
2009/0186512 A1 * 7/2009 Adachi et al. ..... 439/350

FOREIGN PATENT DOCUMENTS

JP 6-325814 11/1994

* cited by examiner

*Primary Examiner*—Phuong K Dinh
(74) *Attorney, Agent, or Firm*—Gerald E. Hespos; Anthony J. Casella

(57) ABSTRACT

First terminal fitting accommodating chambers (61A) are arranged in a width direction in a housing (41) of a connector (40) for receiving first terminal fittings (42). A second terminal fitting accommodating chamber (61B) for receiving a second terminal fitting (42) is adjacent the first terminal fitting accommodating chambers (61A) in a height direction and between the first terminal fitting accommodating chambers (61A) in the width direction. First lances (64A) are in the first terminal fitting accommodating chambers (61A) for engaging the inserted terminal fittings (42) and are deformable into first deformation spaces (65A) lateral to the second terminal fitting accommodating chamber (61B). A second lance (64B) is in the second terminal fitting accommodating chamber (61B) for engaging the second terminal fitting (42) and is deformable into a second deformation space (65B) between the first terminal fitting accommodating chambers (61A).

15 Claims, 43 Drawing Sheets

CONNECTOR

BACKGROUND OF THE INVENTION

1. Field of the Invention

The invention relates to a connector.

2. Description of the Related Art

Japanese Unexamined Patent Publication No. H06-325814 and FIG. 50 herein show a connector with a housing 1 and terminal fittings 2 that can be inserted from behind into terminal accommodating chambers 3 formed at upper and lower levels in the housing 1. Locking lances 4 are provided at the ceiling surfaces of the respective terminal accommodating chambers 3 for retaining the terminal fittings 2. The respective locking lances 4 are resiliently deformable upon inserting and withdrawing the terminal fittings 2, and are retracted into deformation spaces 5 defined above the locking lances 2 during the resilient deformations of the locking lances 2.

The above-described connector is large in a height direction since the terminal accommodating chambers, the locking lances and the deformation spaces are arranged one after another in the upper and lower levels.

The present invention was developed in view of the above situation, and an object thereof is to promote miniaturization.

SUMMARY OF THE INVENTION

The invention relates to a connector comprising a housing with first terminal fitting accommodating chambers arranged in an arrangement direction in the housing. Terminal fittings can be inserted into the first terminal fitting accommodating chambers. At least one second terminal fitting accommodating chamber is arranged in the housing at a position adjacent to the first terminal fitting accommodating chambers in a direction at an angle to the arrangement direction. The second terminal fitting accommodating chamber is between the first terminal fitting accommodating chambers in the arrangement direction and can accommodate a terminal fitting. First locking lances are arranged in the first terminal fitting accommodating chambers and are engageable with the inserted terminal fittings. The first locking lances are resiliently deformable into first deformation spaces defined lateral to the second terminal fitting accommodating chamber. At least one second locking lance is in the second terminal fitting accommodating chamber for engaging the terminal fitting inserted therein. The second locking lance is resiliently deformable into a second deformation space defined at least partly between the first terminal fitting accommodating chambers. With this construction, the entire connector can be miniaturized by as much as the overlap of the first deformation space with the second terminal accommodating chamber and the overlap of the second deformation space with the first terminal accommodating chambers in the direction at an angle to the arrangement direction.

A retainer is mountable into and detachable from the housing and includes at least one deformation restricting portion that can enter the first and second deformation spaces for restricting resilient deformations of the first and second locking lances. The retainer preferably is mountable into and detachable from the housing along an inserting direction of the terminal fittings. A jig insertion groove is formed between the first terminal accommodating chambers in the housing for receiving a jig to move the retainer. The retainer preferably is mountable into and detachable from the housing along an inserting direction of the terminal fittings. With this construction, a space between the first terminal accommodating chambers in the housing can be utilized in an effective manner that is suitable for miniaturization.

The jig insertion groove preferably communicates with the second deformation space, and the retainer includes an operable portion to be arranged in the jig insertion groove for operation by the jig. With this construction, as compared with the case where the jig insertion groove does not communicate with the second deformation space, the operable portion is closer to a part of the deformation restricting portion to be inserted into the second deformation space. Therefore, the retainer can have a short height.

An excessive deformation preventing portion preferably is formed in the housing and substantially faces the second locking lance with the second deformation space located therebetween. The excessive deformation preventing portion prevents excessive deformation of the second locking lance. The jig insertion groove preferably is formed by partly cutting off the excessive deformation preventing portion. With this construction, the jig insertion groove can be formed while preventing an excessive resilient deformation of the second locking lance. Therefore, a higher function can be promoted while the connector is kept small.

Two excessive deformation preventing portions preferably are provided at opposite sides of the jig insertion groove. With this construction, the function of preventing excessive resilient deformation of the second locking lance can be exhibited satisfactorily.

A retainer mount recess is formed in the housing for receiving the retainer. The retainer mount recess preferably is adjacent to the first terminal accommodating chambers in the direction at an angle to the arrangement direction and at least partly lateral to the second terminal accommodating chamber. The retainer can be mounted in the retainer mount recess. With this construction, spaces lateral to the second terminal accommodating chamber in the connector housing can be utilized in an effective manner for miniaturization.

The retainer mount recess preferably is arranged lateral to the first deformation spaces. With this construction, a part of the retainer to be mounted into the retainer mount recess is arranged adjacent to and lateral to parts of the deformation restricting portion to be inserted into the first deformation spaces. Therefore, the retainer can have a small height.

The housing is connectable with a mating housing and includes at least one lock arm for holding the mating housing in a connected state. The lock arm preferably is arranged between the first terminal accommodating chambers and partly overlaps the first terminal accommodating chambers in the direction at an angle to the arrangement direction. With this construction, miniaturization in the height direction can be promoted by as much as the overlap of the lock arm with the first terminal accommodating chambers in the height direction.

The number of the first terminal accommodating chambers and the number of the second terminal accommodating chamber in the housing preferably differ. A connecting peripheral surface of the housing with the mating housing preferably is asymmetric when viewed in a connecting direction. The asymmetric peripheral surface prevents the housing from being fit to the mating housing in an improper posture. This construction is more suitable for miniaturization than a case where connection in an improper posture is prevented by a rib on the connecting peripheral surface.

The first and second locking lances preferably are aligned substantially on a straight line in the arrangement direction.

Central positions of the respective terminal fitting accommodating chambers preferably are located at the vertices of an equilateral triangle.

These and other features of the invention will become more apparent upon reading the following detailed description and accompanying drawings. Even though embodiments are described separately, single features may be combined to additional embodiments.

DETAILED DESCRIPTION OF THE PREFERRED EMBODIMENTS

A connector in accordance with the invention is identified generally by the numeral 40 in FIGS. 1 to 49. The connector 40 is to be mounted on a bracket B fixed to an automotive vehicle body (not shown) and is connectable with a mating connector 10. In the following description, ends of the two connectors 10, 40 to be connected are referred to as the front ends, the opposite ends are referred to as rear ends, and reference is made to FIGS. 1, 16 and 47 concerning the vertical or height direction HD.

Figure 13:
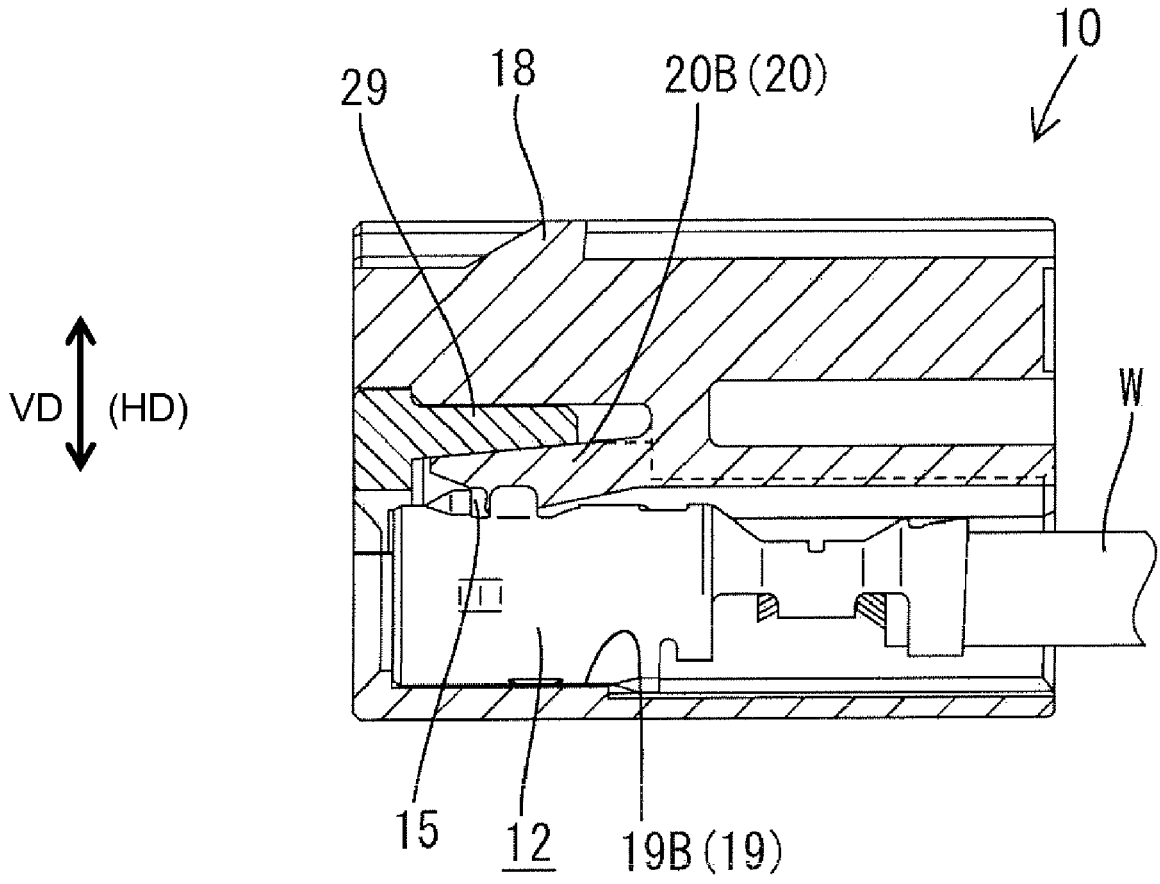
FIG. 13 is a section along A-A of FIG. 14 showing the state where the front retainer is mounted at the fully locked position in the mating housing.
Figure 14:
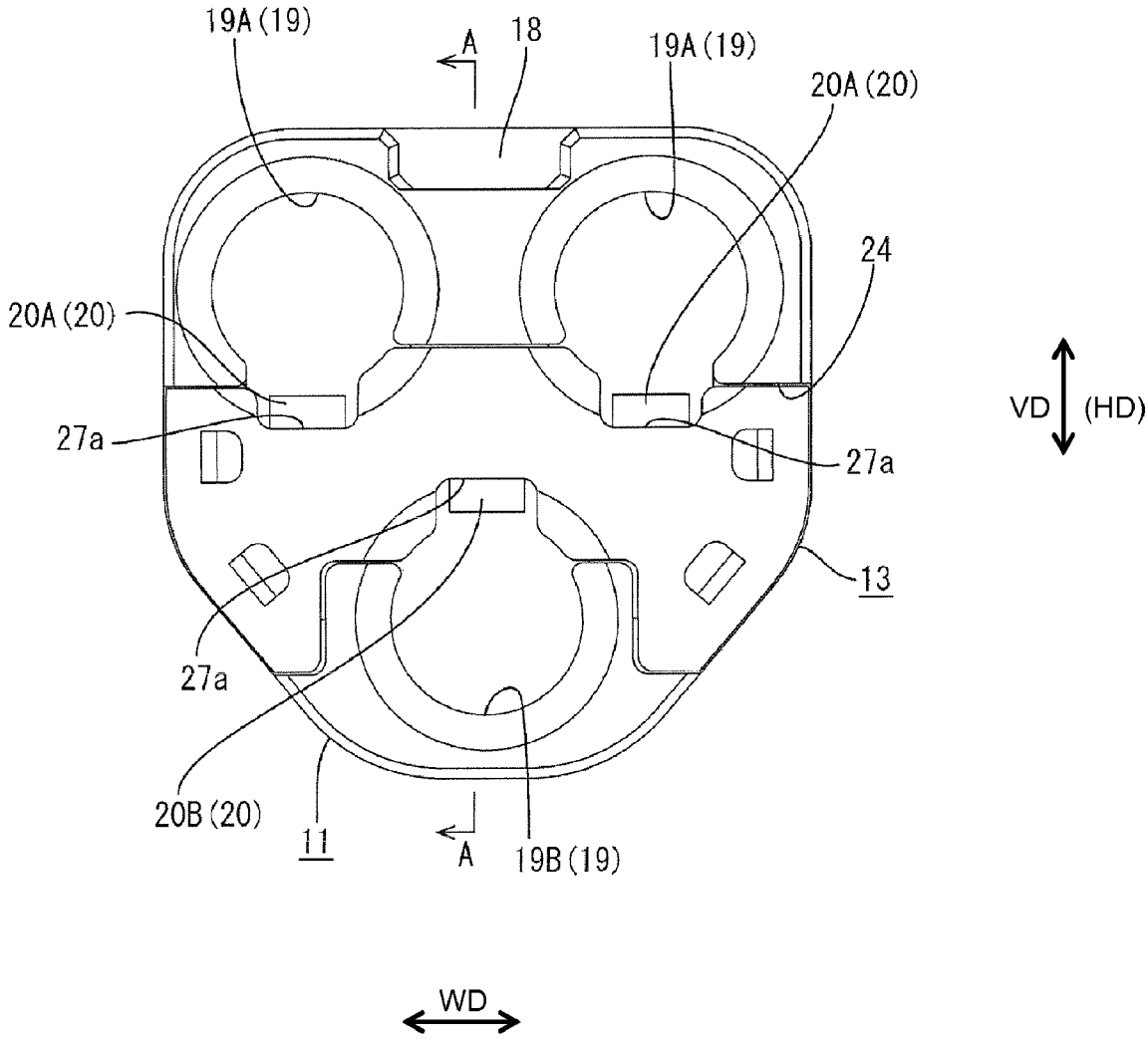
FIG. 14 is a front view showing a state where the front retainer is mounted in the mating housing.

As shown in FIG. 13, the mating connector 10 is provided with a mating housing 11. Mating terminal fittings 12 are accommodated in the mating housing 11 and are connected with ends of coaxial cables W, and a front retainer 13 is mounted to the mating housing 11.

The coaxial cable W connected with the mating terminal fitting 12 has an inner conductor (core), an inner insulating layer, an outer conductor (e.g. a braided wire or conductive film or layer) and an outer sheath arranged substantially concentrically in this order from an axial center. The inner conductor forms a signal wire of an electric circuit of an automotive vehicle and the outer conductor forms a ground conductor of this electric circuit or a shield connected to the ground of this electric circuit.

Figure 10:
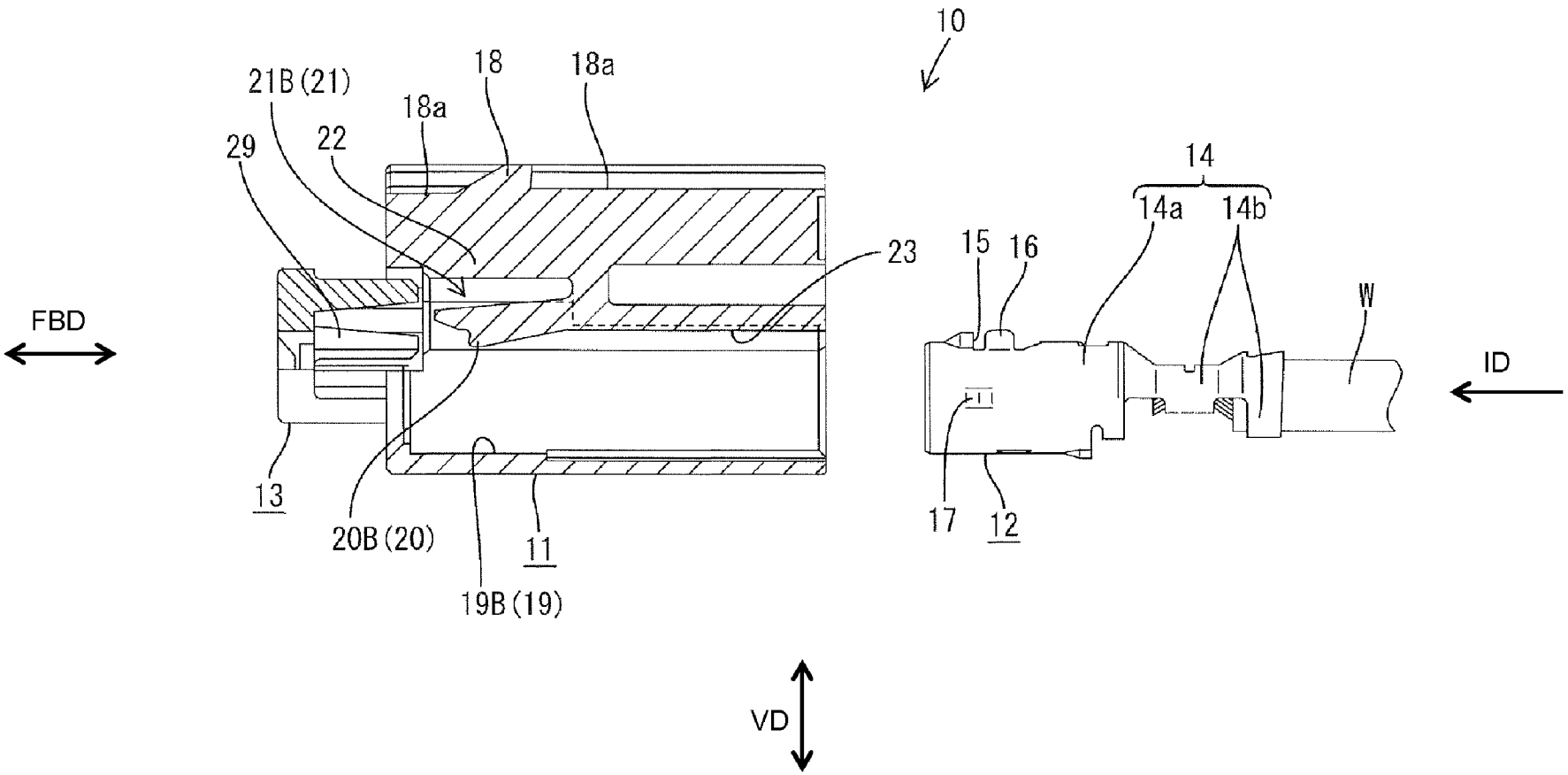
FIG. 10 is a section along A-A of FIG. 14 showing the state where the front retainer is mounted at the partly locked position in the mating housing.
Figure 11:
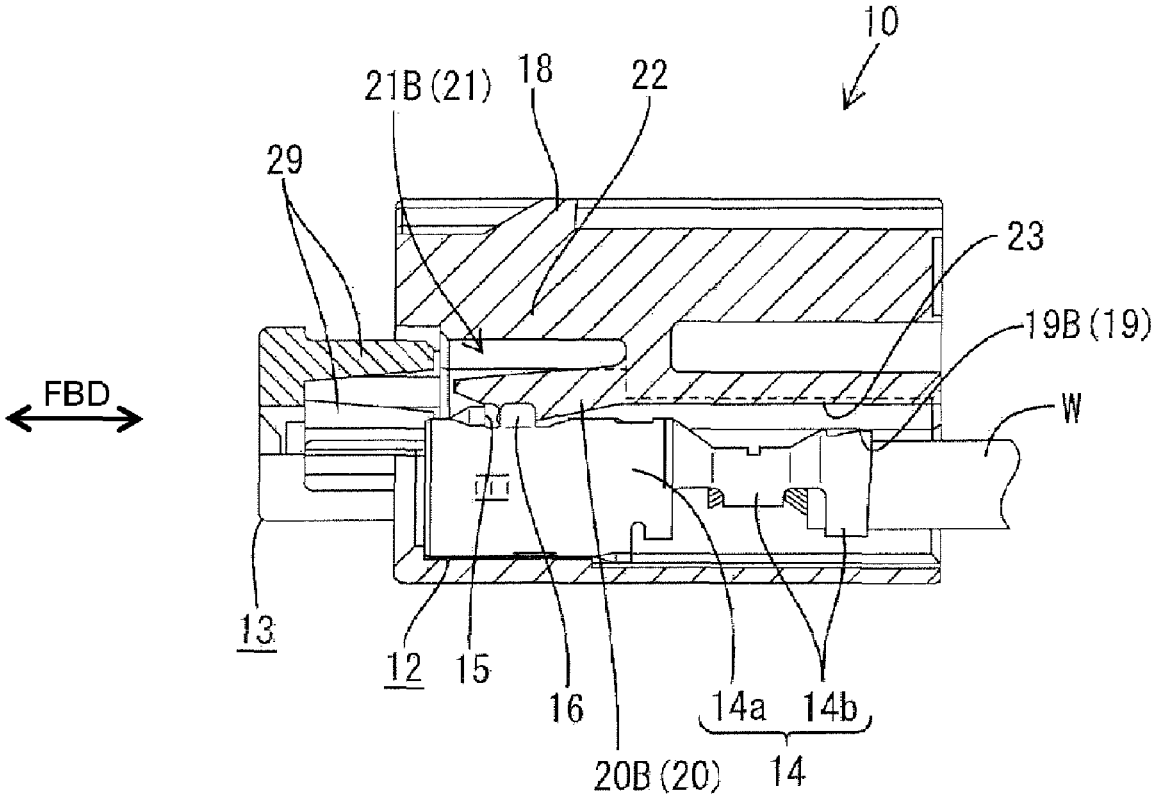
FIG. 11 is a section along A-A of FIG. 14 showing a state where a mating terminal fitting is inserted.

The mating terminal fitting 12 includes an inner conductor terminal (not shown) to be connected with the inner conductor of the coaxial cable W. An outer conductor terminal 14, as shown in FIG. 10, is arranged outside the inner conductor terminal and is connected with the outer conductor of the coaxial cable. An insulator (not shown) is disposed between the inner conductor terminal and the outer conductor terminal 14 to keep the inner and outer conductor terminals insulated from each other. The outer conductor terminal 14 has a substantially cylindrical main portion 14*a* surrounding the outer side of the inner conductor terminal over substantially the entire circumference. A wire connecting portion 14*b* is crimped, bent or folded into connection with the outer conductor exposed at or near an end of the coaxial cable W. An outer conductor terminal 45 of a terminal fitting 42 is fit into the main portion 14*a* upon connection with the connector 40. At this time, the inner conductor terminal is brought electrically into contact with an inner conductor terminal of the terminal fitting 42. The wire connecting portion 14*b* includes crimping pieces at front and rear ends.

A bottom plate of the main portion 14*a* connected with the wire connecting portion 14*b* is formed with a lance locking hole 15 for receiving a locking lance 20 of the mating housing 11. The locking lance 20 is engageable with the front edge of the lance locking hole 15, which is worked to project out. Stabilizers 16 are formed at the opposite lateral edges of the lance locking hole 15 and project up along a vertical direction VD. Two projections 17 project in to face each other at positions of the main portion 14*a* spaced about 90° from the lance locking hole 15. The projections 17 can contact the outer surface of the inner conductor terminal 45 of the terminal fitting 42 upon connection with the connector 40.

Figure 1:
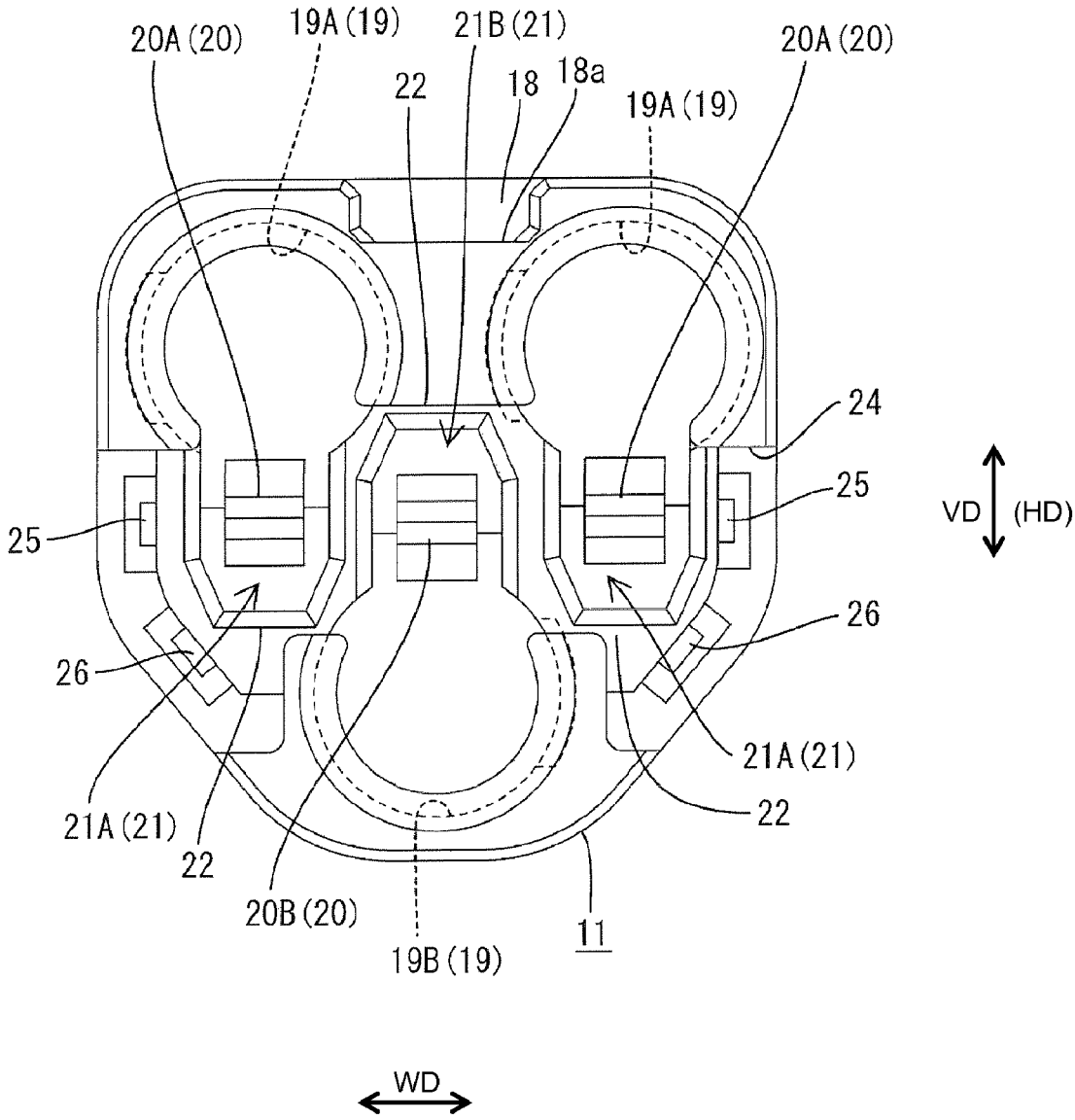
FIG. 1 is a front view of a mating housing according to one embodiment of the invention.
Figure 2:
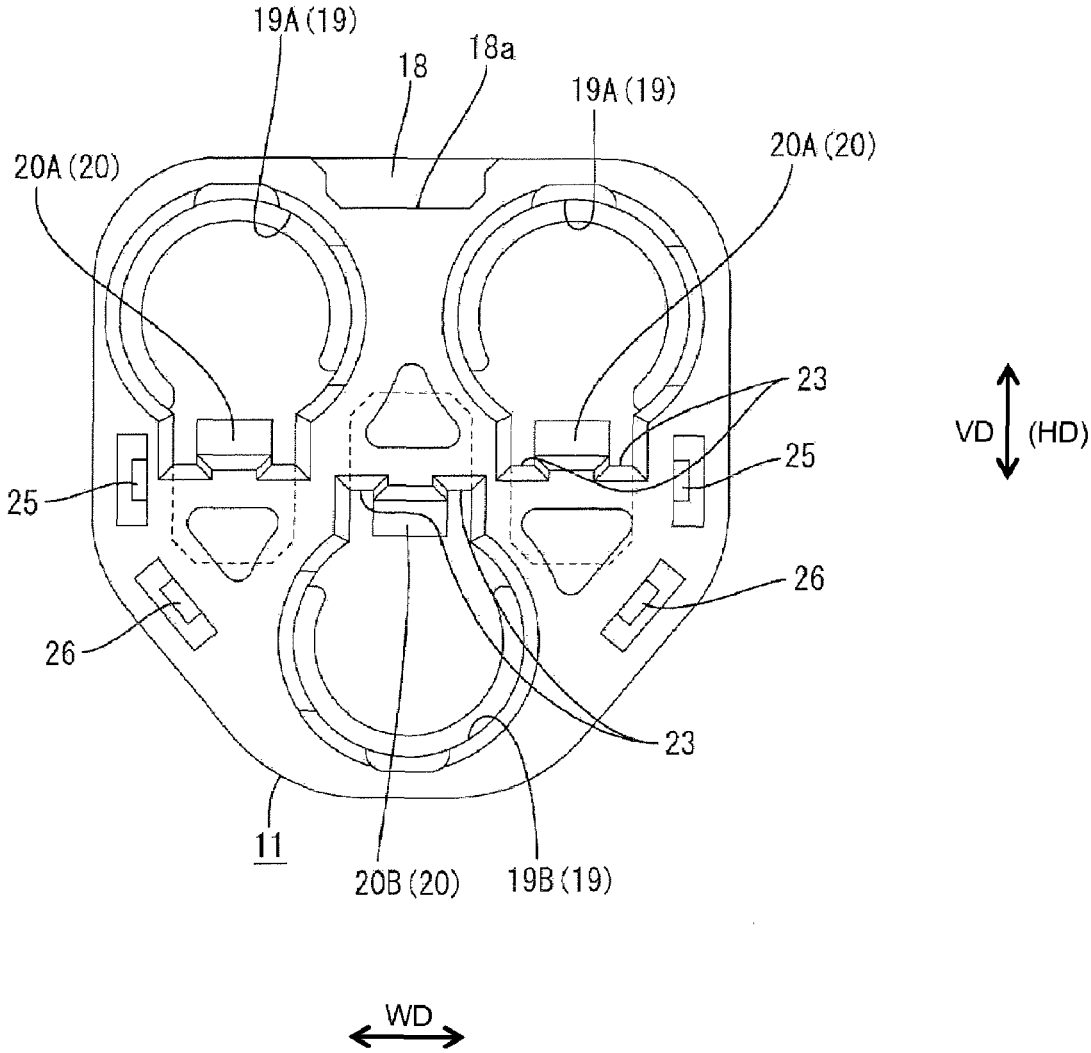
FIG. 2 is a rear view of the mating housing.
Figure 3:
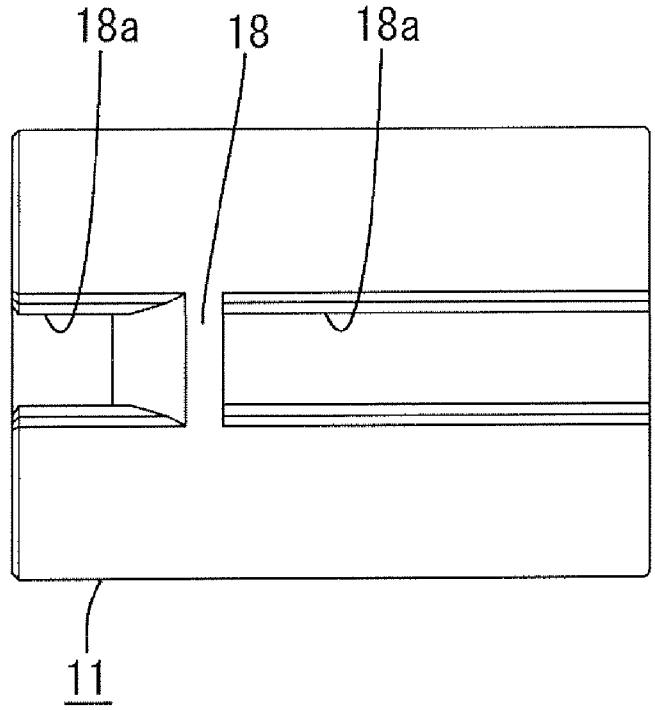
FIG. 3 is a plan view of the mating housing.

The mating housing 11 is made e.g. of synthetic resin and is in the form of a block, as shown in FIGS. 1 to 3. A lock 18 is provided on the upper surface of the mating housing 11 and is engageable with a lock arm 52 of the connector 40. The lock 18 is left upon forming two grooves 18*a* with open front and rear ends in a widthwise intermediate part of the upper surface of the mating housing 11. The front surface of the lock 18 is slanted to guide a movement of the lock arm 52 thereon. The rear surface of the lock 18 extends substantially straight along the height direction HD and defines a locking surface engageable with the lock arm 52.

Mating terminal accommodating chambers 19 penetrate the mating housing 11 in forward and backward directions FBD and have round cross sections that conform to the outer shape of the main portions 14*a* of the mating terminal fittings 12. The mating terminal fittings 12 are individually insertable into the mating terminal accommodating chambers 19 from behind and along the inserting direction ID. As shown in FIG. 10, a locking lance 20 is provided at the inner circumferential surface of each mating terminal accommodating chamber 19 and is configured for engaging a lance engaging portion 15 of the mating terminal fitting 12 for retaining the mating terminal fitting 12. The locking lance 20 is resiliently deformable up and down along a height direction HD that intersects inserting and withdrawing directions ID of the mating terminal fitting 12. The locking lance 20 is retracted into a deformation space 21 adjacent to the locking lance 20 in the height direction during the resilient deformation.

The deformation space 21 is a groove in a wall of the mating housing 11 opposite the mating terminal accommodating chamber 19 and facing the locking lance 20 in a resiliently deforming direction. The deformation space 21 has an open front end and is gradually narrower at positions more distant from the locking lance 20. Wall surfaces that face each other at the opposite lateral sides of the locking lance 20 are slanted (see FIG. 1). Further, an excessive deformation preventing portion 22 is provided at a position of the mating housing 11 substantially facing the locking lance 20 with the deformation space 21 located therebetween. The excessive deformation preventing portion 22 engages the locking lance 20 before the locking lance 20 is deformed beyond its resiliency limit to prevent excessive deformation of the locking lance 20. Two stabilizer insertion grooves 23 are formed in the inner peripheral wall surface of each mating terminal accommodating chamber 19. The stabilizer insertion grooves 23 extend in forward and backward directions FBD at opposite sides of the locking lance 20 for receiving the corresponding stabilizers 16 (see FIG. 2).

A total of three of the mating terminal accommodating chambers 19 are provided in the mating housing 11 in two levels offset along the height direction HD. The locking lances 20 and the deformation spaces 21 are formed to correspond substantially to the respective mating terminal accommodating chambers 19. In the following description, a suffix A is attached to the parts belonging to the upper level and a suffix B is attached to the parts belonging to the lower level for distinguishing the mating terminal accommodating chambers 19, the locking lances 20 and the deformation spaces 21 of the different levels. No suffix is attached when referring to these parts generically.

As shown in FIG. 1, the mating terminal accommodating chambers 19 include two first mating terminal accommodating chambers 19A arranged substantially side by side in the upper level in the mating housing 11 and one second mating terminal accommodating chamber 19B arranged in the lower level. The first mating terminal accommodating chambers 19A and the second mating terminal accommodating chamber 19B are in a positional relationship to be adjacent to each other in the height direction HD. The second mating terminal accommodating chamber 19B is displaced from the first mating terminal accommodating chambers 19A in a width direction WD and is arranged between the first mating terminal accommodating chambers 19A. More specifically, the second mating terminal accommodating chamber 19B is at a substantially middle position between the first mating terminal accommodating chambers 19A in the width direction WD. In this way, the mating terminal accommodating chambers 19A, 19B are arranged in an offset manner, and the central positions of the respective mating terminal accommodating chambers 19A, 19B are at the vertices of a right or equilateral triangle. Accordingly, an upper part of the mating housing 11 corresponding to the first mating terminal accommodating chambers 19A has a fixed width, whereas a lower part thereof corresponding to the second mating terminal accommodating chamber 19B is narrowed toward the bottom. Therefore the outer circumferential surface of the mating housing 11 is vertically asymmetric when viewed from the front.

First locking lances 20A in the first mating terminal accommodating chambers 19A are deformed resiliently out and down substantially toward the second mating terminal accommodating chamber 19B, whereas a second locking lance 20B in the second mating terminal accommodating chamber 19B is deformed resiliently out and up substantially toward the first mating terminal accommodating chambers 19A. In other words, the resiliently deforming directions of the first locking lances 20A and the second locking lance 20B are substantially opposite. Further, the first and second locking lances 20A, 20B are at substantially the same positions in the height direction HD and are aligned substantially on a straight line in the width direction WD.

First deformation spaces 21A are provided for permitting the first locking lances 20A to escape. The first deformation spaces 21A overlap the second mating terminal accommodating chamber 19B in the height direction HD, but are displaced laterally from the second mating terminal accommodating chamber 19B in the width direction WD. On the other hand, a second deformation space 21B is provided for permitting the second locking lance 20B to escape. The second deformation space 21B overlaps the first mating terminal accommodating chambers 19A in the height direction HD, but is displaced laterally from the both first mating terminal accommodating chambers 19A in the width direction WD and is arranged between the both first mating terminal accommodating chambers 19A. Further, the lock 18 and the grooves 18*a* overlap the first mating terminal accommodating chambers 19A in the height direction HD, but are displaced laterally from the both first mating terminal accommodating chambers 19A in the width direction WD and are arranged between the both first mating terminal accommodating chambers 19A. Thus, the mating terminal accommodating chambers 19, the locking lances 20, the deformation spaces 21, the locks, 18 and the grooves 18*a* are arranged efficiently arranged for miniaturization of the mating housing 11.

A retainer mount recess 24 is formed in the front surface of the mating housing 11 for receiving the front retainer 13 from the front. The retainer mount recess 24 is formed in a range extending from the front surface of the mating housing 11 toward the opposite side surfaces thereof. Specifically, the retainer mount recess 24 has a wide strip shape extending in the width direction WD, which is an arranging direction of the locking lances 20 and the deformation spaces 21. Additionally, the retainer mount recess 24 is in a range corresponding to the respective locking lances 20 and the deformation spaces 21 in the height direction HD. The retainer mount recess 24 defines forwardly open grooves in the opposite side surfaces of the mating housing 11 in substantially the same height range as in the front surface. Parts of the front walls of the respective mating terminal accommodating chambers 19 facing the locking lances 20 are cut off by the retainer mount recess 24.

Figure 7:
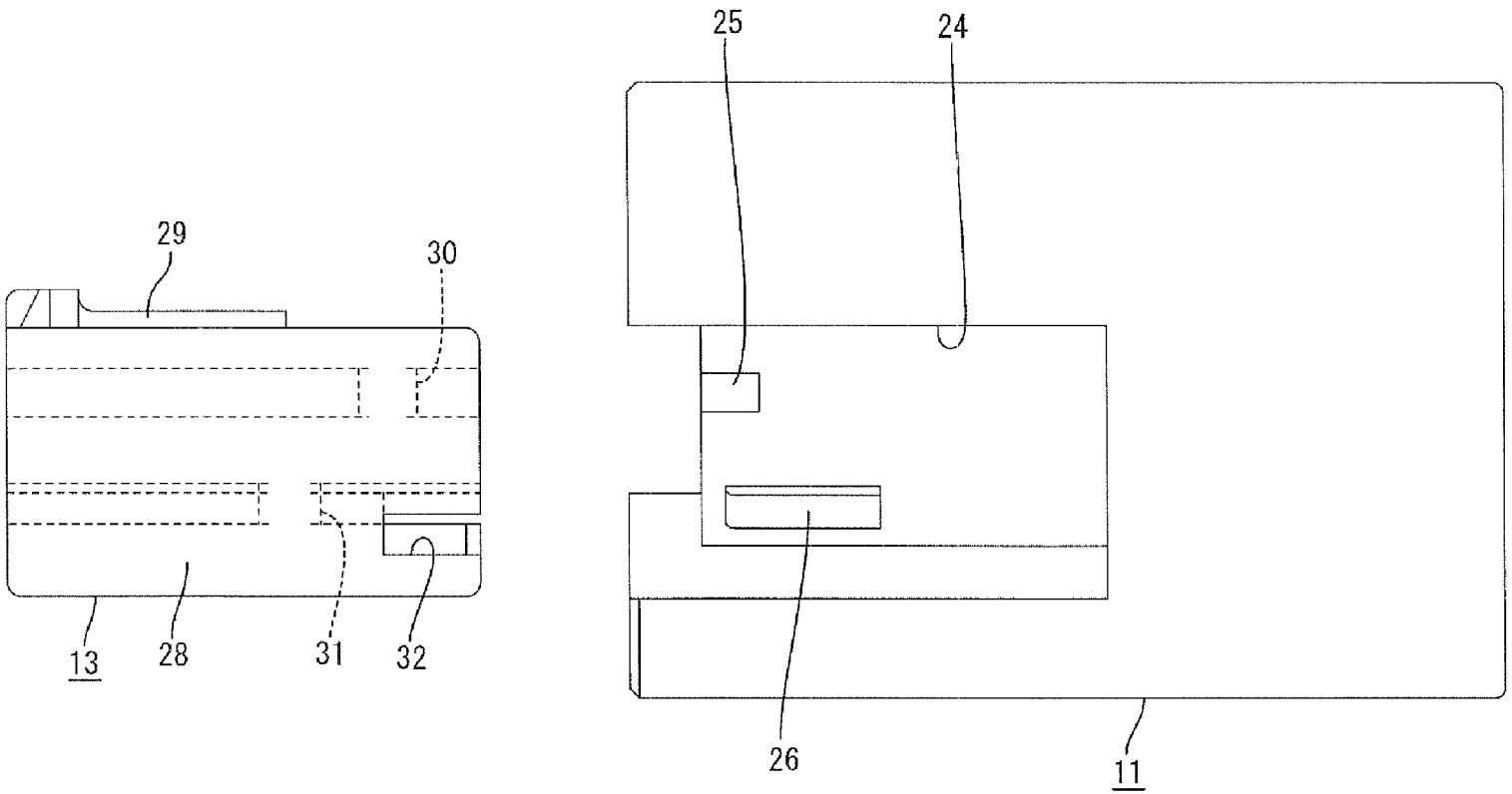
FIG. 7 is a side view of the mating housing and the front retainer.

First and second retainer holders 25 and 26 project out from the opposite side surfaces of the retainer mount recesses 24, as shown in FIGS. 1 and 7, and function to hold the front retainer 13 in a mounted state. Projecting distances of the retainer holders 25, 26 are less than the depth of the retainer mount recess 24. The first retainer holders 25 are at front positions of the retainer mount recess 24. However, the second retainer holders 26 are more backward than the first retainer holders 25 and are displaced down therefrom.

Figure 4:
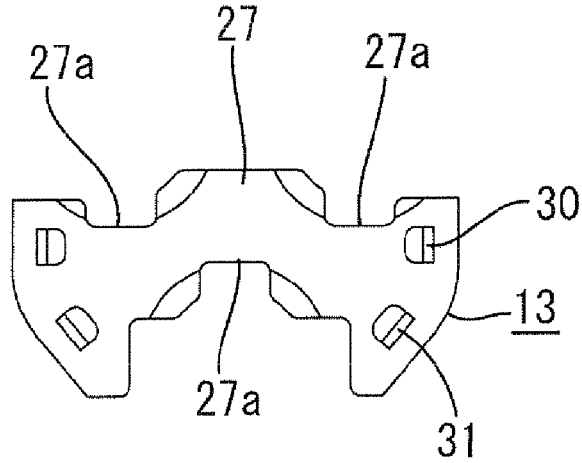
FIG. 4 is a front view of a front retainer for a mating connector.
Figure 5:
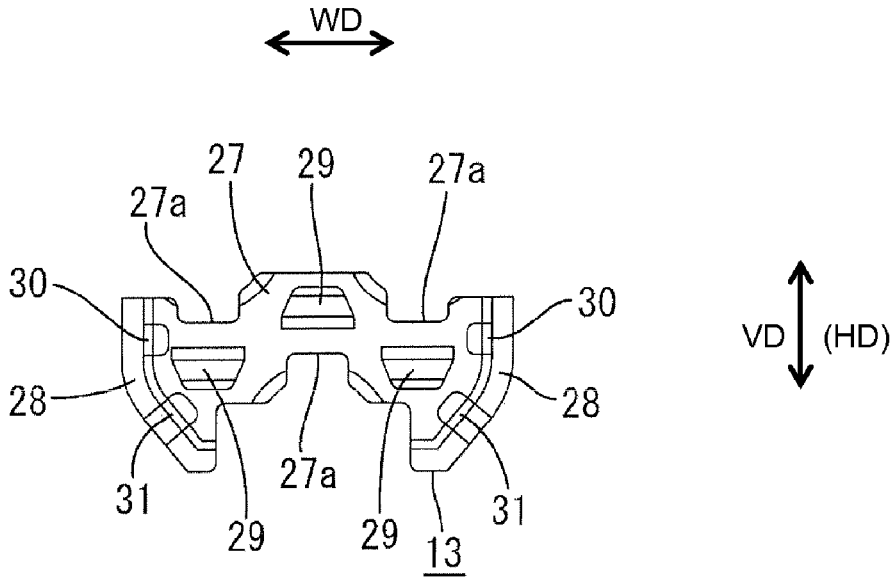
FIG. 5 is a rear view of the front retainer for the mating connector.
Figure 6:
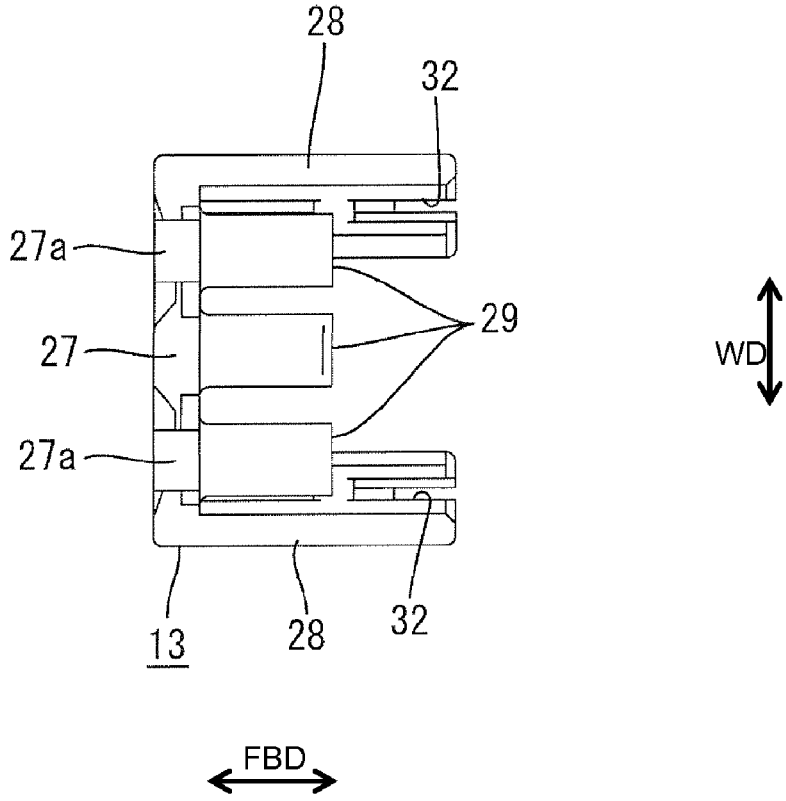
FIG. 6 is a plan view of the front retainer for the mating connector.

The front retainer 13 is made e.g. of synthetic resin and defines a substantially U-shape along the retainer mount recess 24. The front retainer 13 includes a primary plate 27 that is long in the width direction WD. Two side plates 28 extend back from the opposite lateral ends of the rear surface of the primary plate 27 and deformation restricting portions 29 project back from an intermediate part of the rear surface of the primary plate 27, as shown in FIGS. 4 to 6.

The deformation restricting portions 29 can be inserted into the deformation spaces 21 for the locking lances 20 when the front retainer 13 is mounted into the mating housing 11 to restrict resilient deformations of the locking lances 20. Deformation restricting portions 29 are provided at positions of the primary plate 27 spaced apart in the width direction WD. The intermediate deformation restricting portion 29 is offset in the height direction HD with respect to the lateral deformation restricting portions 29 and conforms to the second deformation space 21B of the mating housing 11. The deformation restricting portions 29 at the opposite sides are at relatively low positions to conform to the first deformation spaces 21A of the mating housing 11. It should be understood that the deformation restricting portions 29 may be provided substantially continuously at offset positions substantially in conformity with the first and second deformation spaces 21A, 21B of the mating housing 11. Cutouts 27*a* are formed in parts of the primary plate 27 facing the respective locking lances 20 from the front in the mounted state. Thus, the respective locking lances 20 are exposed to the outside in the front via the corresponding cutouts 27*a* in the mounted state (see FIG. 14). Thus, a jig (not shown) can be inserted from the outside in the front through the corresponding cutout 27*a* for forcibly resiliently deforming each locking lance 20. The respective cutouts 27*a* are formed near the upper and lower edges of the primary plate 27 and at sides substantially opposite to the respective deformation restricting portions 29 in the height direction HD.

Figure 8:
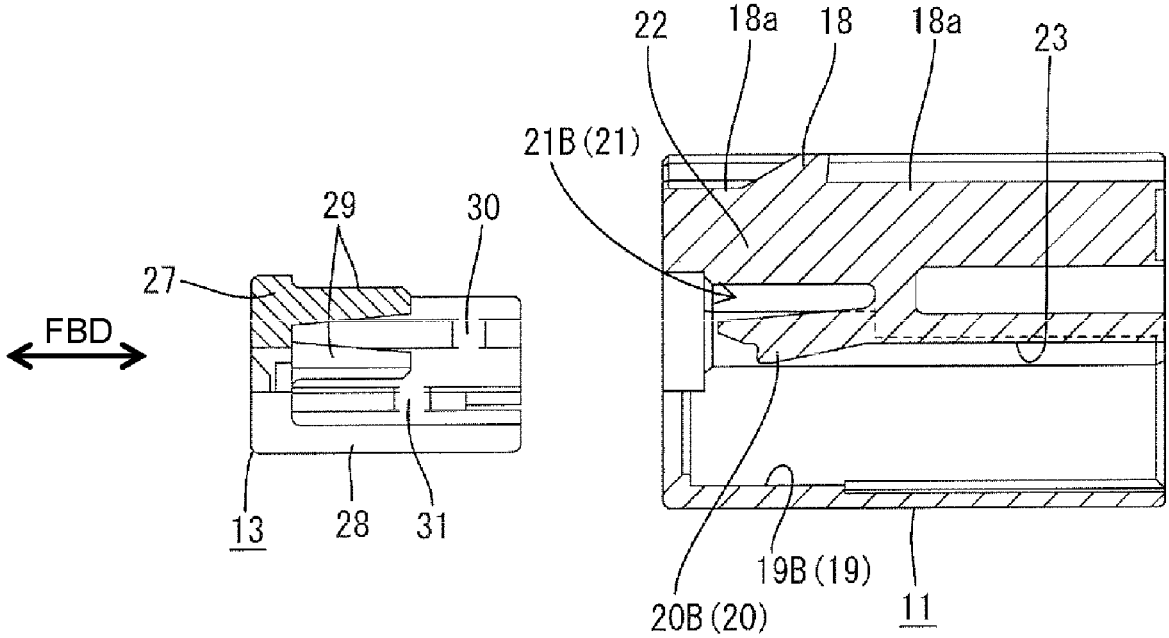
FIG. 8 is a section along A-A of FIG. 14 showing the mating housing and the front retainer.

The side plates 28 are at obtuse angles in conformity with the side surface shapes of the mating housing 11 at intermediate positions when viewed from the front. Specifically, upper parts of the side plates 28 are substantially straight in the height direction HD, whereas lower parts thereof are inclined with respect to the height direction HD. As shown in FIGS. 7 and 8, first and second locks 30, 31 are formed on inner surfaces of the upper and lower parts of the side plates 28 and are engageable with the first and second retainer holders 25, 26 of the mating housing 11. Each of the locks 30, 31 is a part left upon forming two grooves with open front and rear ends in the inner surface of the side plate 28. The first locks 30 are at relatively backward positions in the upper parts of the side plates 28, whereas the second locks 31 are at relatively forward positions in the lower parts of the side plates 28. In other words, the first and second locks 30, 31 are offset with respect to each other along the forward and backward directions FBD. Further, rearwardly open operable grooves 32 are formed in the rear edges of the lower parts of the side plates 28 and can be caught by a jig (not shown) to move the front retainer 13.

Figure 9:
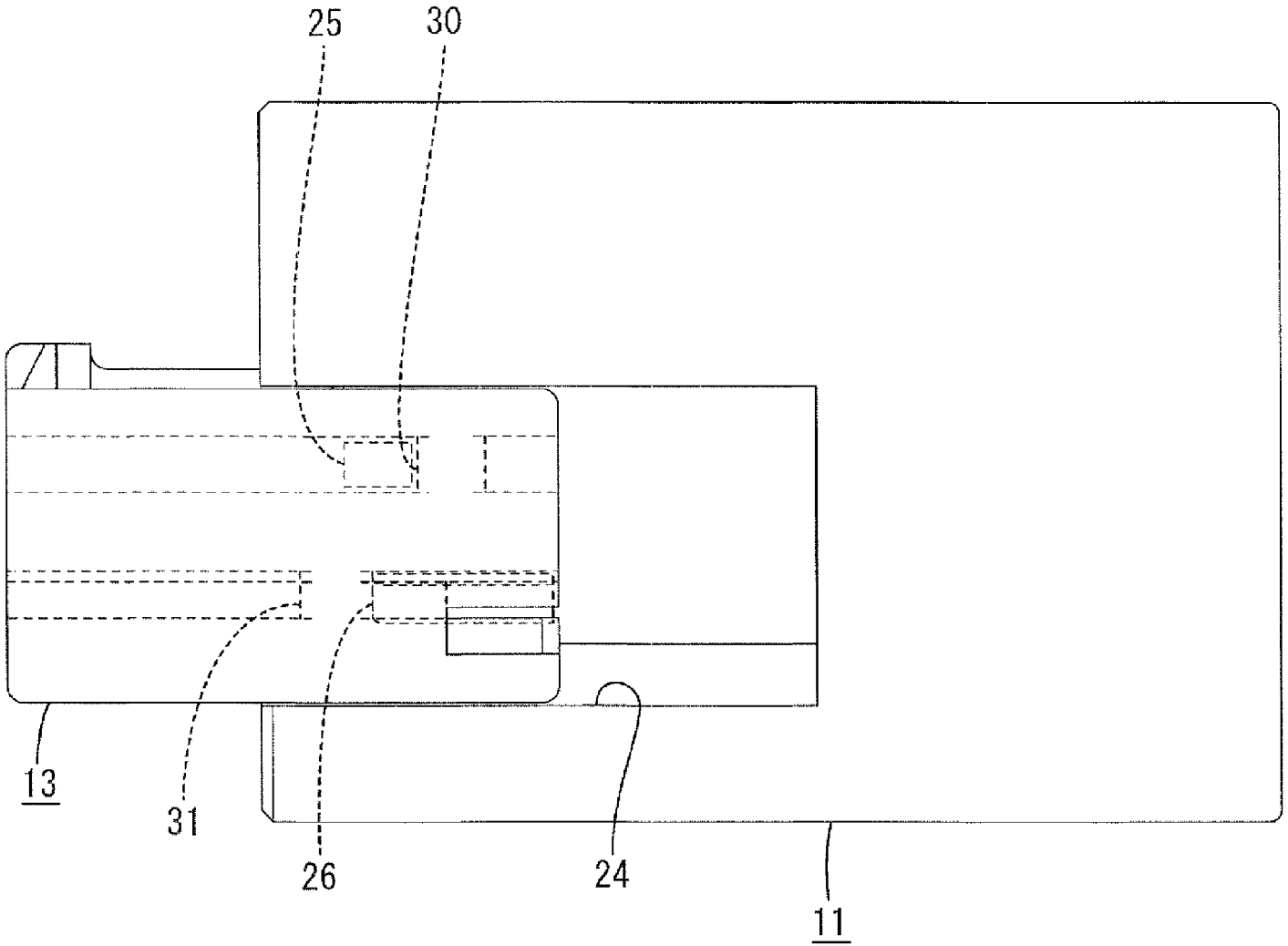
FIG. 9 is a side view showing a state where the front retainer is mounted at a partly locked position in the mating housing.
Figure 12:
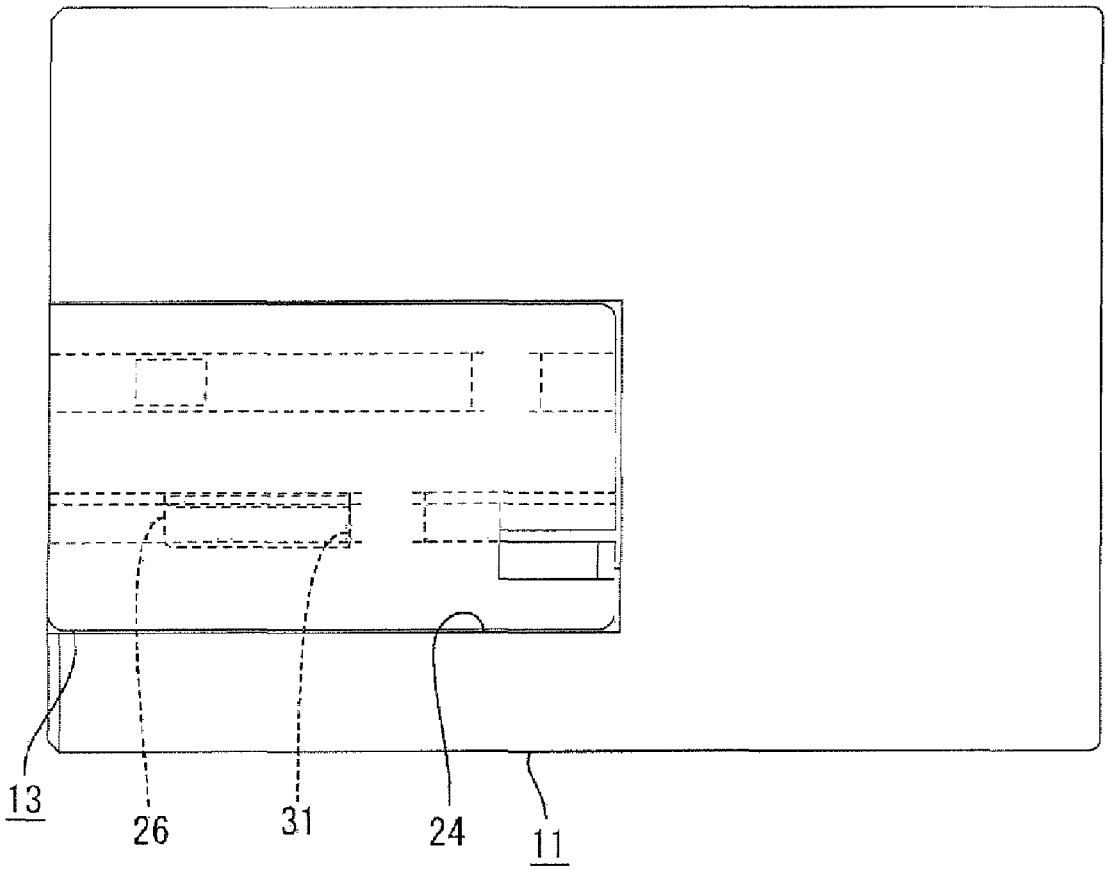
FIG. 12 is a side view showing a state where the front retainer is mounted at a fully locked position in the mating housing.

The front retainer 13 can be held selectively in the mating housing 11 at two different positions in forward and backward directions FBD. Specifically, the front surfaces of the first locking portions 30 can engage the rear surfaces of the first retainer holders 25, as shown in FIG. 9, to hold the front retainer 13 at a partly locked position projecting forward from the mating housing 11. At this time, the deformation restricting portions 29 are forward of the corresponding deformation spaces 21, as shown in FIG. 10, to permit resilient deformations of the respective locking lances 20 and to permit the insertion and withdrawal of the mating terminal fittings 12. On the other hand, the front surfaces of the second locking portions 31 can engage the rear surfaces of the second retainer holders 26 as shown in FIG. 12, to hold the front retainer 13 in a fully locked position in the retainer mount recess 24 where the outer circumferential surfaces of the front retainer 13 and the mating housing 11 are substantially flush with each other. At this time, the deformation restricting portions 29 are in the corresponding deformation spaces 21 to restrict the resilient deformations of the respective locking lances 20 as shown in FIG. 13.

Figure 18:
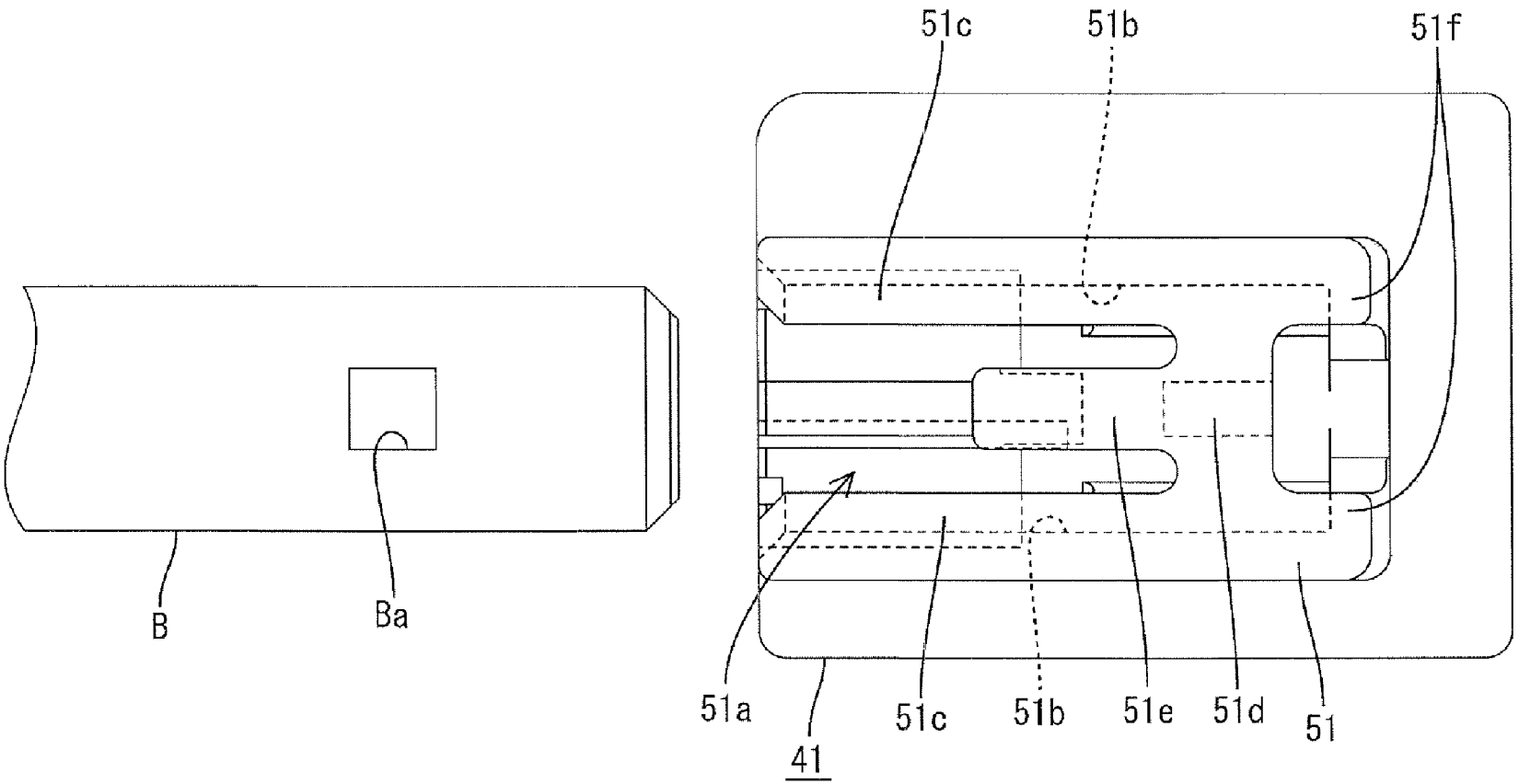
FIG. 18 is a plan view of the housing and a bracket.

The bracket B is made of an electrically conductive material such as metal and defines a wide cantilever-shaped plate extending from a fixed position to the body, as shown in FIG. 18. A lock hole Ba penetrates the bracket B in a thickness direction at a widthwise middle position of the bracket B near the leading end. The leading end of the bracket B is beveled over the entire circumference to enable the connector 40 to be mounted smoothly.

Figure 29:
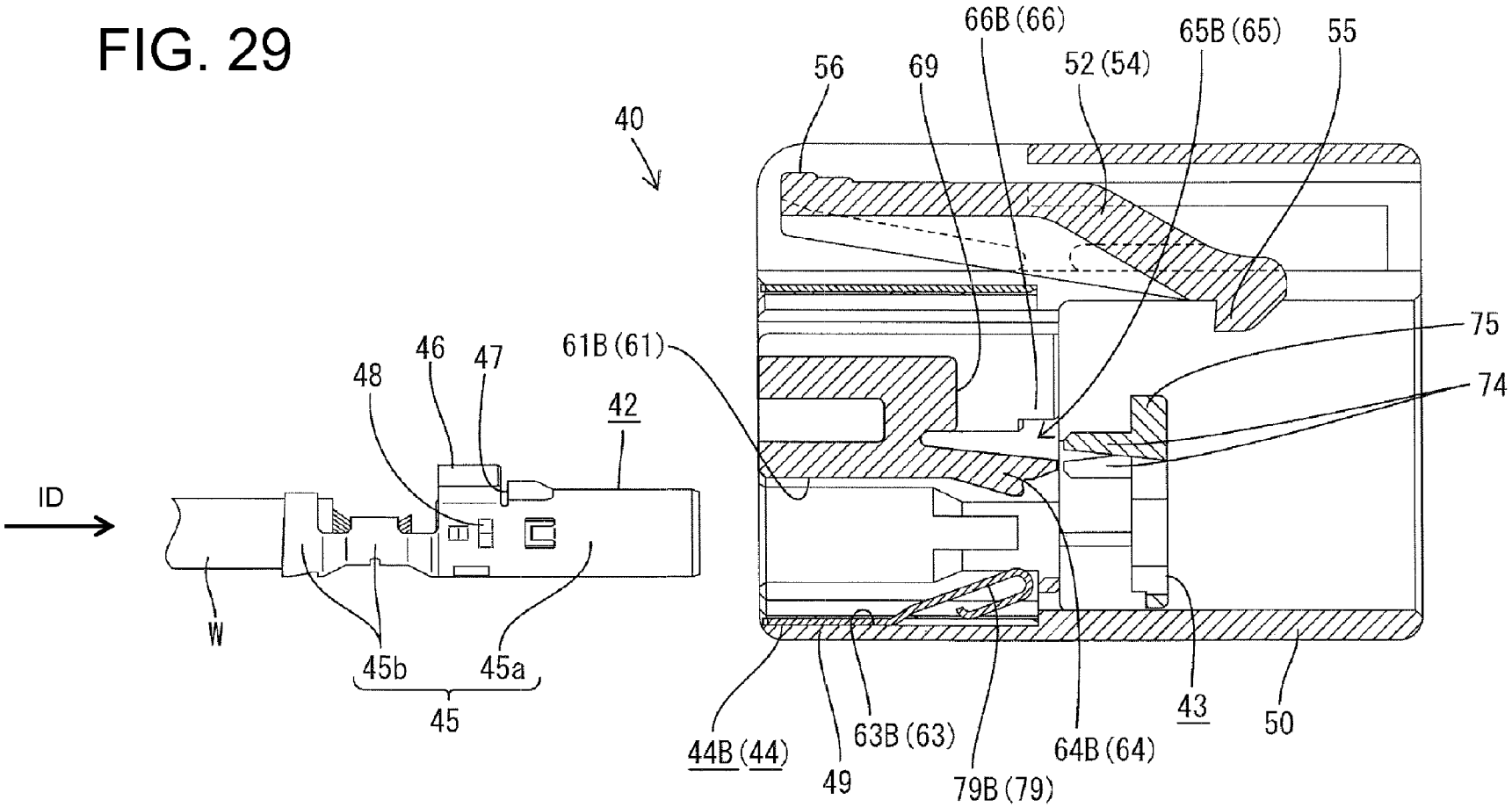
FIG. 29 is a section along F-F of FIG. 45 showing the state where the front retainer is mounted at the partly locked position in the housing.

The connector 40 has a housing 41, as shown in FIG. 29. Terminal fittings 42 are mounted in the housing 41 and are connected with ends of coaxial cables W. A front retainer 43 is mounted in the housing 41 and two divided ground terminals 44 are mounted into the housing 41 for electrically connecting parts of the terminal fittings 42 and the bracket B. The connector 40 is connected with the mating connector 10 in a state mounted on the bracket B. The coaxial cables W connected with the terminal fittings 42 are similar to the coaxial cables W of the mating connector 10 and are not described again.

Figure 15:
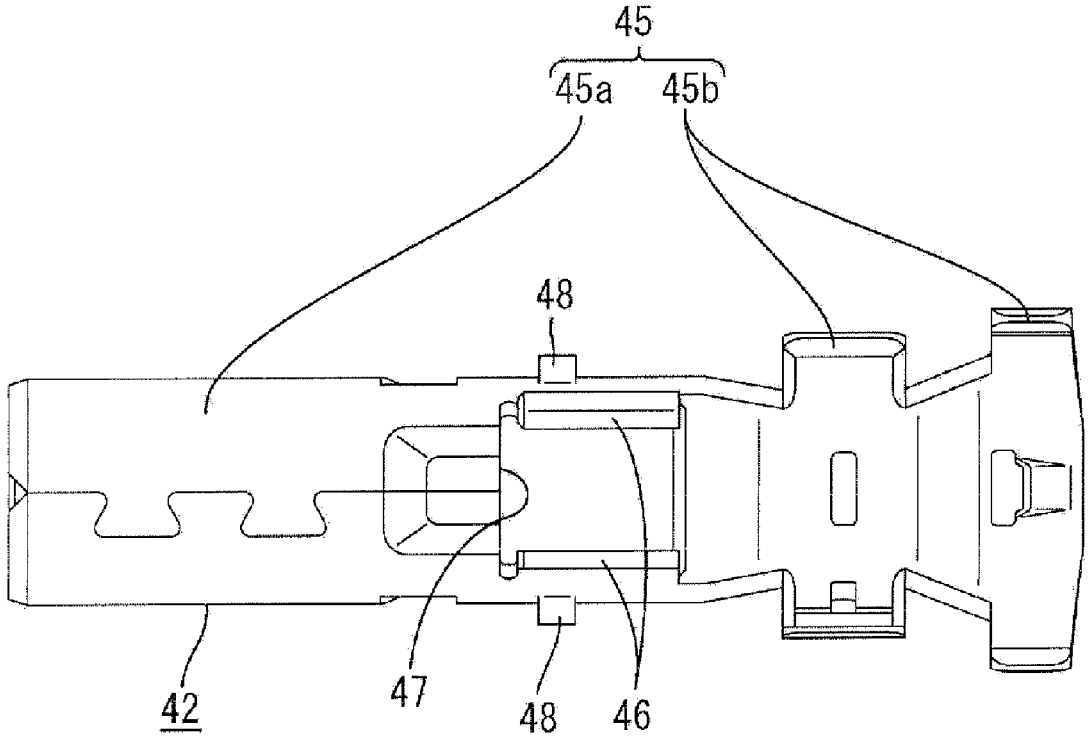
FIG. 15 is a plan view of a terminal fitting.

Each terminal fitting 42 includes an inner conductor terminal (not shown) to be connected with an inner conductor of the coaxial cable W. An outer conductor terminal 45 is arranged outside the inner conductor terminal, as shown in FIGS. 15 and 29, and is connected with an outer conductor of the coaxial cable W. An insulator (not shown) is disposed between the inner conductor terminal and the outer conductor terminal 45 to keep the inner and outer conductor terminals insulated from each other. The outer conductor terminal 45 has a substantially cylindrical main portion 45*a* surrounding the outer side of the inner conductor terminal and a wire connecting portion 45*b* to be crimped, bent or folded into connection with the outer conductor exposed at an end of the coaxial cable W.

Two stabilizers 46 project up in a vertical direction VD from a rear part of the main portion 45*a* at positions substantially opposite to a bottom plate that connects the main portion 45*a* and the wire connecting portion 45*b*. The stabilizers 46 are plates that face each other at positions at the opposite sides of an open part near the rear end of the main portion 45*a*. A lance engaging portion 47 is provided at the front edge of the open part of the main portion 45*a* and is worked to project radially out from the main portion 45*a*. Two projections 48 are formed by cutting and bending the main portion 45*a*. The projections 48 extend out at positions spaced angularly apart by about 90° from the lance engaging portion 47. The inner conductor terminal is connected electrically with the mating terminal fitting 12 (forming part of a signal wire of an electrical circuit of the automotive vehicle) of the mating connector 10 to be connected with the connector 40. The wire connecting portion 45*b* has crimping pieces at front and rear ends.

Figure 16:
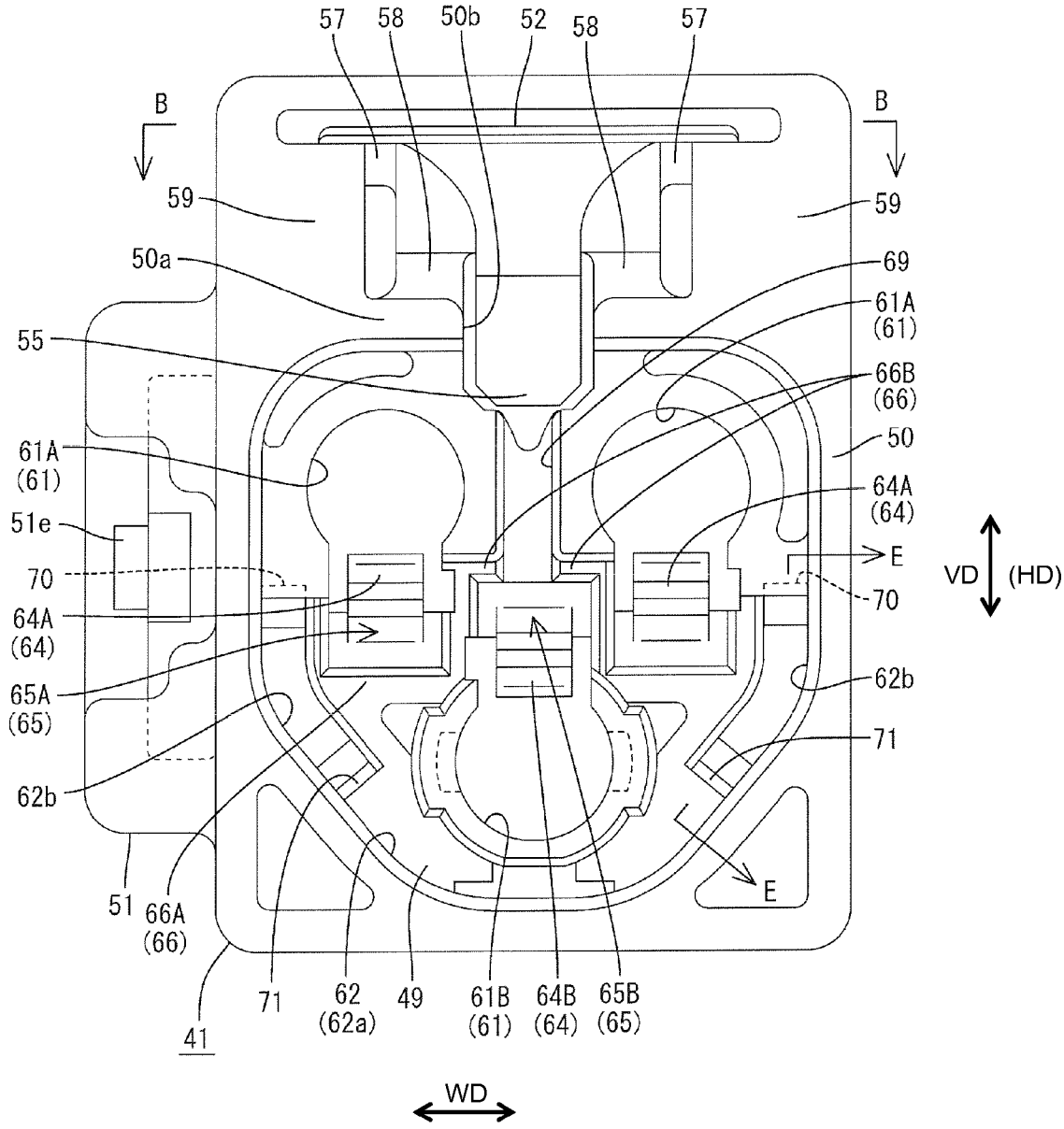
FIG. 16 is a front view of a housing.
Figure 17:
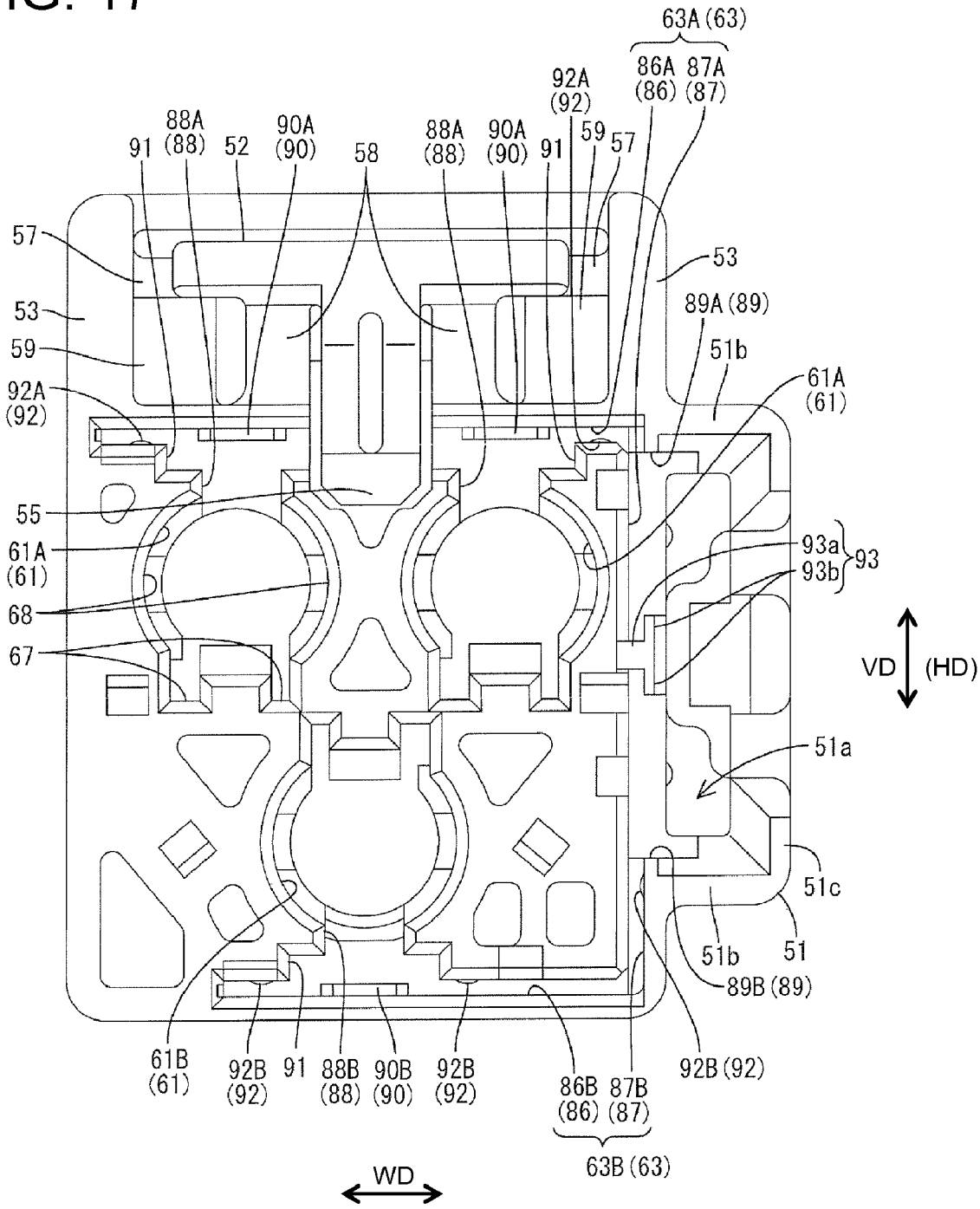
FIG. 17 is a rear view of the housing.

The housing 41 is made e.g. of synthetic resin and is provided with a terminal accommodating portion 49 for accommodating the terminal fittings 42 and the divided ground terminals 44. The housing 41 also has a receptacle 50 for receiving the mating connector 10 and a bracket mounting portion 51 into which the bracket B is to be mounted, as shown in FIGS. 16 to 18.

The receptacle 50 is a substantially rectangular tube that projects substantially forward from the peripheral edge of the terminal accommodating portion 49 and has a forwardly open connection space that can receive the mating connector 10 along the forward and backward directions FBD. The inner peripheral surface of the receptacle 50 defines a vertically asymmetric shape that conforms to the outer shape of the mating housing 11 when viewed from the front. A lock arm 52 is provided on the upper surfaces of the terminal accommodating portion 49 and the receptacle 50 for holding the mating housing 11 in a connected state and lock protecting portions 53 are arranged at opposite sides of the lock arm 52 to protect the lock arm 52.

Figure 19:
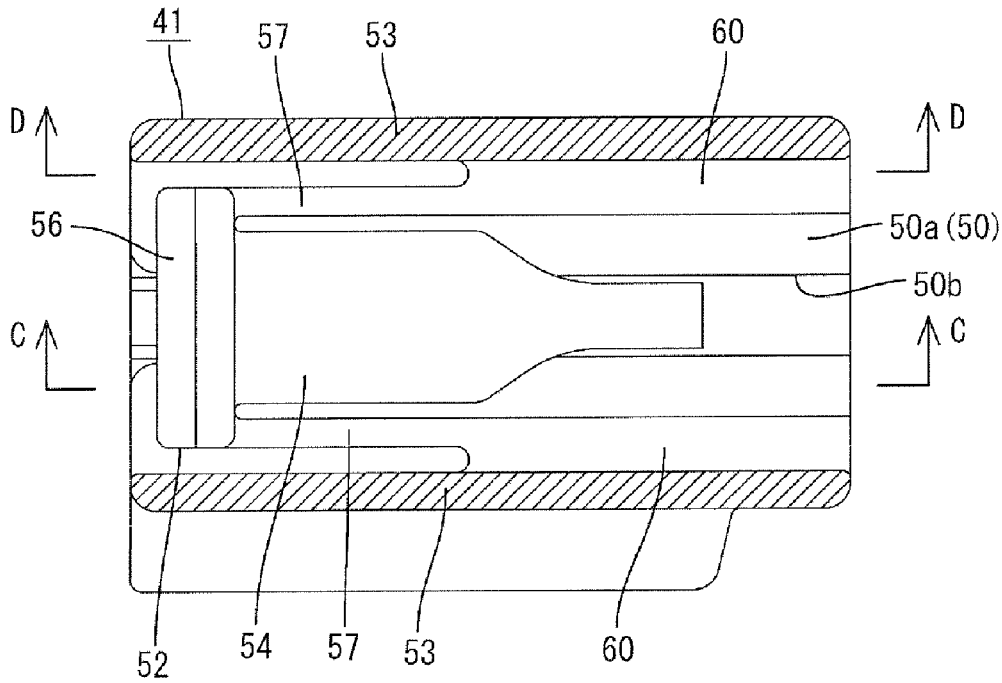
FIG. 19 is a section of the housing along B-B of FIG. 16.
Figure 20:
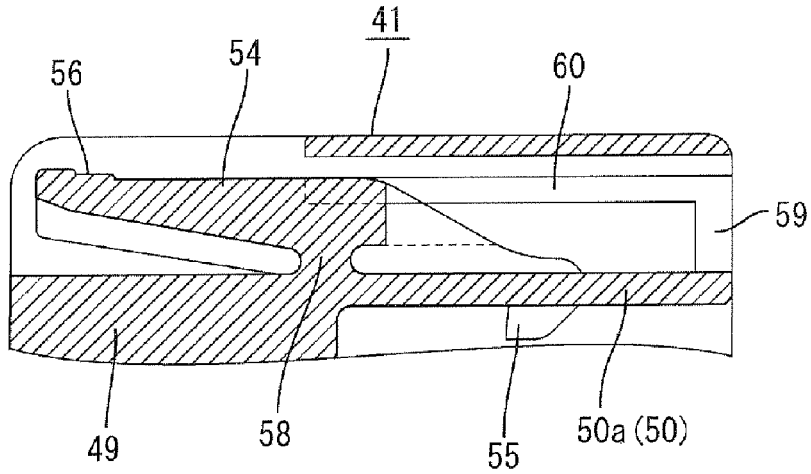
FIG. 20 is a section of the housing along C-C of FIG. 19.

The lock arm 52 includes an arm main body 54 that extends in forward and backward directions FBD, as shown in FIGS. 19, 20 and 29. A claw-shaped interlocking portion 55 is provided near the front end of the arm main body 54 for engaging the lock 18 and an operable portion 56 is provided at the rear end thereof to be pressed from above. A front end portion of the arm main body 54 including the interlocking portion 55 is narrower than an intermediate part, whereas a rear end portion thereof including the operable portion 56 is wider than the intermediate part. A gradually narrowed part connects the intermediate part of the arm main body 54 to the narrow front end portion. The operable portion 56 at the rear end includes steps. As shown in FIG. 16, the front end portion of the arm main body 54 including the interlocking portion 55 is in a partial cutout 50*b* formed at a substantially widthwise middle position of an upper part 50*a* of the receptacle 50, so that the interlocking portion 55 projects into the connection space. Thus, a part of the lock arm 52 utilizes a space defined upon forming the cutout 50*b* in the receptacle 50. This cutout 50*b* penetrates the upper parts of the receptacle 50 and the terminal accommodating portion 49 in forward and backward directions.

Opposite side surfaces of the lock arm 52 are connected to the facing inner side surfaces of the lock protecting portions 53 via first lock supports 57 as shown in FIG. 19, and the lower surface thereof is connected to the facing upper surfaces of the terminal accommodating portion 49 and the receptacle 50 via second lock supports 58, as shown in FIG. 20. Thus, the lock arm 52 is vertically resiliently deformable in the height direction HD with the respective connected positions as supports.

Specifically, as shown in FIGS. 16 and 19, the first lock supports 57 are provided between the lock arm 52 and the lock protecting portions 53 and extend in forward and backward directions FBD substantially parallel with the lock arm 52. Rear ends of the first lock supports 57 are connected with the fronts of the lateral ends of the wide rear end portion of the lock arm 52 and the lateral edges of front end portions of first lock supports 57 are connected with the inner side surfaces of the lock protecting portions 53. The first lock supports 57 are shorter than the lock arm 52, specifically about half the length of the lock arm 52, and the front end portions of the first lock supports 57 connected with the lock protecting portions 53 are at substantially the same positions as the front end of the intermediate part of the lock arm 52. Parts of the first lock supports 57 between the rear ends connected with the lock arm 52 and the front ends connected with the lock protecting portions 53 are separated from both the lock arm 52 and the lock protecting portions 53 and are resiliently deformable so that the lock arm 52 can incline vertically.

The bottom ends of the second lock supports 58 are connected with the upper part 50*a* of the receptacle 50 at positions straddling the rear end of the receptacle 50 and the front end of the terminal accommodating portion 49 and including the peripheral edge of the cutout 50*b*, as shown in FIGS. 16 and 20. The second lock supports 58 face each other in the width direction WD at opposite sides of the cutout 50*b*. The upper ends of the second lock supporting portions 58 are connected to front end of the intermediate part of the arm main body 54 of the lock arm 52 at positions substantially aligned with the connection of the receptacle 50 and the terminal accommodating portion 49 in forward and backward directions FBD. The connections of the second lock supports 58 with the receptacle 50 and the terminal accommodating portion 49 are substantially aligned with the connected positions of the first lock supports 57 with the lock protecting portions 53 in forward and backward directions FBD.

Figure 21:
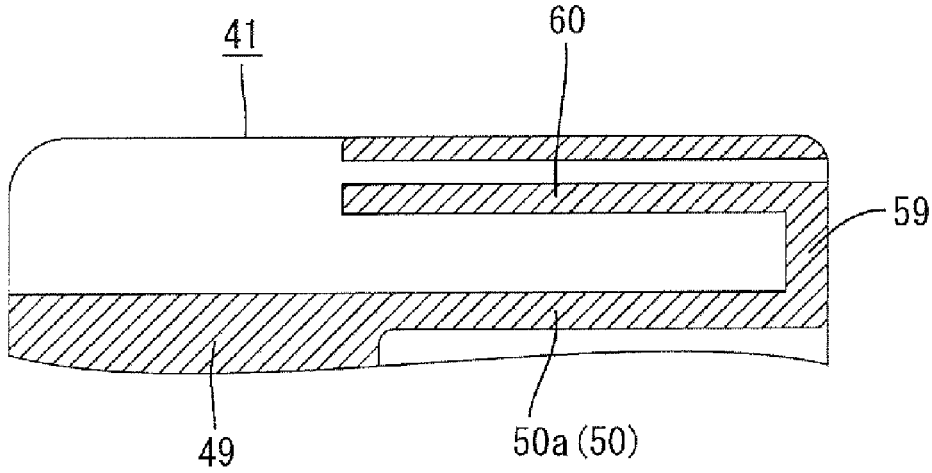
FIG. 21 is a section of the housing along D-D of FIG. 19.

Reinforcements 59 for reinforcing the receptacle 50 are provided in spaces enclosed by the upper part 50*a* of the receptacle 50, the lock protecting portions 53 and the lock supports 57, 58, as seen in the front view of the housing 41 shown in FIG. 16. The bottom ends of the reinforcements 59 are connected with the front end of the upper part 50*a* of the receptacle 50, and the lateral ends thereof are connected with the front ends of the lock protecting portions 53. The front end surfaces of the reinforcements 59 are substantially flush with both the front end surface of the receptacle 50 and the front end surfaces of the lock protecting portions 53. As shown in FIGS. 19 to 21, the first lock supports 57 are provided with extensions 60 extending forward in parallel with the lock arm 52, and the front ends of the extensions 60 are connected with the upper ends of the reinforcements 59. Lateral edges of the extensions 60 are connected with the inner side surfaces of the adjacent lock protecting portions 53 over the entire lengths thereof.

The bracket mounting portion 51 is arranged on a side surface of the housing 41 extending in the height direction HD as shown in FIGS. 16 to 18 and 33, and the bracket B to be mounted thereinto is in such a posture that the plate surface thereof extends substantially in the vertical direction VD.

The bracket mounting portion 51 is a bottomed recess with an open rear end, and the inner space thereof defines a bracket accommodating chamber 51*a* for receiving the bracket B from behind. Specifically, the bracket mounting portion 51 has two side walls 51*b* projecting from the side surface of the housing 41, bulging walls 51*c* projecting in from the projecting ends of the side walls 51*b* to face the side surface of the housing 41, a bridging wall 51*d* projecting from parts of the both bulging walls 51*c* to bridge the bulging walls 51*c*, a bracket locking piece 51*e* extending back from the bridging wall 51*d*, and a front stop wall 51*f* projecting from the side surface of the housing 41 and connected with the front ends of the side walls 51*b* and those of the bulging walls 51*c*. The bracket accommodating chamber 51*a* is suitably dimensioned in conformity with the width and thickness of the bracket B.

Figure 34:
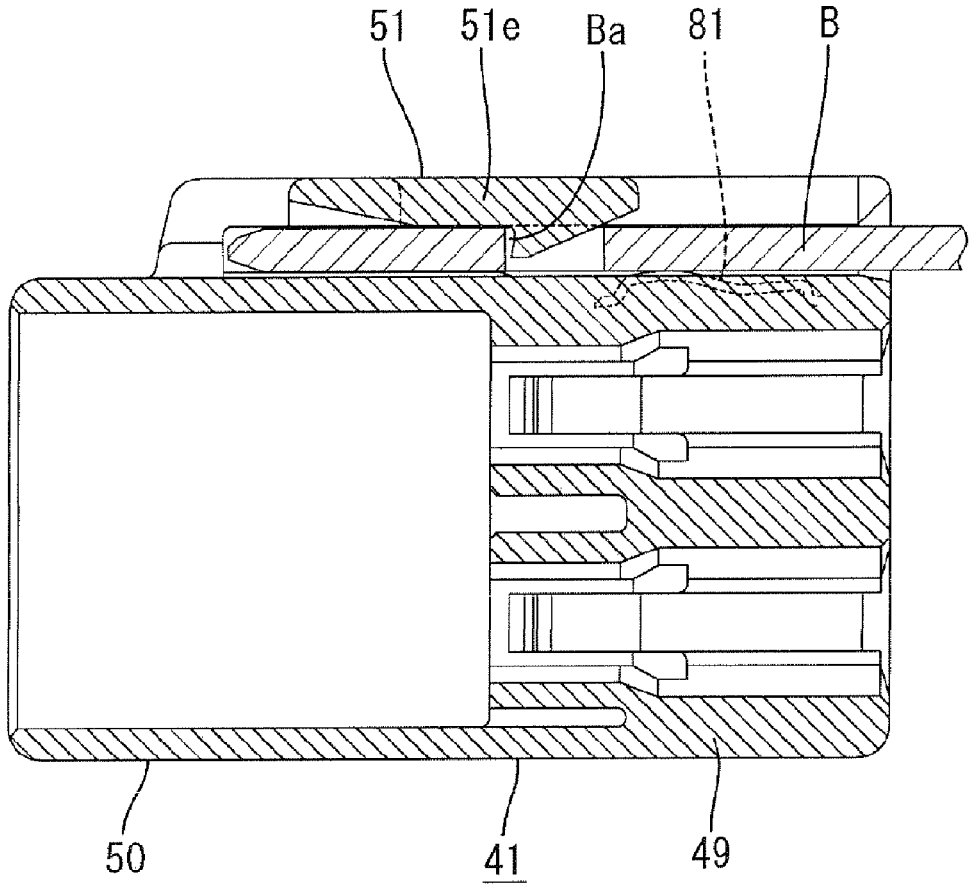
FIG. 34 is a section along G-G of FIG. 45 showing a state where the bracket is inserted in the housing.

The bracket locking piece 51*e* is cantilevered in forward and backward directions FBD and is resiliently deformable in the width direction WD, which is substantially orthogonal to an inserting direction of the bracket B. A lock projection is provided on the inner surface of a free end portion of the bracket locking piece 51*e* and projects into the bracket accommodating chamber 51*a*. The lock projection engages the hole edge of the lock hole Ba of the bracket B to hold the housing 41 on the bracket B (FIG. 34). The bracket locking piece 51*e* is arranged at a vertical middle position of the bracket mounting portion 51. The bracket locking piece 51 is displaced outward in the process of inserting the bracket B.

As shown in FIGS. 16 and 17, the terminal accommodating portion 49 is substantially in the form of a block and has terminal fitting accommodating chambers 61 for accommodating the terminal fittings 42. The terminal accommodating portion 49 also has a retainer mount recess 62 for receiving a front retainer 43 and divided ground terminal accommodating chambers 63 for accommodating the divided ground terminals 44.

The terminal fitting accommodating chambers 61 penetrate the terminal accommodating portion 49 in forward and backward directions FBD and have cross sections substantially conforming to the outer shape of the main portions 45*a* of the mating terminal fittings 42. Thus, the terminal fittings 42 are individually insertable into the in the terminal fitting accommodating chambers 61 from behind and along an inserting direction ID. A locking lance 64 is provided on the inner surface of each terminal fitting accommodating chamber 61, as shown in FIG. 29, and engages the lance engaging portion 47 of the inserted terminal fitting 42. The terminal fitting 42 is retained by the locking lance 64 so that the front part of the main body 45*a* projects into the connection space (see FIG. 30).

The locking lance 64 is resiliently deformable up and down along the height direction HD, and is retracted into a deformation space 65 adjacent to the locking lance 64 in the height direction HD during the resilient deformation. The deformation space 65 is a forwardly open groove formed in a wall of the mating housing 41 facing the locking lance 64 in a resiliently deforming direction and hence at a side opposite the terminal fitting accommodating chamber 61. Further, an excessive deformation preventing portion 66 is at a side of the deformation space 65 facing the locking lance 64 and engages the locking lance 64 before the locking lance 64 is deformed beyond its resiliency limit for preventing an excessive deformation of the locking lance 64.

As shown in FIG. 17, two stabilizer insertion grooves 67 are formed in the inner peripheral surface of each terminal fitting accommodating chamber 61 and extend in forward and backward directions FBD at opposite sides of the locking lance 64 for receiving the stabilizers 46. Two projection insertion grooves 68 are formed in the inner peripheral wall surface of each terminal fitting accommodating chamber 61 and extend back at positions angularly spaced from the locking lance 64 by about 90°. The projections 48 engage the front edges of the projection insertion grooves 68 when the terminal fitting 42 is inserted to a proper depth to limit forward movement of the terminal fitting 42.

The three terminal fitting accommodating chambers 61 are provided in the terminal accommodating portion 49 at two levels in the height direction HD, and the locking lances 64, the deformation spaces 65 and the excessive deformation preventing portions 66 are formed to correspond to the respective terminal fitting accommodating chambers 61. In the following description, a suffix A identifies the parts in the upper level and a suffix B identifies the parts in the lower level. However, no suffix is used to refer generically to the terminal fitting accommodating chambers 61, the locking lances 64, the deformation spaces 65 and the excessive deformation preventing portions 66.

As shown in FIGS. 16 and 17, the terminal fitting accommodating chambers 61 include two first terminal fitting accommodating chambers 61A arranged substantially side by side in the upper level in the terminal accommodating portion 49 and one second terminal fitting accommodating chamber 61B in the lower level and displaced in the vertical direction VD from the first terminal fitting accommodating chambers 61A. The first and second terminal fitting accommodating chambers 61A are adjacent to the second terminal fitting accommodating chamber 61B in the height direction HD, which is substantially normal to an arrangement direction the first terminal fitting accommodating chambers 61A. The second terminal fitting accommodating chamber 61B is displaced from the first terminal fitting accommodating chambers 61A in the width direction WD, which is the arrangement direction the first terminal fitting accommodating chambers 61A, and is arranged at an intermediate position between the first terminal fitting accommodating chambers 61A in the width direction WD. In this way, the respective terminal fitting accommodating chambers 61A, 61B are arranged in an offset manner, and the central positions of the respective terminal fitting accommodating chambers 61A, 61B are at the vertices of a right or equilateral triangle.

First locking lances 64A are in the first terminal fitting accommodating chambers 61A and can deform resiliently down substantially toward the second terminal fitting accommodating chamber 61B. On the other hand, a second locking lance 64B is in the second terminal fitting accommodating chamber 61B and can deform resiliently up substantially toward the first terminal fitting accommodating chambers 61A. In other words, the resilient deforming directions of the first locking lances 64A and the second locking lance 64B are substantially opposite. Further, the first and second locking lances 64A, 64B are at substantially the same positions in the height direction HD and substantially align on a straight line in the width direction WD.

First deformation spaces 65A and first excessive deformation preventing portions 66A for the first locking lances 64A overlap the second terminal fitting accommodating chamber 61B in the height direction HD, but are laterally displaced from the second terminal fitting accommodating chamber 61B in the width direction WD. On the other hand, a second deformation space 65B and a second excessive deformation preventing portion 66B for the second locking lance 64A overlap the first terminal fitting accommodating chambers 61A in the height direction HD, but are laterally displaced in the width direction WD to a middle position between the first terminal fitting accommodating chambers 61A. Further, the front end of the lock arm 52 overlaps the first terminal fitting accommodating chambers 61A in the height direction HD, but is displaced laterally in the width direction WD to a middle position between the first terminal fitting accommodating chambers 61A. Thus, the terminal fitting accommodating chambers 61, the locking lances 64, the deformation spaces 65, the excessive deformation preventing portions 66 and the lock arm 52 are arranged efficiently for miniaturization of the housing 41.

A jig insertion groove 69 is formed in the second excessive deformation preventing portion 66B, as shown in FIGS. 16 and 29, and can receive a jig for moving the front retainer 43. The jig insertion groove 69 is formed by partly recessing the second excessive deformation preventing portion 66B and is at a middle position between the first terminal fitting accommodating chambers 61A. More specifically, the jig insertion groove 69 is at a substantially widthwise middle position of the second excessive deformation preventing portion 66B in the width direction WD and divides the second excessive deformation preventing portion 66B into left and right sections in the width direction WD. Thus, two excessive deformation preventing portions 66B are left at the opposite lateral sides of the jig insertion groove 69 and are engageable with the opposite widthwise ends of the second locking lance 64B. The jig insertion groove 69 communicates with the second deformation space 65B and also recesses a partition wall between the first terminal fitting accommodating chambers 61A to split the partition wall into left and right sections in the width direction WD. The jig insertion groove 69 has a depth to reach a position more forward than the rear end of the second locking lance 64B.

The retainer mount recess 62 is formed in the front surface of the terminal accommodating chamber 49, as shown in FIG. 16, and can receive the front retainer 43 from the front along the forward and backward directions FBD. The retainer mount recess 62 has a recessed section 62*a* formed in a lower area of the front surface of the terminal accommodating chamber 49. Grooves 62*b* are formed at opposite lateral end positions of the recessed section 62*a* and are deeper than the recessed section 62*a*. The recessed section 62*a* is formed in a range of the terminal accommodating chamber 49 lower than the first terminal fitting accommodating chambers 61A and including the respective excessive deformation preventing portions 66A, but excluding the front wall of the second terminal fitting accommodating chamber 61B. The recessed section 62*a* communicates with the respective deformation spaces 65.

The grooves 62*b* of the retainer mount recess 62 are formed in a range in the height direction HD from substantially the same position as the first locking lances 64A to substantially the same position as the second terminal fitting accommodating chamber 61B, and are bent along the inner peripheral surface of the receptacle 50 when viewed from the front. Specifically, upper parts of the grooves 62*b* overlap the first locking lances 64A and the first deformation spaces 65A in the height direction HD and are arranged at positions lateral to the first locking lances 64A and the first deformation spaces 65A in the width direction WD. Lower parts of the grooves 62*b* are adjacent to the first terminal fitting accommodating chambers 61A in the height direction HD and are at positions lateral to the second terminal fitting accommodating chamber 61B in the width direction WD.

First and second retainer holders 70 and 71 are provided at the peripheral edges of the grooves 62*b*, as shown in FIGS. 16 and 29, for holding the front retainer 43 in a mounted state. The first retainer holders 70 project down at front end positions of the upper edges of the grooves 62*b*. On the other hand, the second retainer holders 71 project obliquely up at positions of the lower edges of the grooves 62*b* more backward than the first retainer holders 70.

The front retainer 43 is made e.g. of synthetic resin and defines a U-shape along the retainer mount recess 62. The front retainer 43 includes a primary plate 72 that is long in the width direction WD and two side plates 73 that extend back from the opposite lateral sides of the rear surface of the primary plate 72. Deformation restricting portions 74 project back from an intermediate part of the rear surface of the primary plate 72 and an operable portion 75 projects up from the upper edge of the primary plate 72, as shown in FIGS. 22 to 25. The primary plate 72 is shaped to conform to the recessed section 62*a* of the retainer mount recess 62, and an insertion hole 72*a* penetrates the primary plate 72 for receiving the front wall of the second terminal fitting accommodating chamber 61B.

The deformation restricting portions 74 are spaced apart along the width direction W of the primary plate 72 and enter the deformation spaces 65 for the locking lances 64 when the front retainer 43 is mounted into the housing 41 to restrict deformations of the locking lances 64. The middle deformation restricting portion 74 is at a relatively high position that conforms to the second deformation spaces 65B of the housing 41 and the deformation restricting portions 74 at the opposite sides are at relatively low positions that conform to the first deformation spaces 65A of the housing 41. Surfaces of the respective deformation restricting portions 74 facing the corresponding locking lances 64 are inclined to conform to the outer surface shapes of the corresponding locking lances 64. These inclined surfaces are continuous with the edges of the primary plate 72 adjacent to the respective deformation restricting portions 74.

Figure 25:
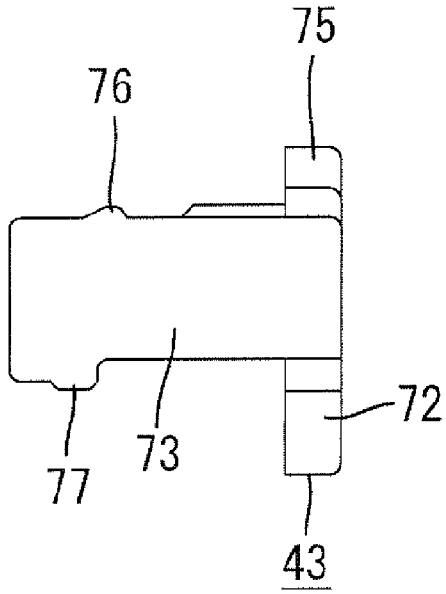
FIG. 25 is a side view of the front retainer for the connector.
Figure 26:
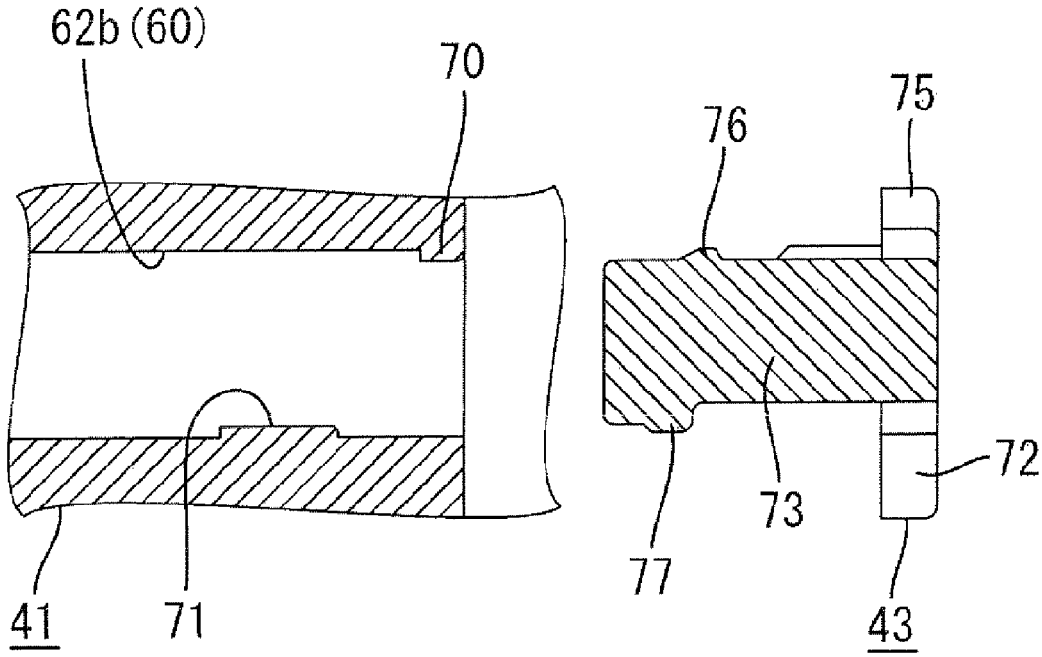
FIG. 26 is a section along E-E of FIGS. 16 and 23 showing a retainer mount recess and the front retainer in detail.
Figure 27:
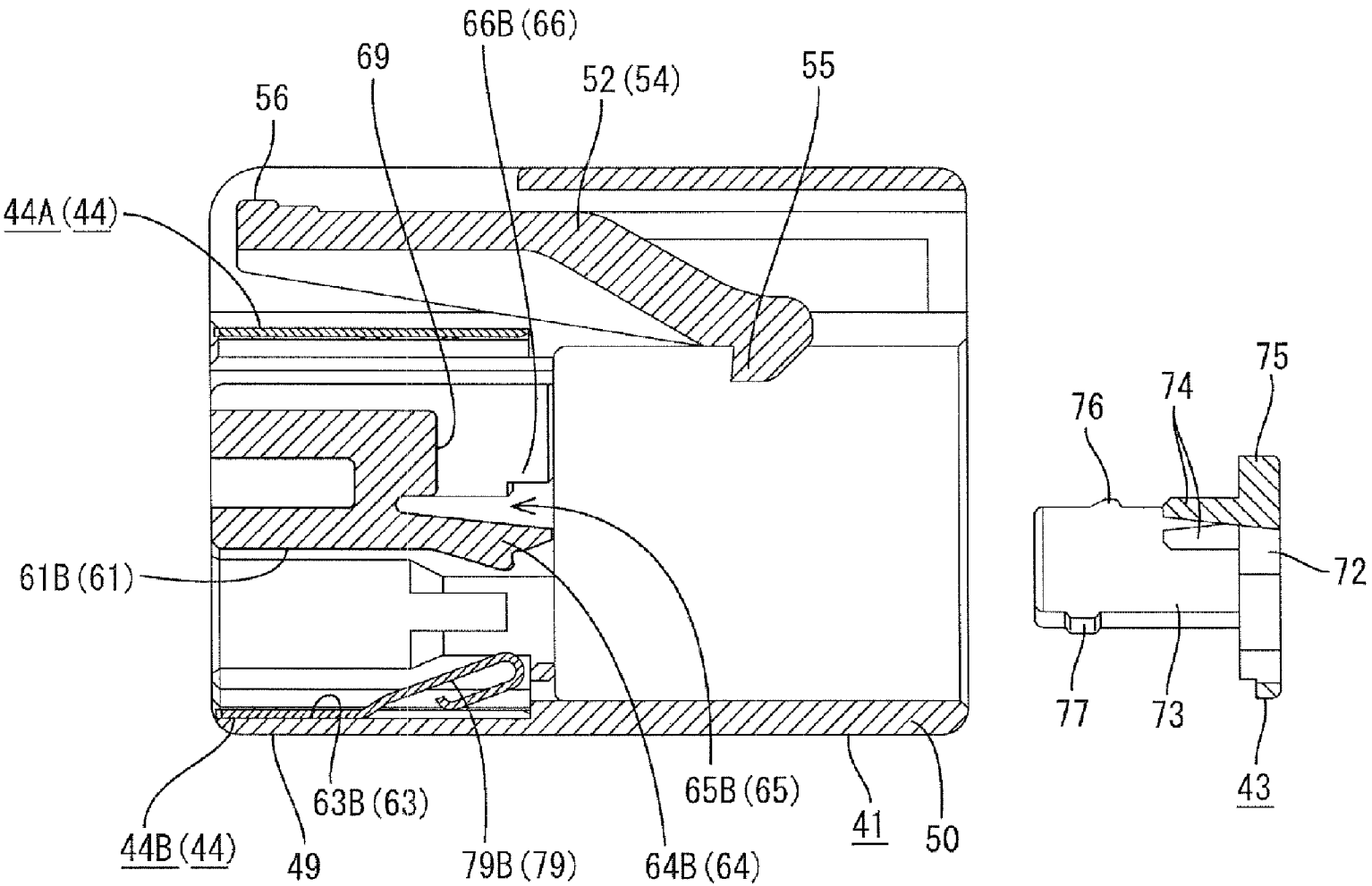
FIG. 27 is a section of the housing and the front retainer along F-F of FIG. 45.

The side plates 73 are bent at obtuse angles in conformity with the shapes of the grooves 62*b* of the retainer mount recess 62 at intermediate positions when viewed from the front. Specifically, upper parts of the side plates 73 are substantially straight in the height direction HD, whereas lower parts thereof are inclined with respect to the height direction HD. First and second locks 76, 77 are formed at upper and lower edges of the side plates 73, as shown in FIGS. 25 and 26, and are engageable with the first and second retainer holders 70, 71 of the housing 41. The first locks 76 are at forward positions on the upper edges of the side plates 73, whereas the second locks 77 are at more backward positions at the lower edges of the side plates 73.

Figure 22:
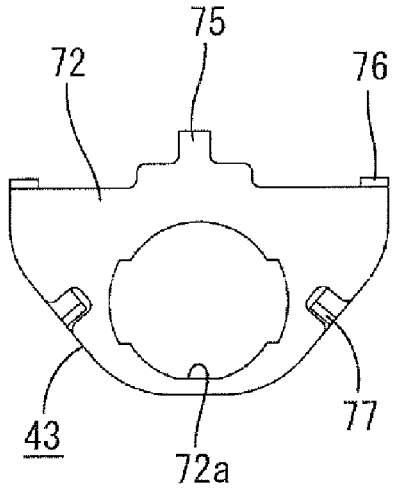
FIG. 22 is a front view of a front retainer for a connector.
Figure 23:
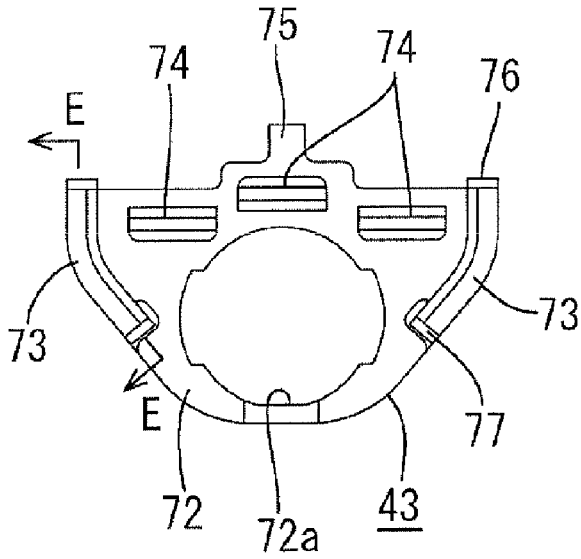
FIG. 23 is a rear view of the front retainer for the connector.
Figure 24:
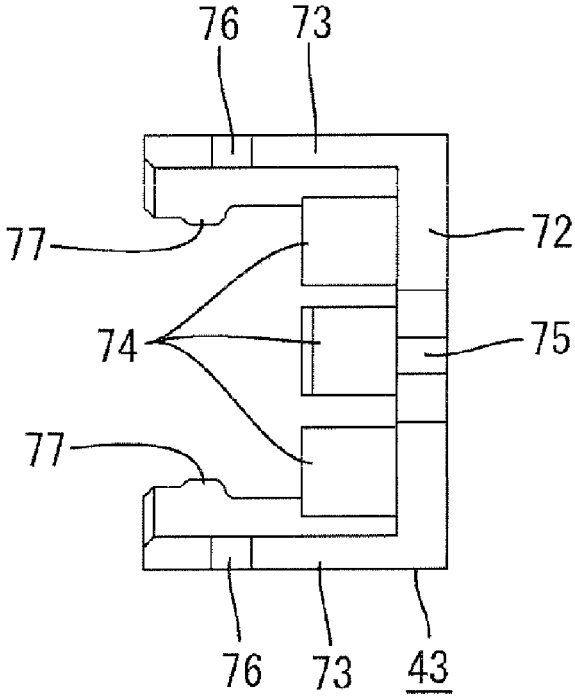
FIG. 24 is a plan view of the front retainer for the connector.
Figure 32:
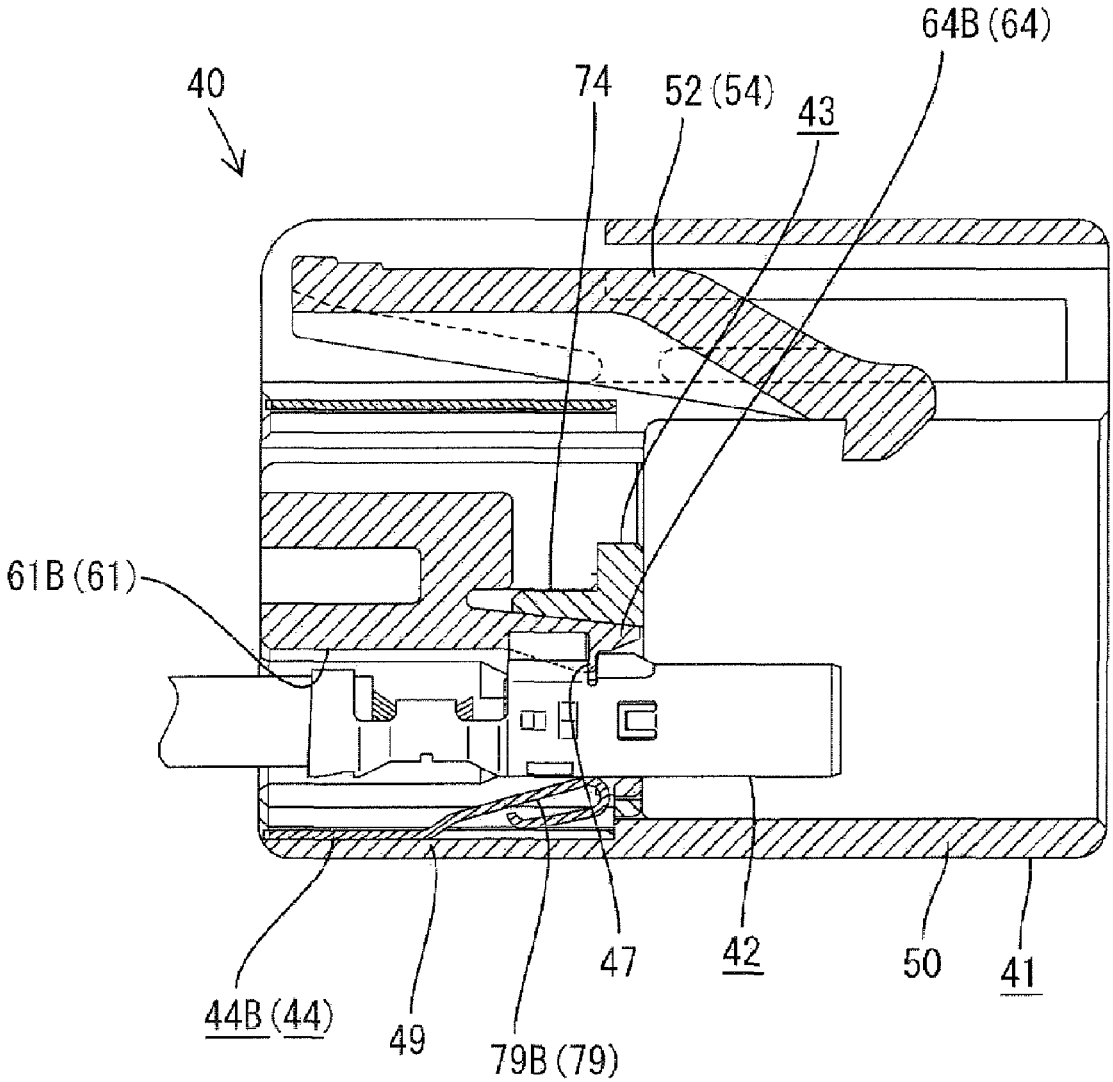
FIG. 32 is a section along F-F of FIG. 45 showing the state where the front retainer is mounted at the fully locked position in the housing.

The operable portion 75 projects up from a widthwise middle part of the primary plate 72, as shown in FIGS. 22 and 23, and is operated by a jig (not shown) to move the front retainer 43 mounted in the housing 41. The operable portion 75 is adjacent to the deformation restricting portion 74 corresponding to the middle second locking lance 64 in the height direction and can fit into the jig insertion groove 69 in the housing 41 (FIG. 32). The height of the operable portion 75 is lower than the jig insertion groove 69 and substantially at the same height as the first terminal fitting accommodating chambers 61A. Thus, the jig can be inserted from the front into a part of the jig insertion groove 69 to be located above the fitted operable portion 75.

Figure 28:
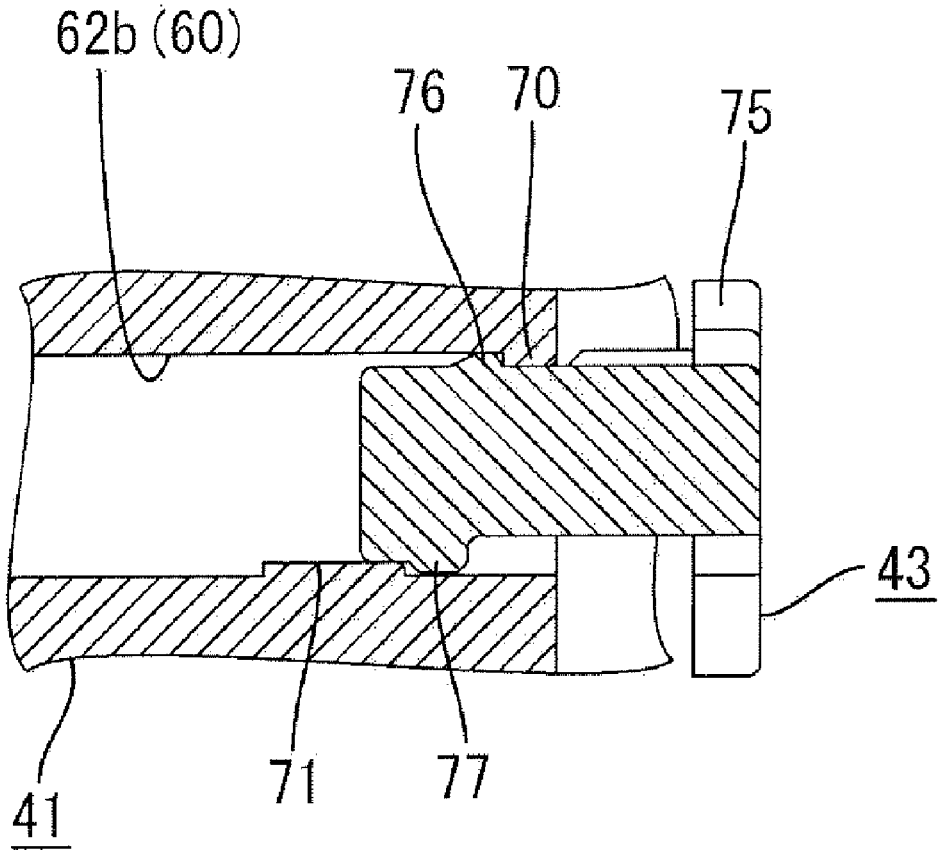
FIG. 28 is a section along E-E of FIGS. 16 and 23 showing a state where the front retainer is mounted at a partly locked position in the housing.
Figure 30:
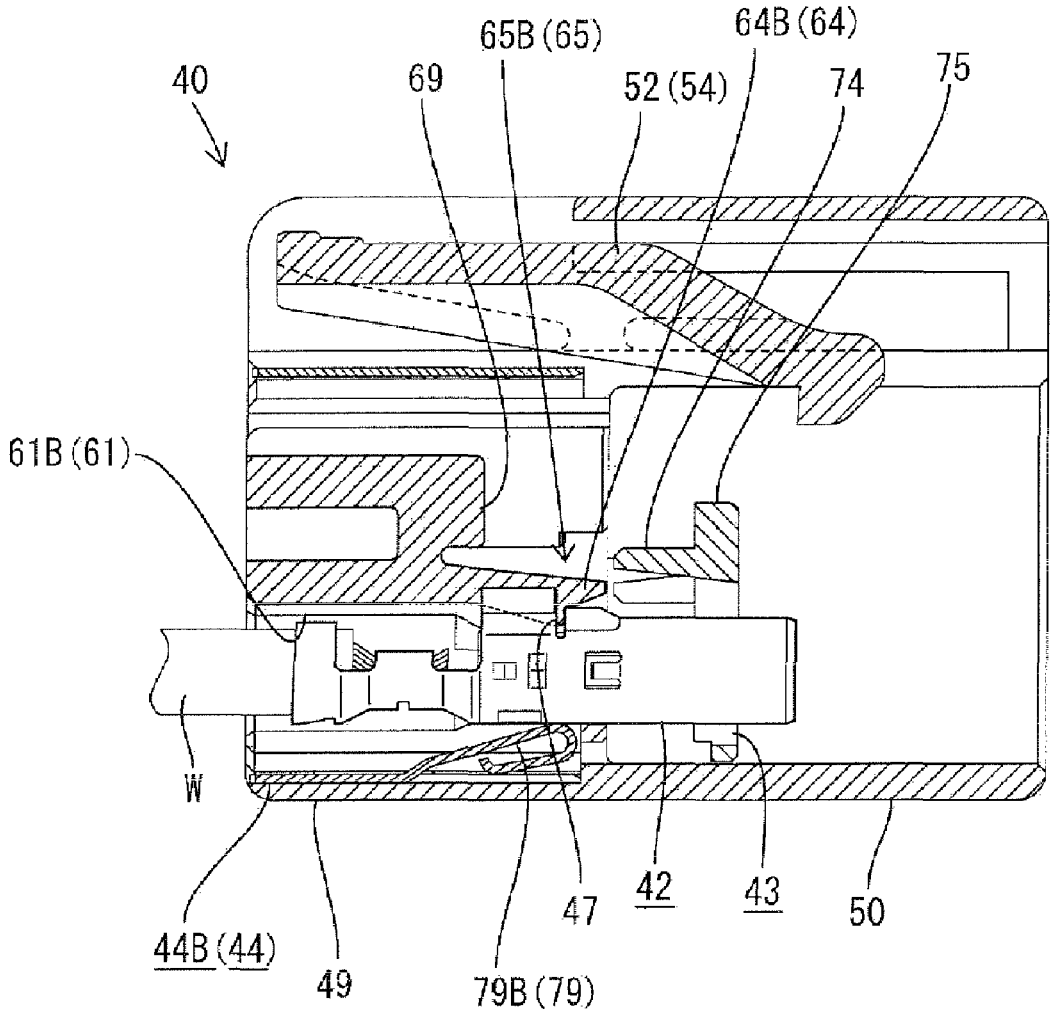
FIG. 30 is a section along F-F of FIG. 45 showing a state where a terminal fitting is inserted.
Figure 31:
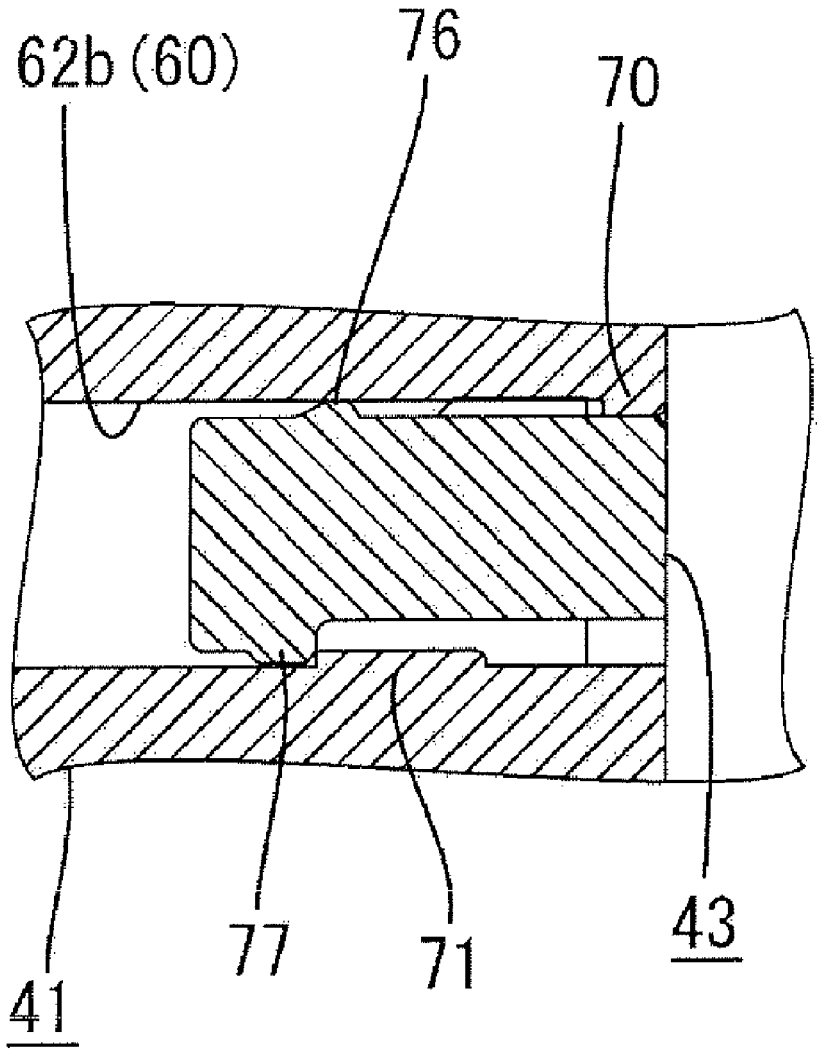
FIG. 31 is a section along E-E of FIGS. 16 and 23 showing a state where the front retainer is mounted at a fully locked position in the housing.

The front retainer 43 can be held selectively in the housing 41 at two different positions that are spaced in forward and backward directions FBD. Specifically, the front surfaces of the first locks 76 can engage the rear surfaces of the first retainer holders 70, as shown in FIG. 28, to hold the front retainer 43 at a partial locking position where the front retainer 43 projects forward from the housing 41. At this time, the deformation restricting portions 74 are forward of the corresponding deformation spaces 65, as shown in FIG. 29, to permit deformation of the respective locking lances 64, and hence to permit insertion and withdrawal of the mating terminal fittings 42. Specified clearances are defined between the deformation restricting portions 74 and the corresponding locking lances 64 at this partly locked position, and a jig (not shown) is insertable into these clearances from the front for forcibly unlocking the locking lances 64 (FIG. 30). On the other hand, the front surfaces of the second locking portions 77 can engage the rear surfaces of the second retainer holding portions 71, as shown in FIG. 31, to hold the front retainer 43 at a fully locked position in the retainer mount recess 62 where the front end surfaces of the front retainer 43 and the terminal accommodating portion 49 are substantially flush with each other. At this time, the respective deformation restricting portions 74 project into the corresponding deformation spaces 65 to restrict the resilient deformations of the respective locking lances 64 as shown in FIG. 32.

Each divided ground terminal 44 is formed into a specified shape by press-forming an electrically conductive metal plate, as shown in FIGS. 35 to 40. The divided ground terminals 44 include a divided ground terminal 44A with two contacts for connecting the two terminal fittings 42 in the upper level with the bracket B and a divided ground terminal 44B with one contact for connecting the one terminal fitting 42 in the lower level with the bracket B. The suffixes A and B are used when referring to these two different types of divided ground terminals. However, no suffix is used when referring to these parts generically.

Each divided ground terminal 44 includes a main plate 78 extending in the width direction WD and in forward and backward directions FBD, at least one terminal contact piece 79 formed by partly cutting and bending the main plate 78, a side plate 80 bent at a lateral edge of the main plate 78 and extending in the vertical direction VD and a bracket contact piece 81 extending from the side plate 80. The terminal contact piece 79 can be brought into contact with the outer conductor terminal 45 of the terminal fittings 42 and the bracket contact piece 81 can be brought into contact with the bracket B.

Figure 41:
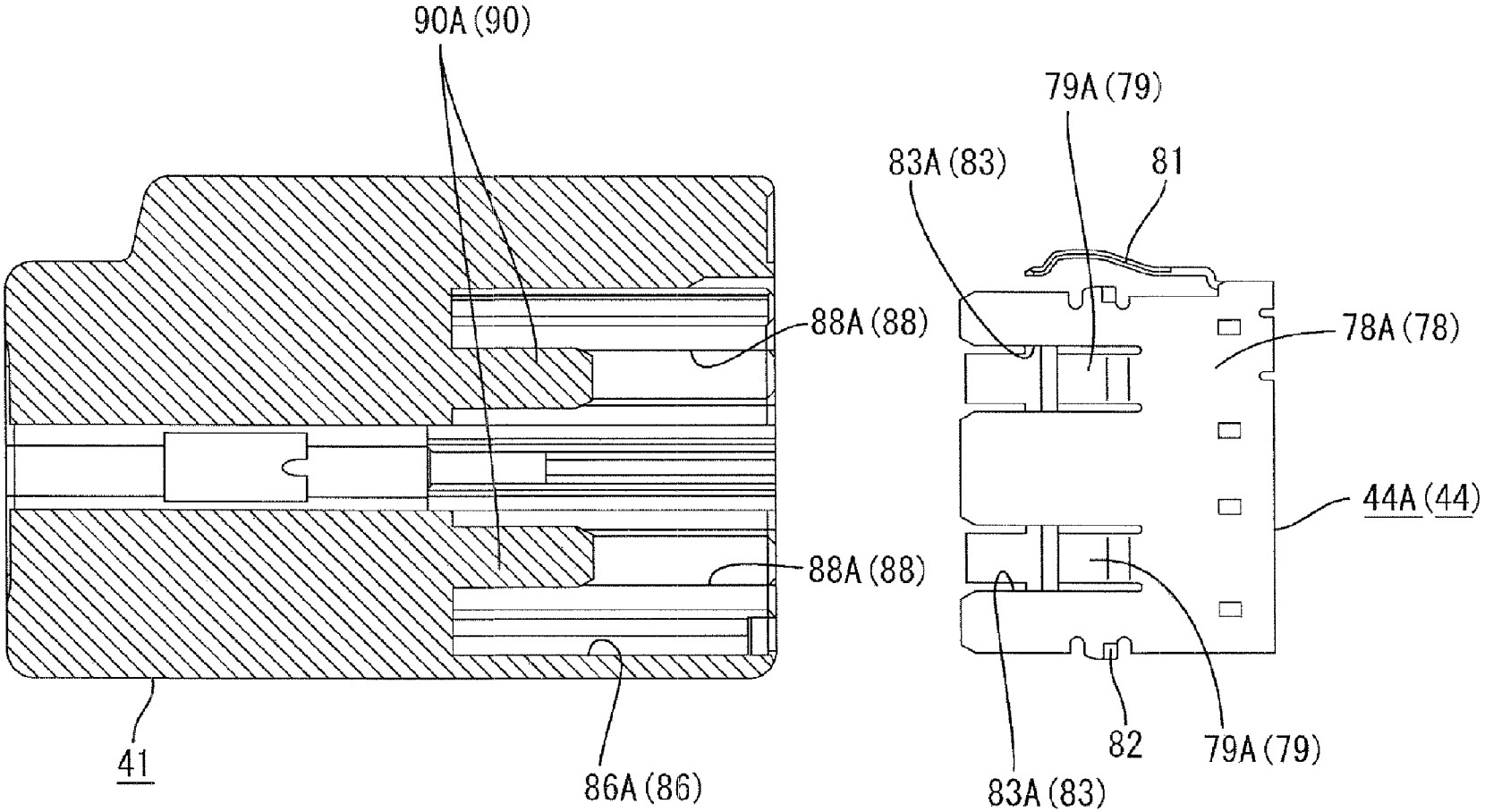
FIG. 41 is a section along H-H of FIG. 46 showing a state before the divided ground terminal with two contacts is mounted into the housing.
Figure 42:
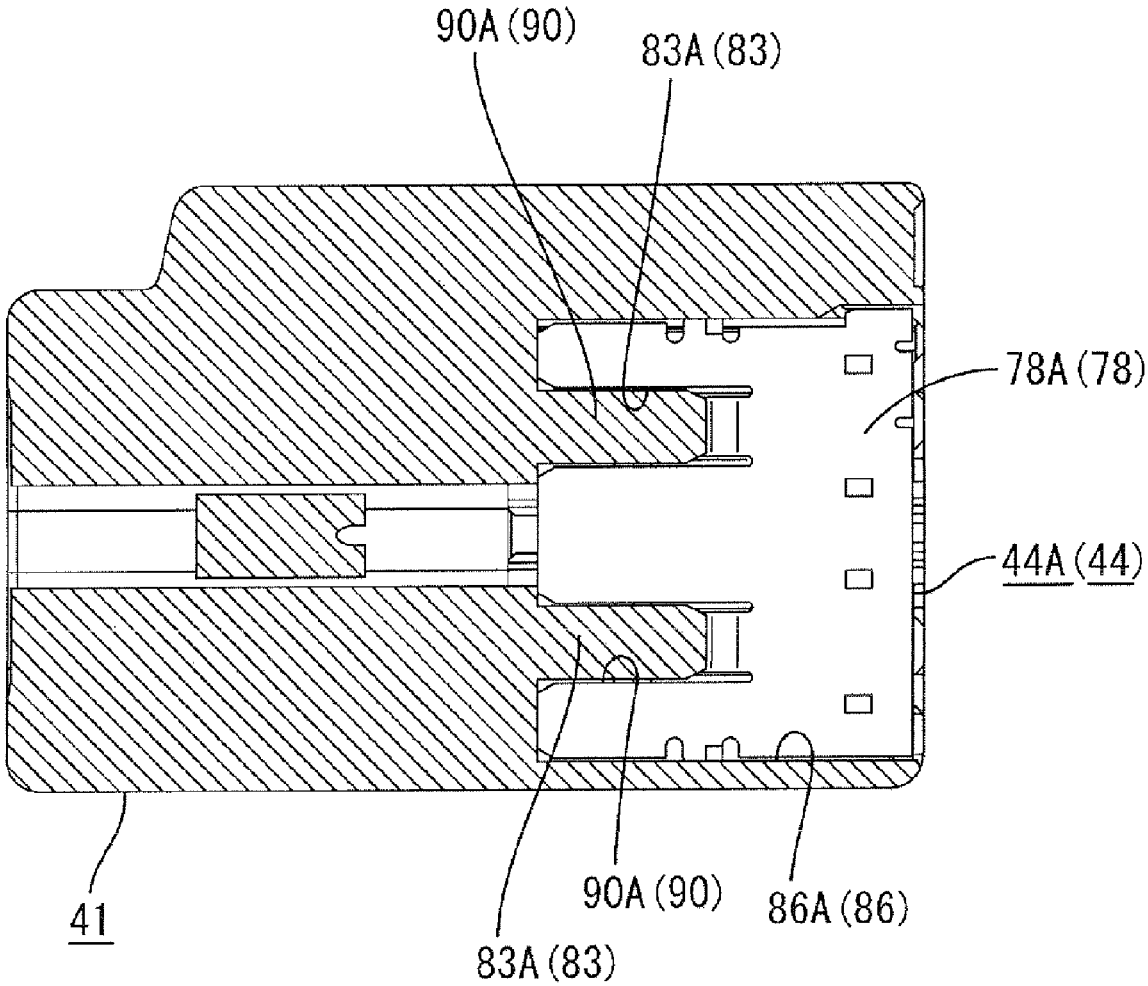
FIG. 42 is a section along H-H of FIG. 46 showing a state where the divided ground terminal with two contacts is mounted in the housing.

The main plate 78 is substantially rectangular in plan view and is shorter than the terminal accommodating portion 49 in forward and backward directions, as shown in FIGS. 41 and 42. Retaining pieces 82 are formed at the opposite lateral edges of the main plate 78 by cutting and bending. The retaining pieces 82 bite in inner surfaces of the divided ground terminal accommodating chamber 63 to hold the divided ground terminal 44 in the housing 41.

Each terminal contact piece 79 is a cantilever formed by making two forwardly open slits in the main plate 78 and bending a plate piece that extends farther forward from a part between the slits. Accordingly, a forwardly open cutout 83 is formed as the terminal contact piece 79 is formed and has a width that is substantially the sum of the width of the terminal contact piece 79 and the widths of both slits. The cutout 83 defines a rectangle that is long and narrow in forward and backward directions when the main plate 78 is viewed from above.

The terminal contact piece 79 is bent from the main plate 78 to project obliquely forward toward the opening of the cutout 83, then is folded toward the main plate 78 at the front end position of the main plate 78. This folded portion 79*a* defines a contact point with the terminal fitting 42. Accordingly, the terminal contact piece 79 is arranged to overlap the cutout 83 in forward and backward directions FBD and is arranged at a position displaced from the main plate 78 in the height direction HD by utilizing a space in the cutout 83. The terminal contact piece 79 is resiliently deformable up and down substantially orthogonal to an inserting direction ID of the terminal fitting 42 with the base end thereof as a support. Two projections 83 project sideways from opposite lateral edges of the free end of the terminal contact piece 79. The projections 84 are formed by partly widening the free end of the terminal contact piece 79, and the projecting distance thereof is longer than the width of the slits. The projections 84 are held in contact with the peripheral edge of the cutout 83 of the main plate 78. In this way, a resilient force of the terminal contact piece 79 is increased and an excessive resilient deformation is prevented.

Shake preventing portions 85 are formed by partly cutting and bending the main plate 78 at positions behind the cutout 83 and opposite sides of the cutout 83 in the width direction WD, as shown in FIGS. 35, 36, 38 and 39. The shake preventing portions 85 extend from the main plate 78 in substantially the same direction as the terminal contact piece 79 and prevent the main plate 78 from shaking in the vertical direction VD with respect to the housing 41.

Figure 35:
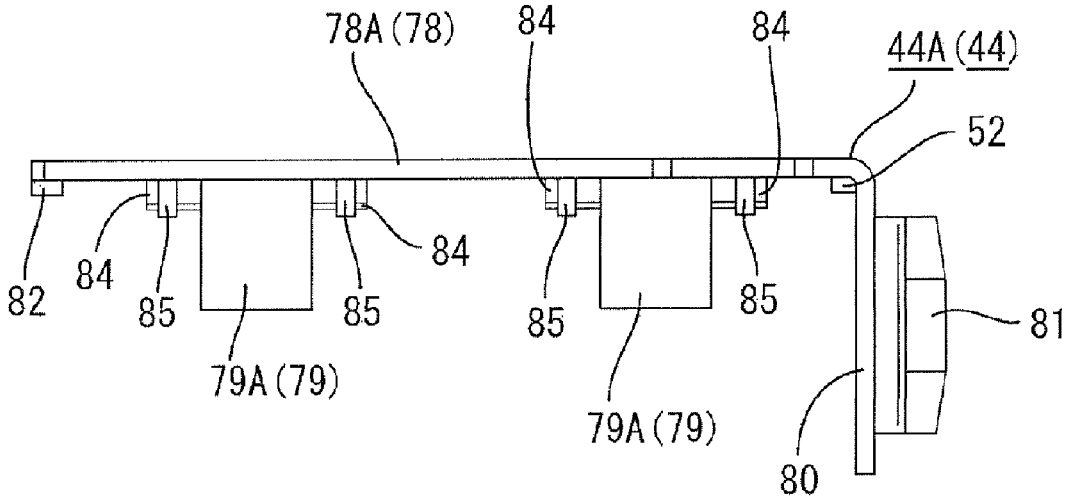
FIG. 35 is a rear view of a divided ground terminal with two contacts.
Figure 38:
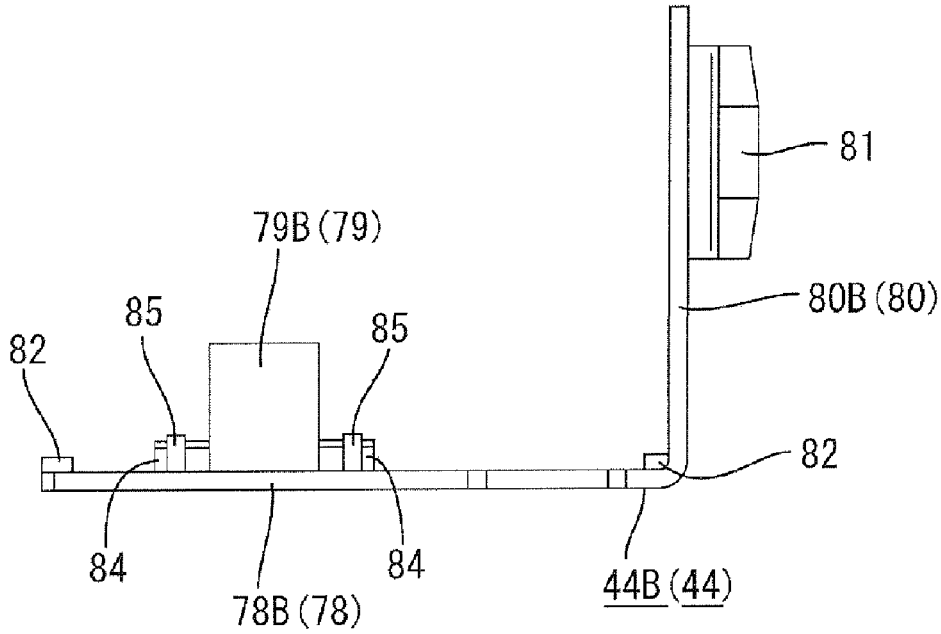
FIG. 38 is a rear view of a divided ground terminal with one contact.

The side plate 80 is bent at substantially at right angles from a rear end portion of the lateral edge of the main plate 78 to extend substantially in the vertical direction VD As shown in FIGS. 35 and 38. Thus, the main plate 78 and the side plate 80 form an L shape when viewed from the front or rear. The side plate 80 is a long narrow piece, and the bracket contact piece 81 extends forward from the front end thereof.

Figure 36:
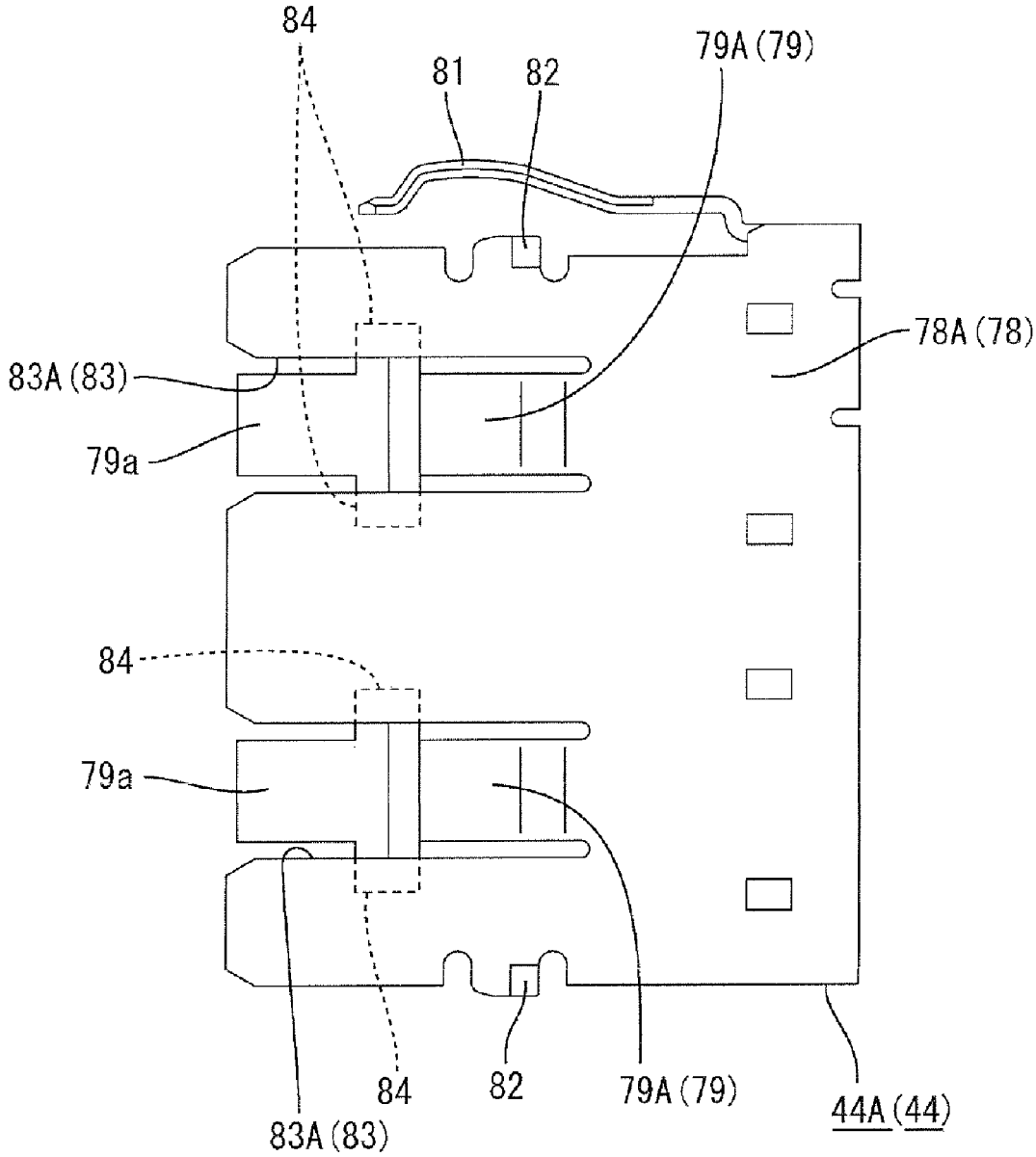
FIG. 36 is a plan view of the divided ground terminal with two contacts.
Figure 37:
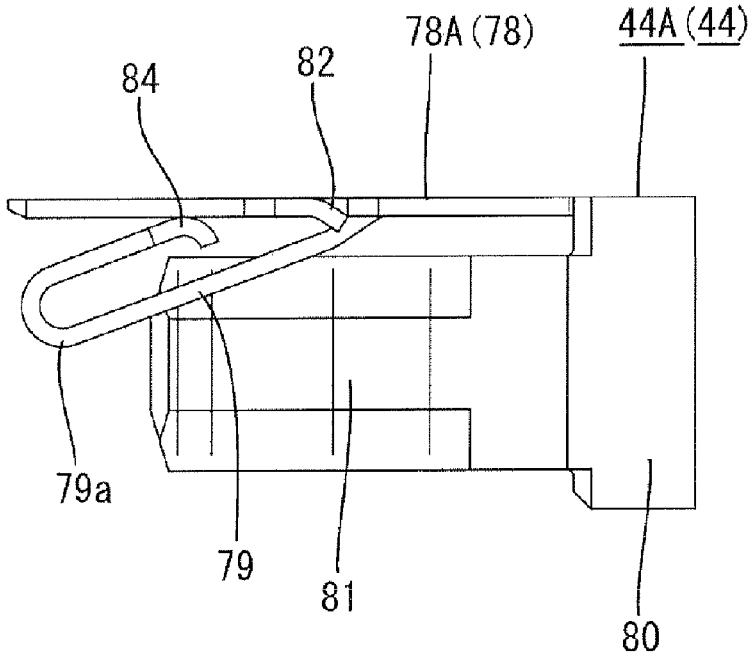
FIG. 37 is a side view of the divided ground terminal with two contacts.
Figure 39:
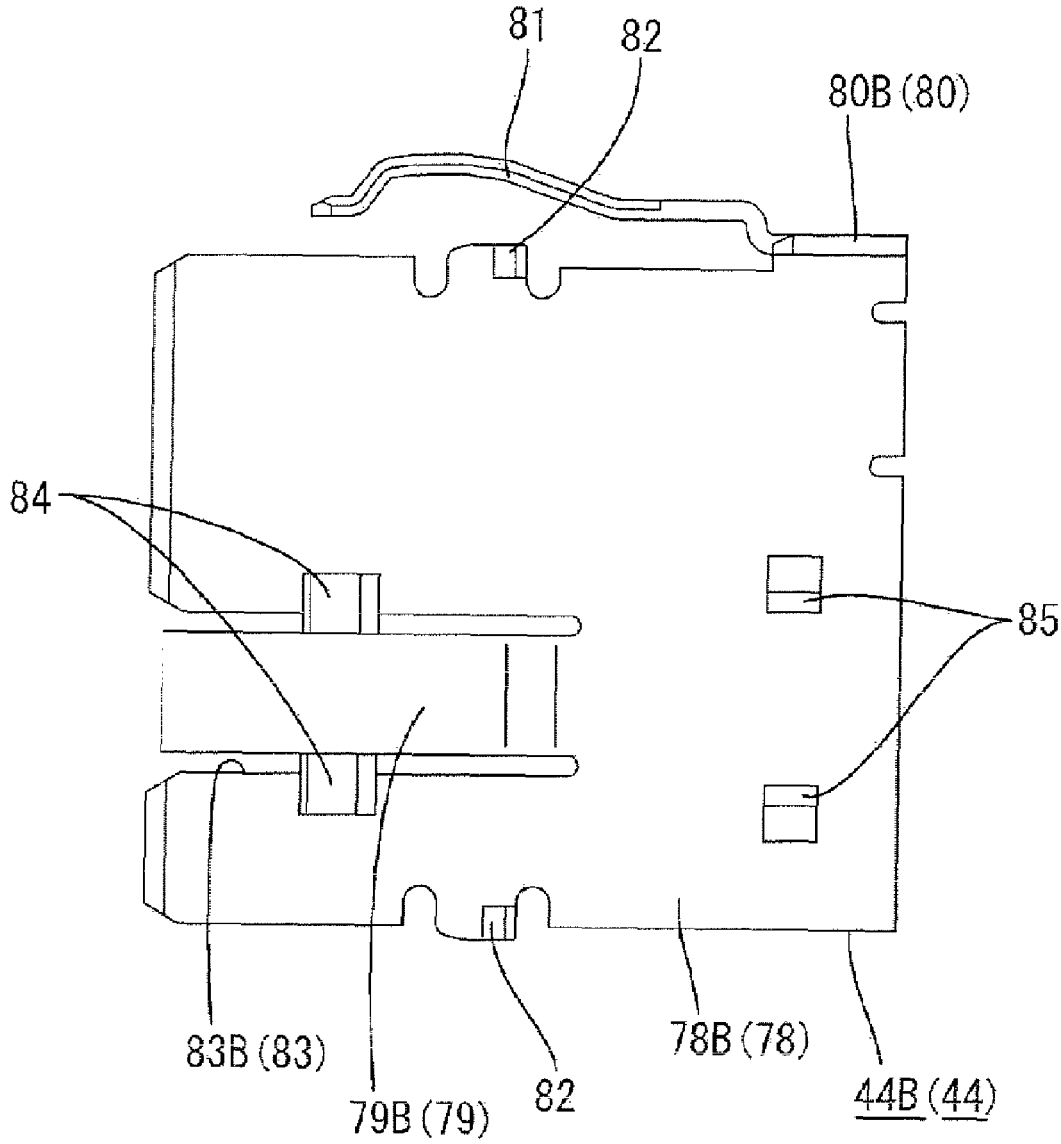
FIG. 39 is a plan view of the divided ground terminal with one contact.
Figure 40:
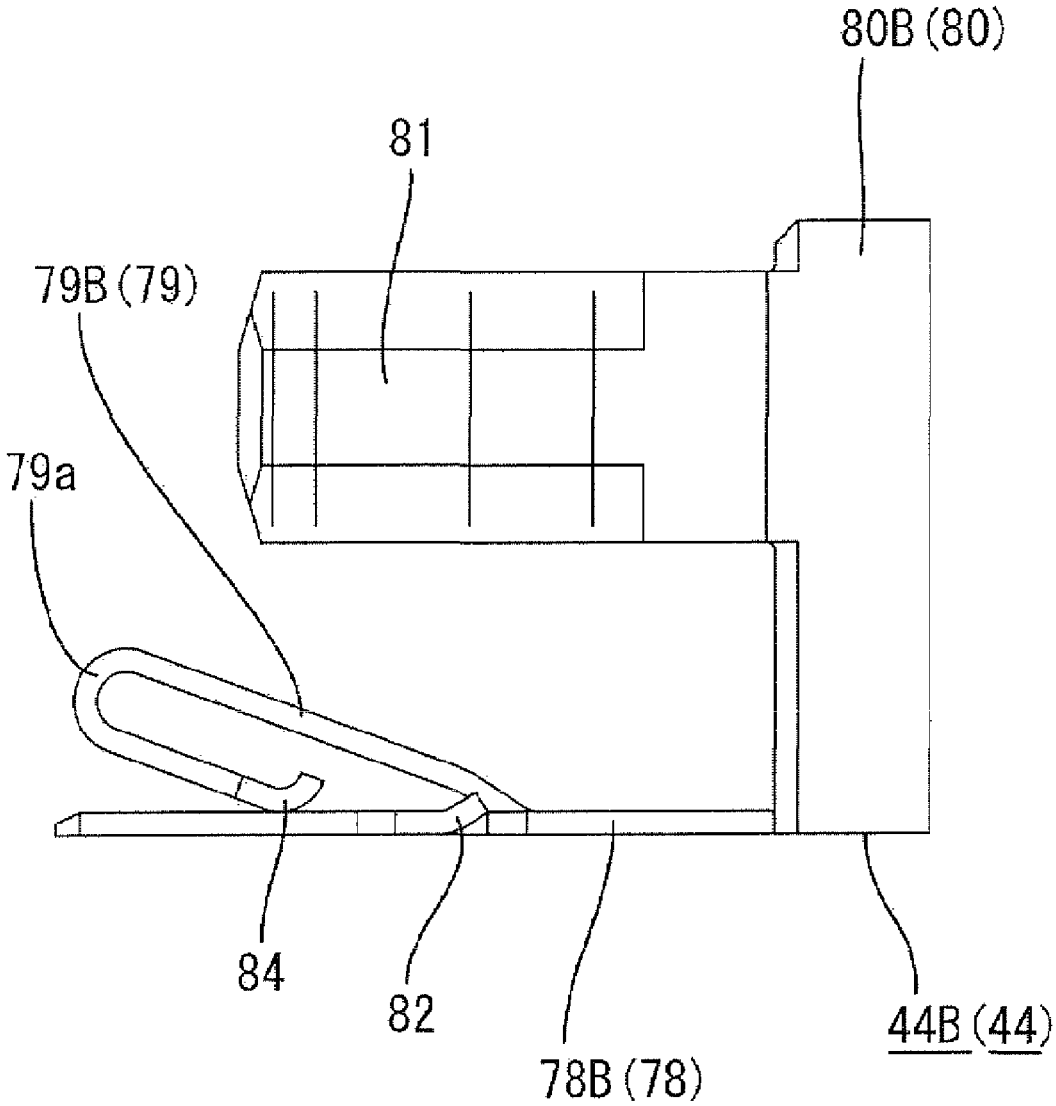
FIG. 40 is a side view of the divided ground terminal with one contact.

The bracket contact piece 81 is cantilevered forward, as shown in FIGS. 36 and 39, and has a substantially moderate mountain shape projecting from the side plate 80 and having a peak at an intermediate position. The peak defines a contact portion. Unlike the terminal contact piece 79, the free end of this bracket contact piece 81 cannot contact either the main plate 78 or the side plate 80 even during the resilient deformation. The bracket contact piece 81 is resiliently deformable about the base end thereof in the width direction WD substantially orthogonal to the inserting direction of the bracket B and substantially orthogonal to a vertically arranging direction VD of the terminal fittings 42. The outer surface of the bracket contact piece 81 defines a contact surface with the bracket B and has opposite sides thereof tapered as shown in FIGS. 35 and 38. A substantially a middle part of the bracket contact piece 81 projects more out than the opposite sides thereof. Further, bracket contact piece 81 is wider than the terminal contact piece 79.

Two terminal contact pieces 79A and two cutouts 83A are formed in the divided ground terminal 44A with two contacts (FIG. 36), whereas one terminal contact piece 79B and one cutout 83B are formed in the divided ground terminal 44B with one contact (FIG. 39). Accordingly, the main plate 78A of the divided ground terminal 44A with two contacts is wider than the main plate 78B of the divided ground terminal 44B with one contact (FIGS. 36 and 39). The two connecting portions 79A and the two cutouts 83A are substantially symmetrical in the main plate 78A with respect to the width direction WD in the divided ground terminal 44A with two contacts (FIG. 36), whereas the one terminal contact piece 79B and the one cutout 83B are displaced from the center of the main plate 78B toward a side opposite to the side plate 80B in the divided ground terminal 44B with one contact (FIG. 39).

The divided ground terminal accommodating chambers 63 are rearwardly open grooves in the terminal accommodating portion 49 that are outward of the respective terminal fitting accommodating chambers 61 and inward of the bracket accommodating chamber 51*a*, as shown in FIG. 17. Each divided ground terminal accommodating chamber 63 has a substantially L-shape that conforms to the corresponding divided ground terminal 44. More particularly, each divided ground terminal accommodating chamber 63 has a main plate accommodating part 86 that extends in the width direction WD for accommodating the main plate 78 and a side plate accommodating part 87 that extends in the vertical direction VD for accommodating the side plate 80.

Rearwardly open terminal contact piece communicating grooves 88 are formed in parts of the terminal accommodating portion 49 between the main plate accommodating parts 86 of the divided ground terminal accommodating chambers 63 and the adjacent terminal fitting accommodating chambers 61 to provide communication between the accommodating chambers 61, 63 and to permit insertion of the terminal contact pieces 79 into the terminal fitting accommodating chambers 61. Rearwardly open bracket contact piece communicating grooves 89 are formed in parts of the terminal accommodating portion 49 between the side plate accommodating parts 87 of the divided ground terminal accommodating chambers 63 and the bracket accommodating chamber 51*a* to provide communication between the accommodating chambers 51*a*, 63 and to permit insertion of the bracket contact pieces 81 into the bracket accommodating chamber 51*a*.

Figure 43:
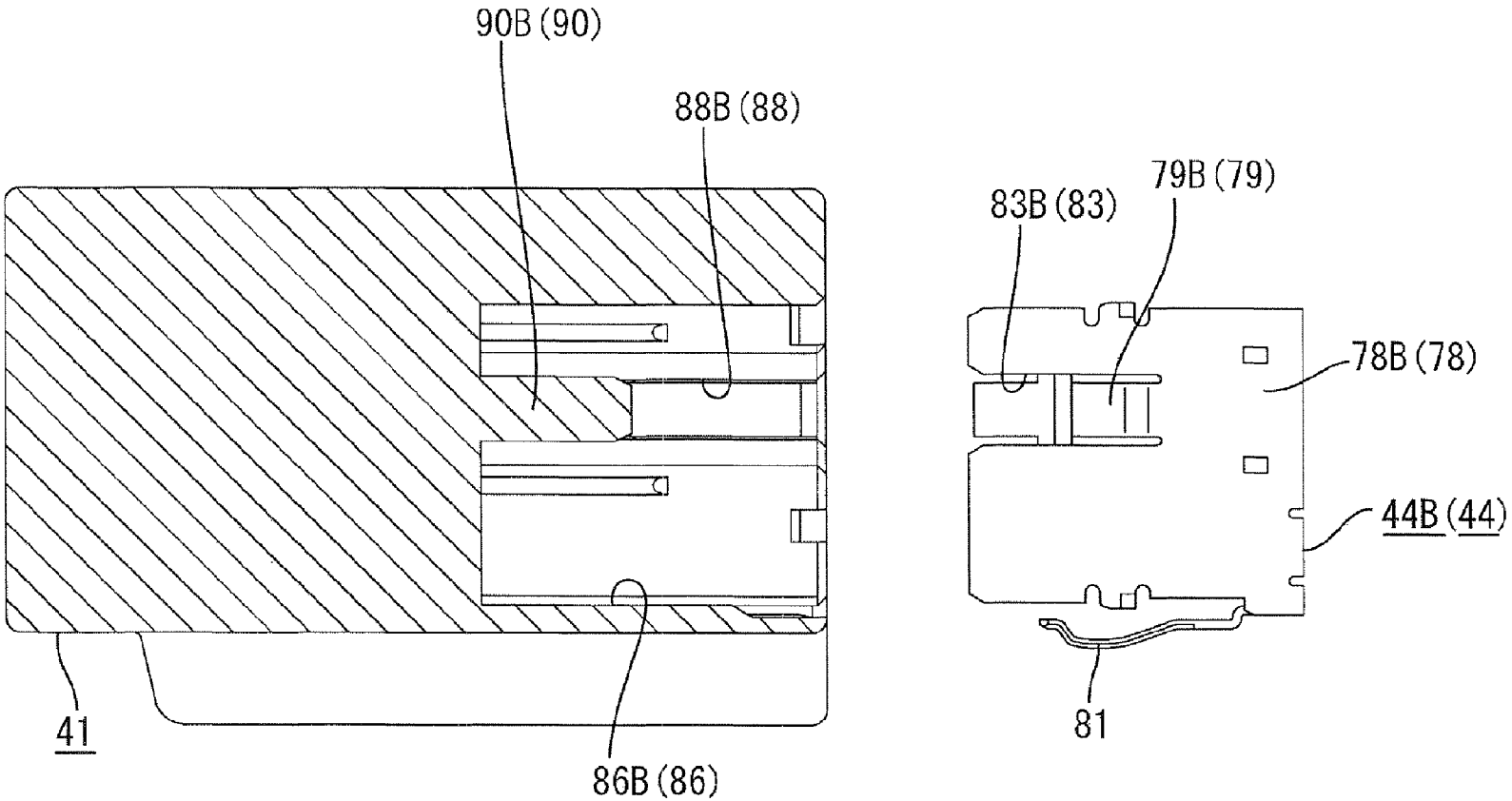
FIG. 43 is a section along I-I of FIG. 46 showing a state before the divided ground terminal with one contact is mounted into the housing.
Figure 44:
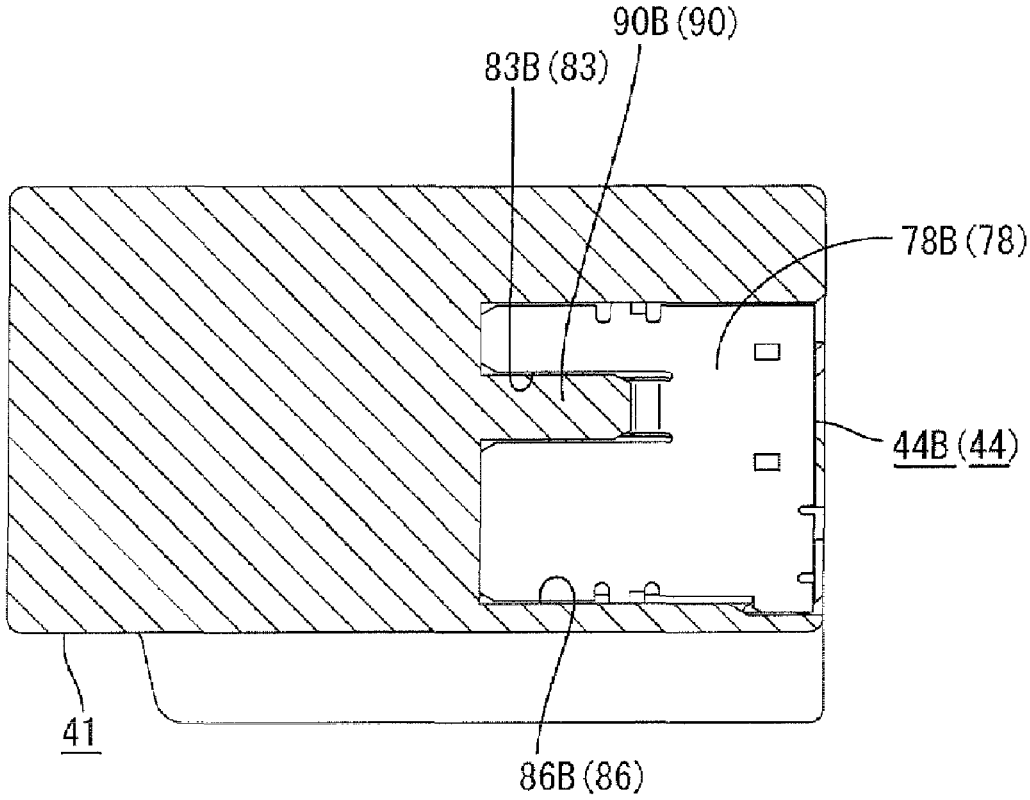
FIG. 44 is a section along I-I of FIG. 46 showing a state where the divided ground terminal with one contact is mounted in the housing.
Figure 45:
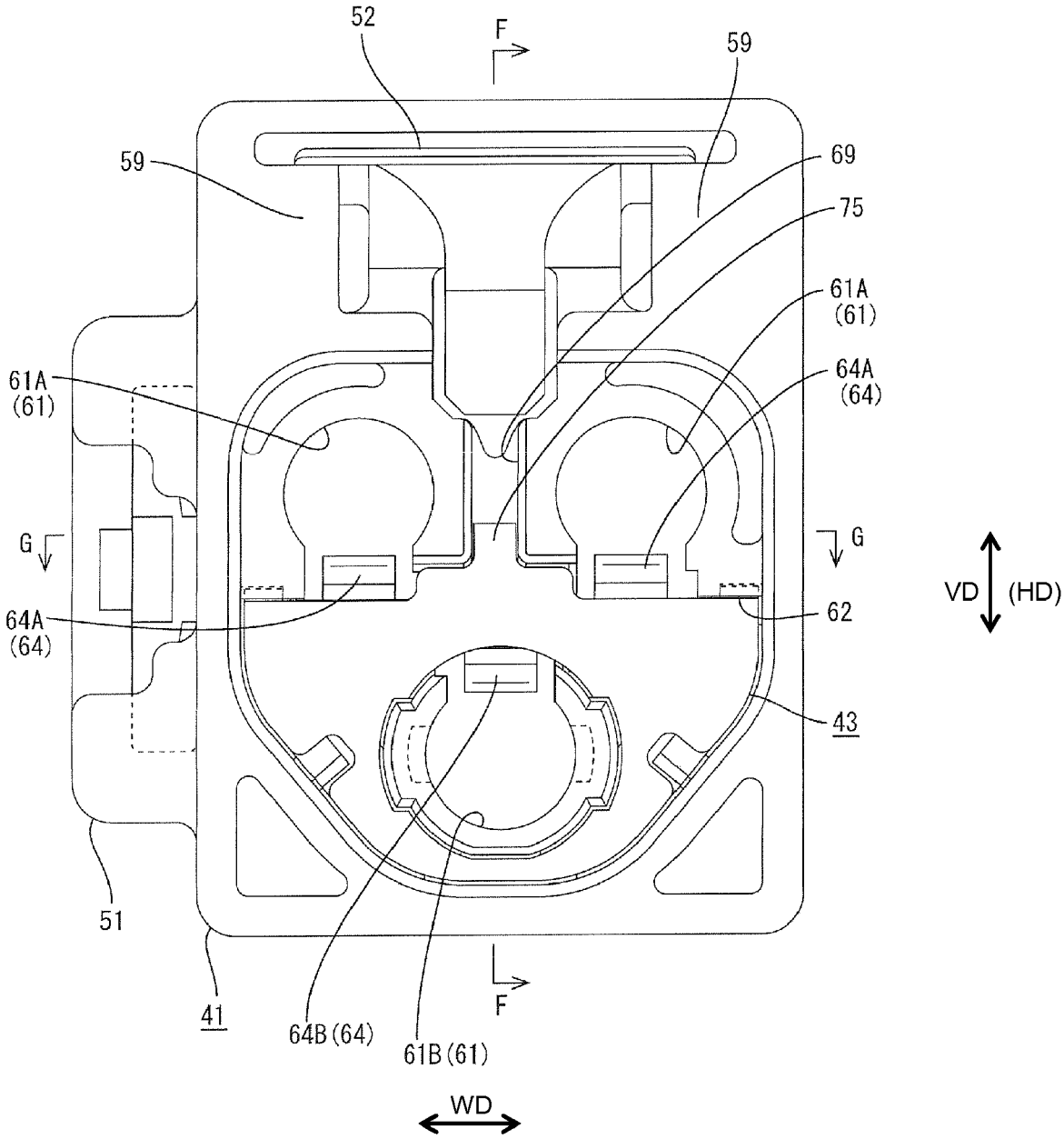
FIG. 45 is a front view showing a state where the front retainer is mounted in the housing.

As shown in FIGS. 17, 41 and 43, a positioning rib 90 faces the terminal contact piece communicating groove 88 on the circumferential surface of the main plate accommodating part 86 of the divided ground terminal accommodating chamber 63 and functions to position the mounted divided ground terminal 44. The positioning rib 90 is at substantially the same position as the terminal contact piece communicating groove 88 in the width direction WD to conform to the terminal contact piece 79 and the cutout 83 of the divided ground terminal 44. Accordingly, the positioning ribs 90 fit into the cutouts 83 when the divided ground terminal 44 is mounted to position the divided ground terminal 44 in the divided ground terminal accommodating chamber 63 in the width direction WD. In this way, the terminal contact pieces 79 are positioned in the width direction WD with respect to the terminal contact piece communicating grooves 88 and the terminal fittings 42. Each positioning rib 90 extends in forward and backward directions FBD and projects toward the corresponding terminal contact piece communicating groove 88 from the surface of the main plate accommodating part 86 extending in the width direction WD. The front end of each positioning rib 90 is connected with the front edge of the main plate accommodating part 86. The rear end of each positioning rib 90 is more forward than the rear end position of the housing 41. The positioning portion 90 is slightly shorter than the cutout 83 in the main plate 78.

Stepped projection insertion grooves 91 are formed between the terminal contact piece communicating grooves 88 and the main plate accommodating parts 86, as shown in FIG. 17, to permit insertion of the projections 84 of the terminal contact pieces 79. The projection insertion grooves 91 are slightly wider than both the terminal contact piece communicating grooves 88 and the widened parts of the terminal contact pieces 79 formed with the projections 84. The shake preventing portions 85 that project up from the main plates 78 can contact the peripheral edges of the projection insertion grooves 91 to prevent the main plates 78 and the terminal contact pieces 79 from shaking in the height direction HD. Two ribs 92 are provided on a surface of each main plate accommodating part 78 opposite the surface with the positioning rib 90. The ribs 92 have an arcuate cross section and extend in forward and backward directions FBD. The ribs 92 press against the main plate 78 when the main plate 78 is mounted into the main plate accommodating part 86 to support the main plate 78 and prevent shaking.

The accommodating chamber 63A for the divided ground terminal with two contacts extends from the upper end of the terminal accommodating portion 49 to an upper part of the right (side of the bracket mounting portion 51) side shown in FIG. 17. Specifically, the main plate accommodating part 86A of the accommodating chamber 63A for the divided ground terminal with two contacts is above the terminal fitting accommodating chambers 61A in the upper level in the connector 40, and the side plate accommodating part 87A is between the right terminal fitting accommodating chamber 61A in the upper level in FIG. 17 and the bracket accommodating chamber 51*a*. Two terminal contact piece communicating grooves 88A are formed to correspond to the terminal fitting accommodating chambers 61A in the upper level. Further, two positioning ribs 90A are formed to correspond to the terminal contact piece communicating grooves 88A. The bracket contact piece communicating groove 89A communicates with the side plate accommodating part 87A in the upper part of the terminal accommodating portion 49 and the upper part of the bracket accommodating chamber 51*a*. Further, the ribs 92A are provided at opposite end positions of the main plate accommodating part 86A.

The accommodating chamber 63B for the divided ground terminal with one contact extends from the bottom end of the terminal accommodating portion 49 to a lower part of the right (side of the bracket mounting portion 51) side shown in FIG. 17. Specifically, the main plate accommodating part 86B of the accommodating chamber 63B for the divided ground terminal with one contact is below the terminal fitting accommodating chamber 61A in the lower level, and the side plate accommodating part 87B is between the terminal fitting accommodating chamber 61B in the lower level and the bracket accommodating chamber 51*a*. The terminal contact piece communicating groove 88B corresponds to the terminal fitting accommodating chamber 61B in the lower level. Further, the positioning rib 90B corresponds to the terminal contact piece communicating groove 88B. The bracket contact piece communicating groove 89B communicates the side plate accommodating part 87B in the lower part of the terminal accommodating portion 49 and the lower part of the bracket accommodating chamber 51*a*. Further, the ribs 92B are at positions of the main plate accommodating part 86B adjacent to the projecting portion insertion groove 91.

The bracket contact piece communicating grooves 89 are between the divided ground terminal accommodating chambers 63 and the bracket accommodating chamber 51*a* as described above to communicate the divided ground terminal accommodating chambers 63 and the bracket accommodating chamber 51*a*. A partition 93 is left in this communicating part and partitions the divided ground terminals 44 and the bracket B mounted in the respective accommodating chambers 51*a*, 63. The partition 93 includes a base 93*a* for partitioning the side plate accommodating parts 87 of the divided ground terminal accommodating chambers 63. Two projections 93*b* project from the leading end of the base 93*a* and partition the side plate accommodating parts 87 and the bracket accommodating chamber 51*a*. Thus, the partition 93 is substantially T-shaped when viewed from behind.

Figure 46:
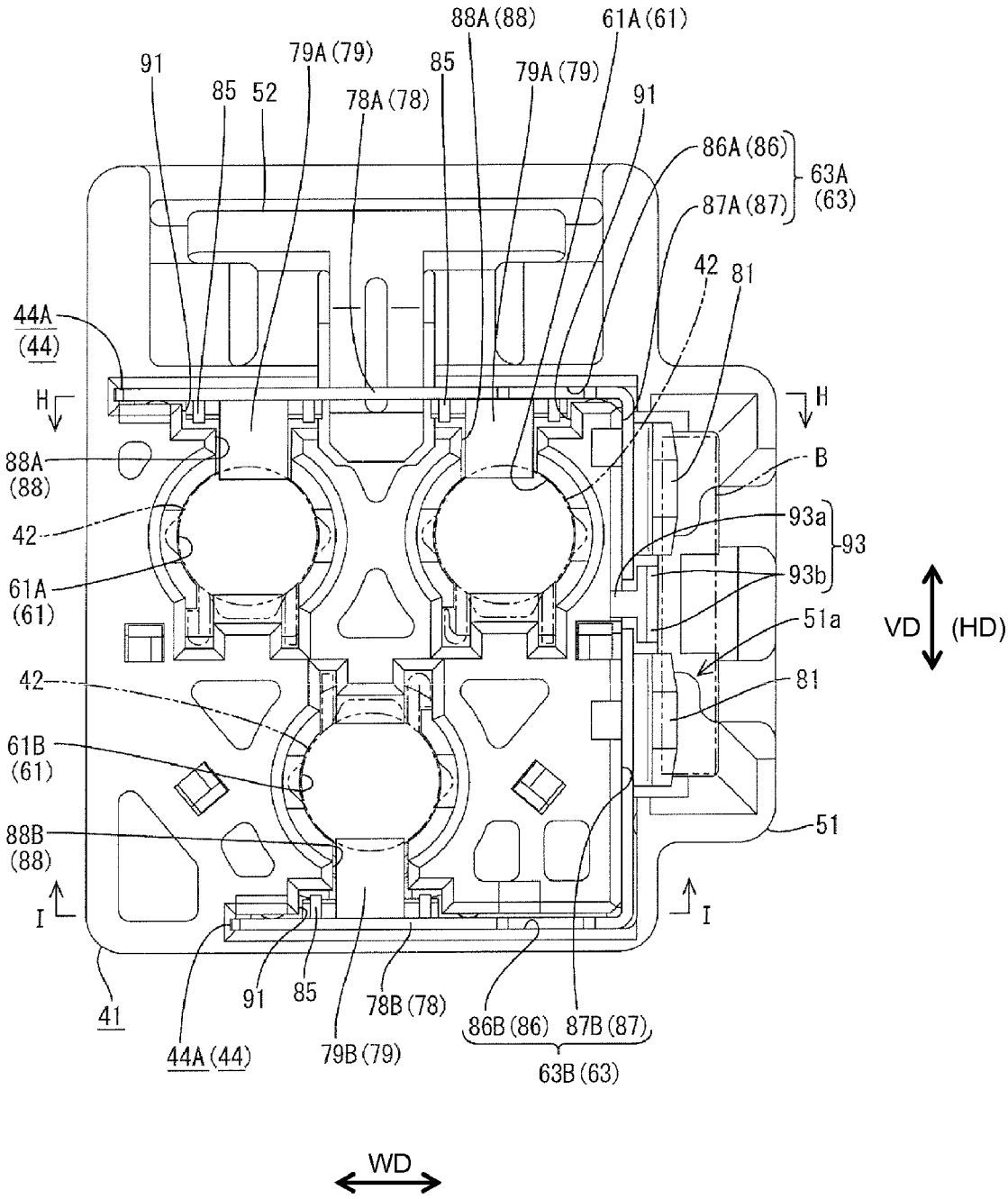
FIG. 46 is a rear view showing a state where the divided ground terminals are mounted in the housing.

The base 93*a* of the partition 93 forms side walls of the side plate accommodating parts 87, whereas the projections 93*b* form the ceiling walls of the side plate accommodating parts 87 and the bottom wall of the bracket accommodating chamber 51*a*. The projections 93*b* project up to positions near the ends of the bracket contact pieces 81, but still avoid the bracket contact pieces 81 (FIG. 46). As shown in FIG. 17, the partition 93 defines a rib extending substantially in forward and backward directions FBD, in which the divided ground terminal accommodating chambers 63 and the bracket accommodating chamber 51*a* are open, and the rear end of the partition 93 is at the rear end of the housing 41 and exposed to the outside in the back.

The connectors 10, 40 are connected after the connector 40 and the mating connector 10 are assembled.

First, the front retainer 13 is mounted at the partly locked position in the mating housing 11 as shown in FIG. 10. The mating terminal fittings 12 connected with the ends of the coaxial cables W are inserted into the respective mating terminal accommodating chambers 19 of the mating housing 11 from behind and along the inserting direction ID. The stabilizers 16 enter the respective stabilizer insertion grooves 23 so that the mating terminal fittings 12 are positioned circumferentially (prevented from rotation) and inserted smoothly.

The mating terminal fittings 12 temporarily deform the locking lances 20 in the inserting process. The locking lances 20 then restore resiliently when the mating terminal fittings 12 reach proper depths and engage the lance locking holes 15 to hold the mating terminal fittings 12 in the mating housing 11. The front retainer 13 then is pushed to the fully locked position. As a result, the deformation restricting portions 29 enter the corresponding deformation spaces 21, as shown in FIG. 13, to restrict deformations of the locking lances 20 engaged with the corresponding mating terminal fittings 12 and to increase forces for holding the mating terminal fittings 12.

The divided ground terminals 44 are mounted individually and from behind into the corresponding divided ground terminal accommodating chambers 63. The rear end of the partition 93 at the rear of the housing 41 reliably guides the side plates 80 into the side plate accommodating part 87 without entering the bracket accommodating chamber 51*a*.

On the other hand, the positioning ribs 90 are fit into the cutouts 83 of the main plates 78 of the divided ground terminals 44 in the inserting process from a state shown in FIGS. 41 and 43, and opposite side surfaces of the positioning ribs 90 slide along the lateral edges of the cutouts 83. Thus, the main plates 78 are positioned in the width direction WD with respect to the main plate accommodating parts 86. At this time, the terminal contact pieces 79 similarly are positioned with respect to the terminal contact piece communicating grooves 88.

The mounted terminal contact pieces 79 are in the corresponding terminal fitting accommodating chambers 61 to wait on standby and the bracket contact pieces 81 are in the bracket accommodating chamber 51*a* to wait on standby while being substantially vertically aligned, as shown in FIGS. 29 and 46. The respective terminal contact pieces 79 face the locking lances 64 at positions angularly spaced by about 180° therefrom. The bracket contact pieces 81 are at substantially vertically symmetrical positions in the bracket accommodating chamber 51*a* and vertically distant from the bracket locking piece 51*e* arranged in the intermediate position by substantially the same distance. In this mounted state, the positioning ribs 90 are fit in the cutouts 83 of the main plates 78 to hold the terminal contact pieces 79 and to prevent shaking in the width direction WD with respect to the corresponding terminal contact piece communicating grooves 88. Additionally, the positioning ribs 90 are held in contact with the peripheral edges of the cutouts 83 to reinforce the main plates 78. In this state, the respective retaining pieces 82 bite in the inner wall surfaces of the divided ground terminal accommodating chambers 63 to hold the divided ground terminals 44 in the housing 41.

The front retainer 43 can be at the partly locked position in the housing 41, as shown in FIG. 29, while the divided ground terminals 44 are being mounted. It does not matter if the front retainer 43 is mounted before the divided ground terminals 44 are mounted. The respective terminal fittings 42 connected with the ends of the coaxial cables W are inserted from behind into the corresponding terminal fitting accommodating chambers 61 from the state shown in FIG. 29. Thus, the stabilizers 46 enter the respective stabilizer insertion grooves 67 and the projections 48 are inserted into the respective projection insertion grooves 68 so that the terminal fittings 42 are positioned circumferentially (prevented from rotation) and inserted smoothly (see FIG. 46).

The terminal fittings 42 temporarily deform the locking lances 64 and the terminal contact pieces 79 in the inserting process. However, the locking lances 64 restore resiliently and engage the lance engaging portions 47 as shown in FIG. 30, when the terminal fittings 42 reach proper depths to hold the terminal fittings 42 in the housing 41. The front retainer 43 then is pushed to the fully locked position so that the deformation restricting portions 74 enter the corresponding deformation spaces 65, as shown in FIG. 32, to restrict deformations of the locking lances 64 engaged with the corresponding terminal fittings 42 and to increase the forces for holding the terminal fittings 42.

The terminal contact pieces 79 resiliently contact the bottom plates of the outer conductor terminals 45 of the terminal fittings 42 from outer sides in the vertical direction VD of the connector 40 in the mounted state shown in FIGS. 30 and 46. Accordingly, the terminal fittings 42 are held between the locking lances 64 and the terminal contact pieces 79 at the opposite sides to be received resiliently by both. The positioning ribs 90 position the terminal contact pieces 79 in the width direction WD with respect to the terminal fittings 42, as described above, to assure satisfactory contact.

Figure 33:
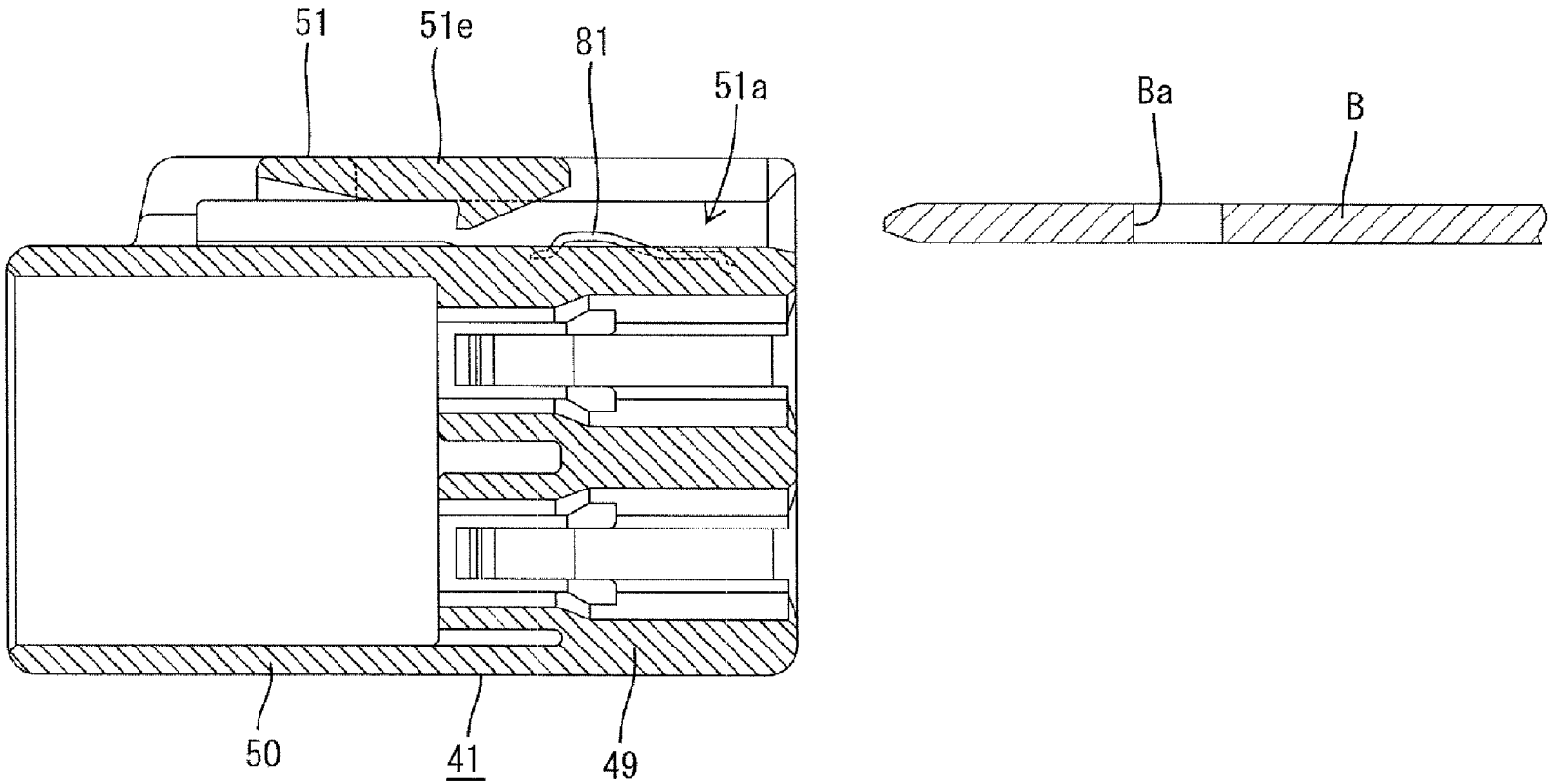
FIG. 33 is a section along G-G of FIG. 45 showing a state before the bracket is inserted into the housing.

The rear end of the partition 93 reliably guides the bracket B as the bracket B is inserted from behind into the bracket accommodating chamber 51*a* from a state shown in FIGS. 18 and 33 and ensures that the bracket B does not enter the side plate accommodating parts 87.

In the process of inserting the bracket B, the bracket locking piece 51*e* is deformed temporarily outwardly by the bracket B and/or both bracket contact pieces 81 are deformed resiliently inwardly. The lock projection aligns with the lock hole Ba when the bracket B reaches a proper depth. Thus, the bracket locking piece 51*e* is restored and the lock projection engage the recess edge of the lock hole Ba as shown in FIG. 34 to hold the housing 41 on the bracket B. In this mounted state, as shown in FIG. 46, the bracket contact pieces 81 arranged substantially in the vertical direction VD are resiliently in contact with the same plate surface of the bracket B facing in the radially inward direction of the connector 40 (facing toward the side opposite to the bracket locking piece 51*e*). The bracket contact pieces 81 contact the bracket B at substantially vertically symmetrical positions.

Figure 47:
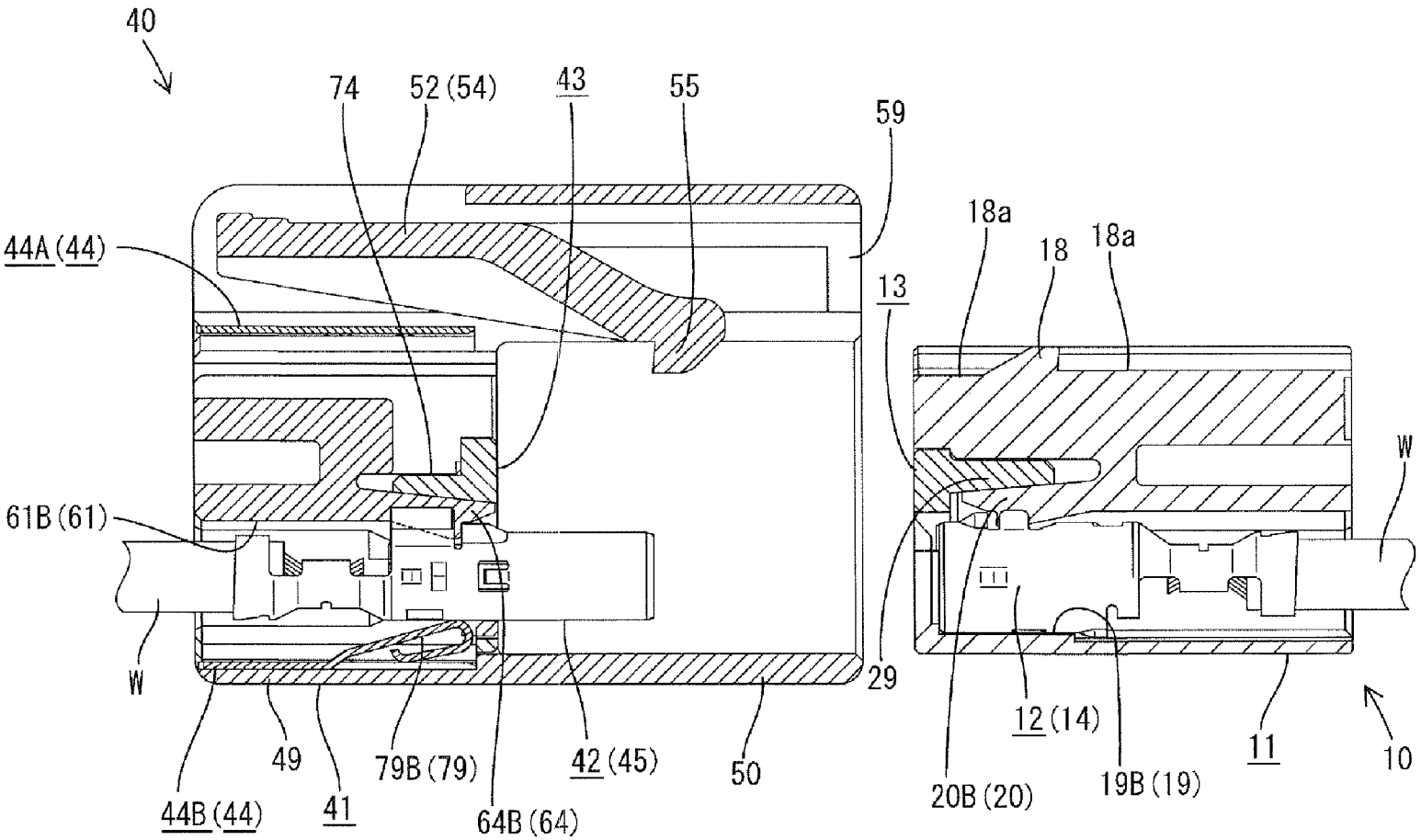
FIG. 47 is a side view in section showing a state before the two connectors are connected.
Figure 48:
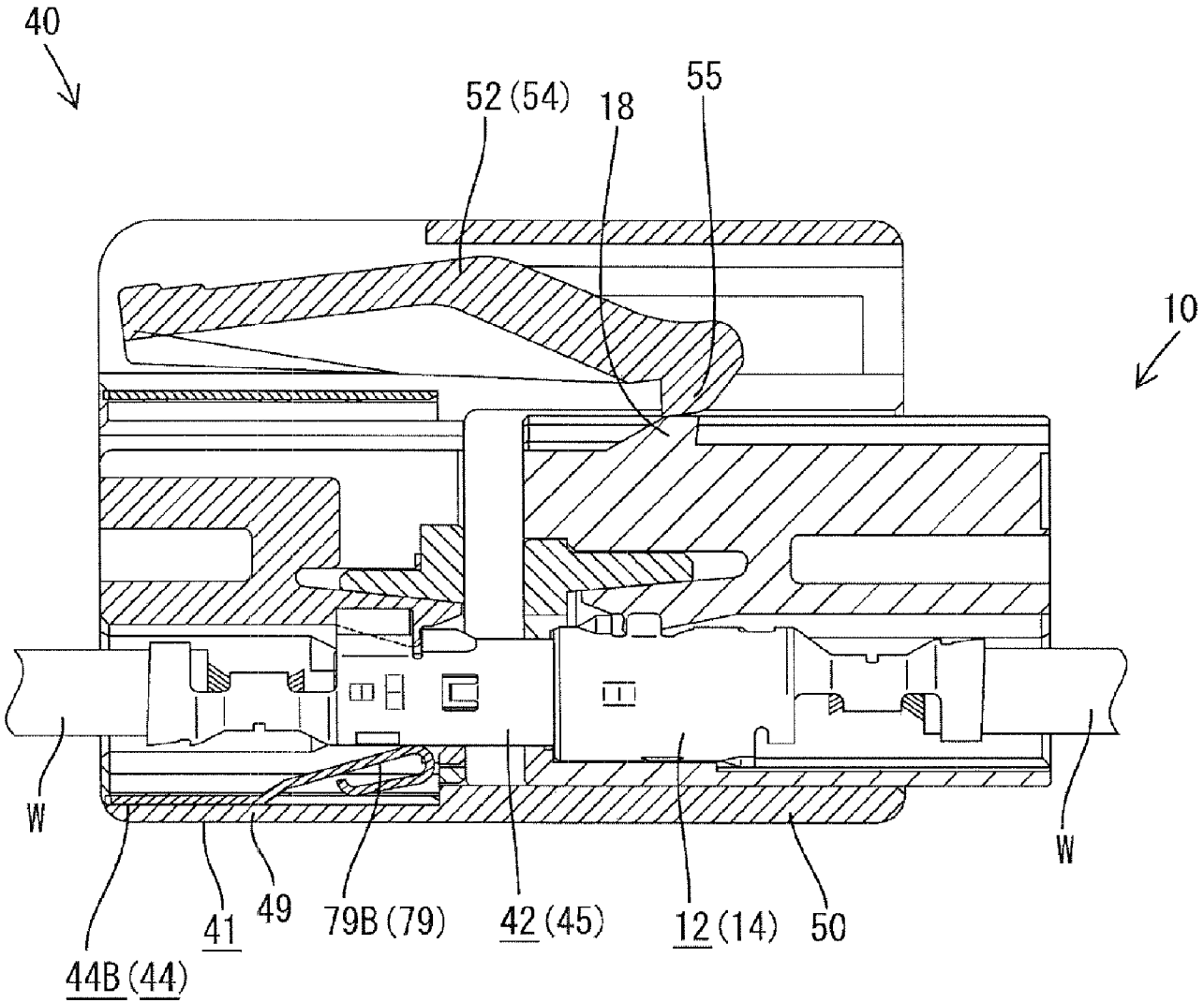
FIG. 48 is a side view in section showing an intermediate state of connecting the two connectors.
Figure 49:
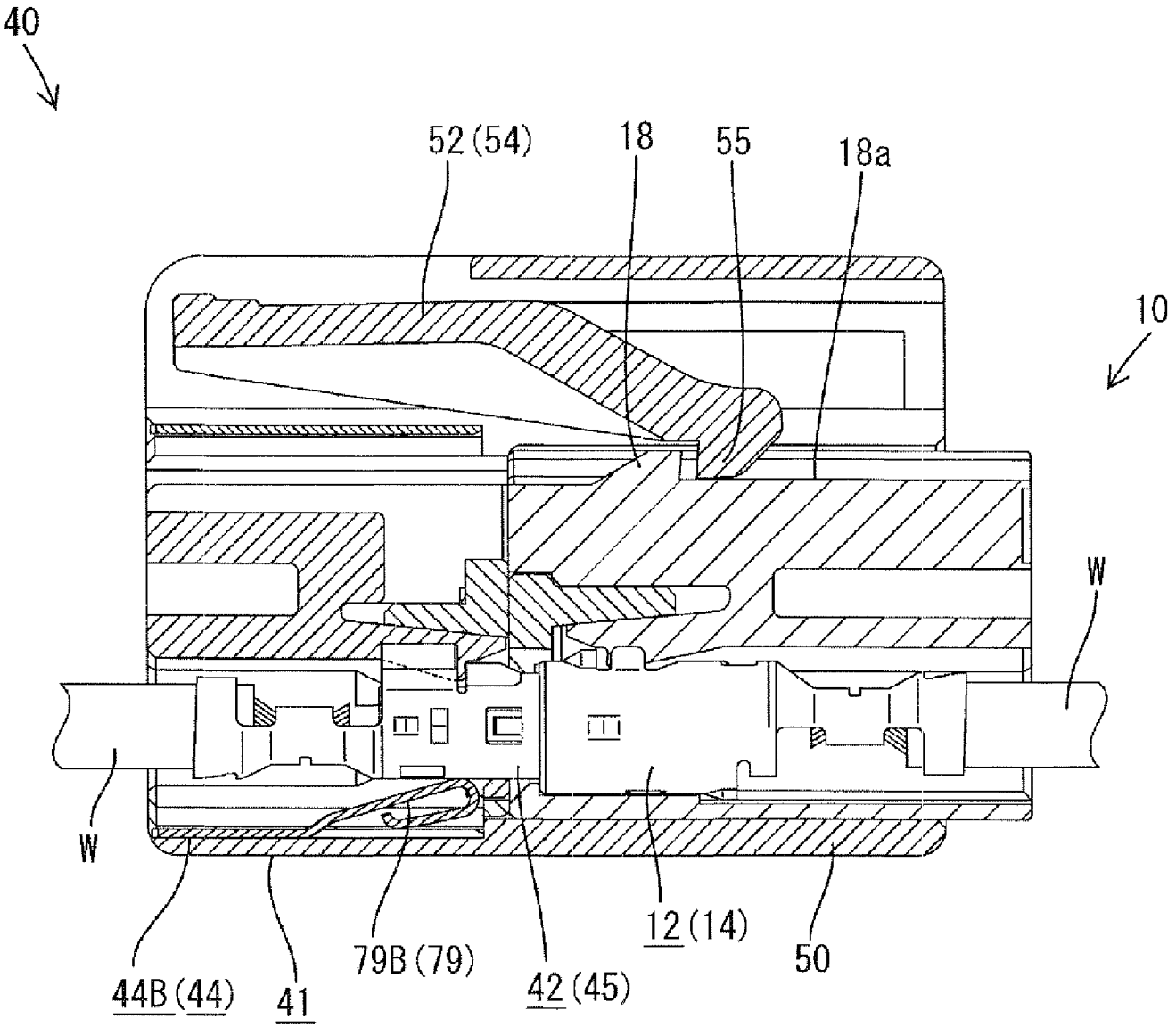
FIG. 49 is a side view in section showing a state where the two connectors are connected.
Figure 50:
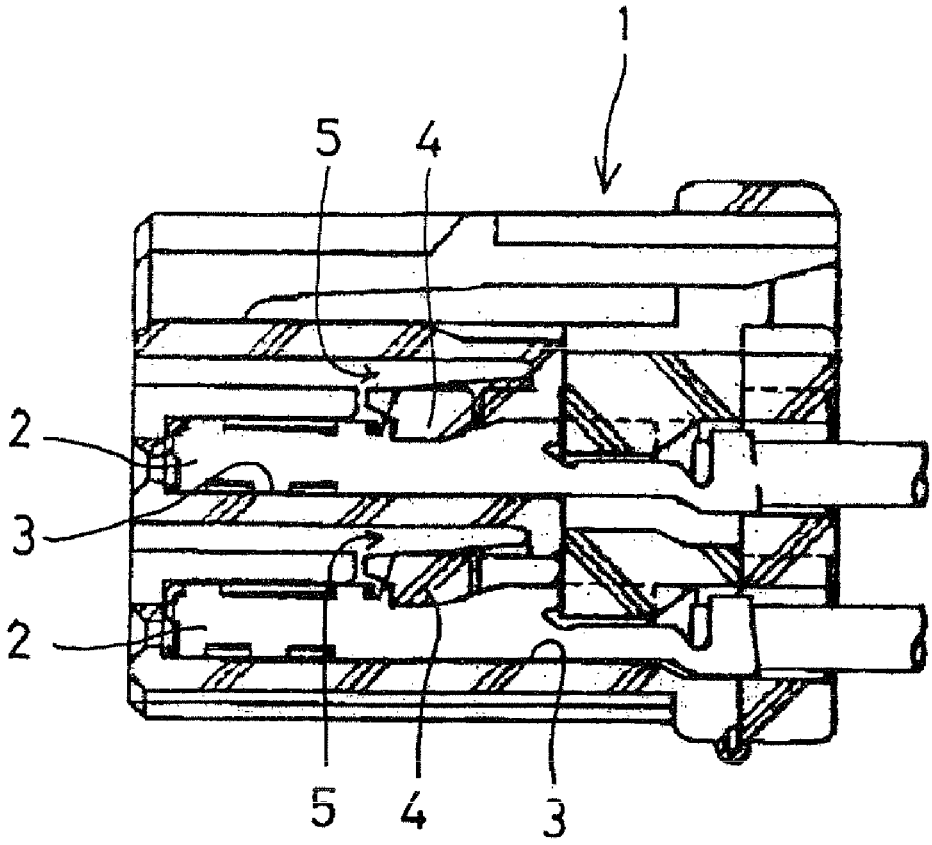
FIG. 50 PRIOR ART
FIG. 50 is a side view of a prior art connector.

Next, the mating connector 10 is fit into the receptacle 50 of the housing 41 from a state shown in FIG. 47. An attempt could be made to fit the mating housing 11 into the housing 41 with the connection surface inclined. In this case, the mating housing 11 will interfere with the inner peripheral surface of the receptacle 50 and could deform the receptacle 50 sufficiently to permit the oblique connection. However, the lock protecting portions 53 are connected by the reinforcements 59 to reinforce the receptacle 50. Therefore, it is difficult to deform the receptacle 50 and the oblique connection is prevented. An attempt also could be made to fit the mating housing 11 into the housing 41 in a vertically inverted posture. However, the inner peripheral surface of the receptacle 50 and the outer peripheral surface of the mating housing 11 are vertically asymmetric when viewed in the connecting direction. Therefore, the mating housing 11 interferes with the front end of the receptacle 50 to prevent connection in an improper posture The interlocking portion 55 of the lock arm 52 moves onto the lock 18 and the arm main body 54 is deformed, as shown in FIG. 48 when the mating housing 11 is fit into the housing 41 in the proper posture. The interlocking portion 55 then moves beyond the lock 18 and into the groove 18*a* when the mating housing 11 is fit to a substantially proper depth. Thus, the arm main body 54 restores resiliently so that the rear surface of the interlocking portion 55 engages the rear surface of the lock 18, as shown in FIG. 49. In this way, the two housings 11, 41 are held in the properly connected state.

Upon this proper connection, the outer conductor terminals 45 of the terminal fittings 42 are fit in the outer conductor terminals 14 of the mating terminal fittings 12, the projections 17 are held in contact with the outer peripheral surfaces of the outer conductor terminals 45 of the terminal fittings 42 and the inner conductor terminals of the terminal fittings 42 are held in contact with the inner conductor terminals of the mating terminal fittings 12. Thus, the ground wires of the connectors 10, 40 are connected electrically, and the signal wires are connected electrically. In this state, the respective terminal contact pieces 79 of both divided ground terminals 44 are in contact with the outer conductor terminals 45 of the respective terminal fittings 42 and both bracket contact pieces 81 are in contact with the bracket B. Accordingly, the ground wires of both connectors 10, 40 are connected electrically with the bracket B via the divided ground terminals 44 to achieve grounding.

The two connectors 10, 40 may have to be separated and the terminal fittings 12, 42 may have to be detached from the respective connectors 10, 40 for maintenance or another reason. In such a case, the operable portion 56 of the lock arm 52 is pressed to disengage the lock arm 52 from the lock 18 (FIG. 47) and the mating housing 11 is pulled apart from the receptacle 50. The operable grooves 32 of the front retainer 13 can be caught by the jig to move the front retainer 13 forward to the partly locked position (FIG. 11) after the two connectors 10, 40 are separated. The jig is manipulated to deform the locking lance 20 out of engagement with the mating terminal fitting 12 (FIG. 10), and the coaxial cable W is pulled while locking lance 20 is deformed. On the other hand, the jig is inserted into the jig insertion groove 69 of the housing 41 of the connector 40 from the front to catch the operable portion 75 of the front retainer 43 exposed to the jig insertion groove 69 after the connector 40 is detached from the bracket B. The jig then is operated forward to move the front retainer 43 to the partly locked position (FIG. 30). The locking lance 64 then is deformed to disengage from the terminal fitting 42 (FIG. 29) and the coaxial cable W then may be pulled.

Circumstances may necessitate a connector that has a different number of cables W and terminal fittings 42 in addition to the above connector 40. The divided ground terminals 44 used in the above connector 40 can be commonly used by making the construction of a housing of this connector partly common to that of the housing 41 of the above connector 40. Hence, the divided ground terminals 44 can be used commonly in a plurality of types of connectors with different numbers of contacts. Therefore cost reduction can be more promoted as compared with the case where divided ground terminals are produced as special parts for each type of the connector.

As described above, the connector 40 has the housing 41 with first terminal fitting accommodating chambers 61A arranged in the width direction WD for receiving first terminal fittings 42. A second terminal fitting accommodating chamber 61B is at a position adjacent to the first terminal fitting accommodating chambers 61A in the height direction HD, which is substantially normal to the arraying direction of the first terminal fitting accommodating chambers 61A. The second terminal fitting accommodating chamber 61B is between the first terminal fitting accommodating chambers 61A in the width direction WD and receives a terminal fitting 42. First locking lances 64A are in the first terminal fitting accommodating chambers 61A and are engageable with the inserted terminal fittings 42. The first locking lances 64A are resiliently deformable into the first deformation spaces 65A defined lateral to the second terminal fitting accommodating chamber 61B. The second locking lance 64B is arranged in the second terminal fitting accommodating chamber 61B and is engageable with the inserted terminal fitting 42. The second locking lance 64B is resiliently deformable into the second deformation space 65B defined between the first terminal fitting accommodating chambers 61A. Thus, the entire connector 40 can be miniaturized by as much as the overlap of the first deformation spaces 65A with the second terminal fitting accommodating chamber 61B and the overlap of the second deformation space 65B with the first terminal fitting accommodating chambers 61A in the height direction.

Similarly, the mating connector 10 has the mating housing 11 and the first mating terminal accommodating chambers 19A are arranged in the width direction WD in the mating housing 11 for accommodating the respective terminal fittings 12. The second mating terminal accommodating chamber 19B is adjacent to the first mating terminal accommodating chambers 19A in the height direction HD, which is substantially normal to the arraying direction of the first mating terminal fitting accommodating chambers 19A. Additionally, the second mating terminal accommodating chamber 19B is between the first mating terminal accommodating chambers 19A in the width direction WD. The first locking lances 20A are in the first mating terminal accommodating chambers 19A and are engageable with the inserted mating terminal fittings 12. The first locking lances 20A are resiliently deformable into the first deformation spaces 21A defined lateral to the second mating terminal accommodating chamber 19B. The second locking lance 20B is in the second mating terminal accommodating chamber 19B, for engaging the inserted mating terminal fitting 12. The second locking lance 20B is resiliently deformable into the second deformation space 21B defined between the first mating terminal accommodating chambers 19A. Thus, the entire connector 10 can be miniaturized by as much as the overlap of the first deformation spaces 21A with the second mating terminal accommodating chamber 19B and the overlap of the second deformation space 21B with the first mating terminal accommodating chambers 19A in the height direction HD.

The front retainer 43 is mountable into and detachable from the housing 41 along the inserting direction ID of the terminal fittings 42. The front retainer 43 includes the deformation restrictions 74 for entering the first and second deformation spaces 65A, 65B and restricting the deformations of the first and second locking lances 64A, 64B. The jig insertion groove 69 is between the first terminal fitting accommodating chambers 61A for receiving the jig to move the front retainer 43. Thus, the space between the first terminal fitting accommodating chambers 61A in the housing 41 is utilized effectively to achieve miniaturization.

Further, the jig insertion groove 69 communicates with the second deformation space 65B and the front retainer 43 has the operable portion 75 located in the jig insertion groove 69 for operation by the jig. Thus, as compared with the case where the jig insertion groove does not communicate with the second deformation space, the front retainer 43 is shorter since the operable portion 75 is near the deformation restricting portion 74 to be at inserted into the second deformation space 65B.

The housing 41 has the second excessive deformation preventing portion 66B facing the second locking lance 64B with the second deformation space 65B located therebetween and capable of preventing an excessive deformation of the second locking lance 64B. The jig insertion groove 69 is formed by partly cutting off the excessive deformation preventing portion 66B. Thus, the jig insertion groove 69 can be formed while a function of preventing the excessive resilient deformation of the second locking lance 64B is ensured. Therefore a higher function is promoted while keeping the housing 41 small.

The second excessive deformation preventing portions 66B are provided at the opposite sides of the jig insertion groove 69. Thus, the function of preventing the excessive resilient deformation of the second locking lance 64B is exhibited satisfactorily.

The housing 41 has the retainer mount recess 62 for receiving the front retainer 43. The retainer mount recess 62 is adjacent to the first terminal fitting accommodating chambers 61A in the height direction HD and lateral to the second terminal fitting accommodating chamber 61B. Thus, the spaces in the housing 41 lateral to the second terminal fitting accommodating chamber 61B are utilized effectively to achieve miniaturization. The mating connector 10 is constructed similarly and similar effects can be obtained.

The retainer mount recess 62 is arranged lateral to the first deformation spaces 65A. Thus, a part of the front retainer 43 to be mounted into the retainer mount recess 62 is arranged lateral to the deformation restrictions 74 to be inserted into the first deformation spaces 65A. Thus, the front retainer 43 can be miniaturized in the height direction HD. The mating connector 10 is constructed similarly and similar effects can be obtained.

The housing 41 is connectable with the mating housing 11 and includes the lock arm 52 for holding the mating housing 11 in the connected state. The lock arm 52 is between the first terminal fitting accommodating chambers 61A and partly overlaps the first terminal fitting accommodating chambers 61A in the height direction HD. Thus, the housing 41 can be miniaturized in the height direction by as much as the overlap of the lock arm 52 with the first terminal fitting accommodating chambers 61A in the height direction HD.

The number of the first terminal fitting accommodating chambers 61A and the number of the second terminal fitting accommodating chamber 61B in the housing 41 differ and the connecting peripheral surface of the housing 41 with the mating housing 11 is asymmetric when viewed in the connecting direction. Thus, connection is prevented if the mating housing 11 is in an improper posture during a connection operation. This is more suitable for miniaturization as compared with the case where connection in an improper posture is prevented by a rib on the connecting peripheral surface.

The invention is not limited to the above described and illustrated embodiment. For example, the following embodiments are also embraced by the technical scope of the present invention.

Three terminal fitting accommodating chambers are arranged in the above embodiment. However, the invention is also applicable to connectors in which four or more terminal fitting accommodating chambers are arranged. In such cases, it does not matter even if the numbers of the first and second terminal fitting accommodating chambers are equal.

The terminal fitting accommodating chambers are arranged in upper and lower levels in the above embodiment. However, the invention is also applicable to connectors in which terminal fitting accommodating chambers are arranged in three or more vertical levels.

The jig insertion groove splits the second excessive deformation preventing portion and communicates with the second deformation space in the connector of the above embodiment. However, it may not communicate with the second deformation space according to the invention. Then, the strength of the second excessive deformation preventing portion is increased and the second locking lance can be received over the entire width to improve the excessive deformation preventing function.

The second excessive deformation preventing portion is split into two sections by the jig insertion groove in the above-described connector. However, the second excessive deformation preventing portion may be at only one side by adjusting the position or width of the jig insertion groove.

Although the jig insertion groove is formed by partly cutting off the second excessive deformation preventing portion in the above-described connector, it may be formed by entirely cutting off the second excessive deformation preventing portion according to the present invention.

The jig insertion groove overlaps the first terminal fitting accommodating chambers in the height direction in the above-described embodiment. However, it need not overlap the first terminal fitting accommodating chambers in the height direction according to the invention. Further, the jig insertion groove may be omitted according to the invention.

The jig insertion groove only is between the first terminal fitting accommodating chambers in the above-described connector. However, a jig insertion groove may be between the first mating terminal accommodating chambers, and/or the front retainer may have an operable portion located in the jig insertion groove while the jig insertion groove communicates with the second deformation space, and/or the jig insertion groove may be formed by partly cutting off the second excessive deformation preventing portion, and/or the jig insertion groove may be formed while splitting the second excessive deformation preventing portion into two sections in the mating connector.

The front retainers have individual deformation restricting portions corresponding to the respective deformation spaces in the connector and mating connector of the above embodiment. However, a front retainer may have a deformation restricting portion insertable into plural deformation spaces.

The positions of the retainer mount recesses can be changed.

The lock arm overlaps both first terminal fitting accommodating chambers in the height direction in the connector of the above embodiment. However, the lock arm may not overlap the first terminal fitting accommodating chambers in the height direction HD according to the invention.

The connecting peripheral surfaces of the two housings are vertically asymmetric when viewed from front in the above embodiment. However, housings with laterally asymmetric connecting circumferential surfaces also are embraced by the invention. Further, symmetrically shaped connecting circumferential surfaces also are embraced by the invention.

The connector and the mating connector have the front retainers in the above embodiment. However, connectors with no front retainer or having lateral or back type retainers also are embraced by the invention.

A plurality of divided ground terminals are mounted in the connector of the above embodiment. However, only one ground terminal may be mounted according to the invention. Further, the invention also embraces connectors with no ground terminal and accommodating terminal fittings connected with normal insulated wires including no outer conductors and the like.

Although the connector is mounted on the bracket in the above embodiment, the invention is also applicable to connectors that are not mounted on brackets.

Although the main portion of the outer conductor terminal of each terminal fitting is cylindrical in the above embodiment, it may be box-shaped.

What is claimed is:

1. A connector, comprising:

a housing;

first terminal fitting accommodating chambers arranged in an arrangement direction in the housing for receiving first terminal fittings;

at least one second terminal fitting accommodating chamber for receiving at least one second terminal fitting, the second terminal fitting accommodating chamber being adjacent the first terminal fitting accommodating chambers in a direction aligned at an angle to the arrangement direction and being between the first terminal fitting accommodating chambers in the arrangement direction;

first locking lances in the first terminal fitting accommodating chambers and being engageable with the first terminal fittings, the first locking lances being resiliently deformable into first deformation spaces defined at least partly lateral to the second terminal fitting accommodating chamber; and at least one second locking lance in the second terminal fitting accommodating chamber and being engageable with the second terminal fitting, the second locking lance being resiliently deformable into a second deformation space at least partly between the first terminal fitting accommodating chambers.

2. The connector of claim 1, further comprising a retainer that is detachably mounted the housing, the retainer having at least one deformation restricting portion capable of entering the first and second deformation spaces and restricting deformations of the locking lances.

3. The connector of claim 2, wherein the retainer is mountable into and detachable from the housing along an inserting direction of the terminal fittings, and a jig insertion groove is formed in the housing at a position between the first terminal accommodating chambers for receiving a jig for moving the retainer.

4. The connector of claim 3, wherein the jig insertion groove communicates with the second deformation space, and the retainer has an operable portion in the jig insertion groove.

5. The connector of claim 3, wherein an excessive deformation preventing portion faces into the second deformation space of the housing at a position opposed to the second locking lance for preventing excessive deformation of the second locking lance.

6. The connector of claim 5, wherein the jig insertion groove is formed by partly cutting off the excessive deformation preventing portion.

7. The connector of claim 5, wherein two of the excessive deformation preventing portions are provided at substantially opposite sides of the jig insertion groove.

8. The connector of claim 2, wherein a retainer mount recess is formed in the housing adjacent to the first terminal accommodating chambers in the direction and at least partly lateral to the second terminal accommodating chamber for receiving the retainer.

9. The connector of claim 8, wherein the retainer mount recess is arranged lateral to the first deformation spaces.

10. The connector of claim 1, wherein the housing is connectable with a mating housing and includes at least one lock arm for holding the mating housing in a connected state.

11. The connector of claim 10, wherein the lock arm is at least partly arranged between the first terminal accommodating chambers and formed to partly overlap the first terminal accommodating chambers in the direction substantially normal to the arrangement direction.

12. The connector of claim 1, wherein the number of the first terminal accommodating chambers and the number of the second terminal accommodating chamber in the housing differ.

13. The connector of claim 12, wherein the housing is connectable with a mating housing, and a connecting circumferential surface of the housing with the mating housing is asymmetric when viewed in a connecting direction.

14. The connector of claim 1, wherein the first and second locking lances are substantially aligned on a straight line in the arrangement direction and are arranged substantially at the same positions in the direction substantially normal to the arrangement direction.

15. The connector of claim 1, wherein the central positions of the respective terminal fitting accommodating chambers are located at the vertices of an equilateral triangle.

* * * * *